US006331043B1

(12) United States Patent
Shimazu et al.

(10) Patent No.: US 6,331,043 B1
(45) **Date of Patent: *Dec. 18, 2001**

(54) LIQUID DISCHARGING METHOD, A LIQUID DISCHARGE HEAD, AND A LIQUID DISCHARGER APPARATUS

(75) Inventors: Satoshi Shimazu, Yokohama; Hiroshi Sugitani, Machida; Kazuaki Masuda, Kawasaki; Masami Ikeda, Seki-machi; Hiroyuki Ishinaga, Tokyo; Toshio Kashino, Chigasaki; Masahiko Kubota, Tokyo; Aya Yoshihira, Yokohama; Kiyomitsu Kudo, Kawasaki, all of (JP)

(73) Assignee: Canon Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/089,427

(22) Filed: Jun. 3, 1998

(30) Foreign Application Priority Data

Jun. 6, 1997 (JP) ..... 9-149379
Jun. 6, 1997 (JP) ..... 9-149382

(51) Int. Cl.[7] ..... B41J 2/14; B41J 2/05
(52) U.S. Cl. ..... 347/48; 347/65; 347/67
(58) Field of Search ..... 347/48, 65, 20, 347/56, 57, 63, 67

(56) References Cited

U.S. PATENT DOCUMENTS

| | | | | |
|---|---|---|---|---|
| 4,435,721 | | 3/1984 | Tsuzuki et al. | 347/48 |
| 4,480,259 | | 10/1984 | Kruger et al. | 347/63 |
| 4,542,391 | * | 9/1985 | Miyagawa | 347/65 |
| 4,723,129 | | 2/1988 | Endo et al. | 347/56 |
| 4,965,594 | | 10/1990 | Komuro | 347/62 |
| 4,994,825 | | 2/1991 | Saito et al. | 347/63 |
| 5,185,615 | | 2/1993 | Koitabashi et al. | 347/35 |
| 5,208,604 | | 5/1993 | Watanabe et al. | 347/47 |
| 5,280,299 | | 1/1994 | Saikawa et al. | 347/87 |
| 5,389,957 | | 2/1995 | Kimuar et al. | 347/20 |
| 5,574,488 | | 11/1996 | Tamura | 347/63 |
| 5,589,858 | | 12/1996 | Kadowaki et al. | 347/14 |
| 5,602,576 | | 2/1997 | Murooka et al. | 347/59 |

FOREIGN PATENT DOCUMENTS

| | | | | |
|---|---|---|---|---|
| 195 17 969 | | 11/1995 | (DE) . | |
| 737581 | | 10/1996 | (EP) . | |
| 2306399 | | 5/1997 | (GB) . | |
| 55-81172 | | 6/1980 | (JP) . | |
| 59-26270 | | 2/1984 | (JP) . | |
| 61-59911 | | 3/1986 | (JP) . | |
| 61-59914 | | 3/1986 | (JP) . | |
| 61-69467 | | 4/1986 | (JP) . | |
| 361252165 | * | 11/1986 | (JP) | 347/48 |
| 63-151459 | | 6/1988 | (JP) . | |
| 63-199972 | | 8/1988 | (JP) . | |
| 1-247168 | | 10/1989 | (JP) . | |
| 4-329148 | | 11/1992 | (JP) . | |
| 5-229122 | | 9/1993 | (JP) . | |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid discharging method for discharging liquid, which uses the pressure exerted at the time of creating each of bubbles in liquid in a bubble generating area, is arranged to provide two bubble generating areas for generating bubbles in such a manner as to enable these areas to face each other at least partly, hence discharging liquid by means for the pressure thus exerted in the bubble generating areas. In this way, it becomes possible to increase the amount of liquid discharged, as well as to enhance the durability of the movable members, while stabilizing the discharge of liquid from each of the discharge openings.

33 Claims, 29 Drawing Sheets

LIQUID DISCHARGING METHOD, A LIQUID DISCHARGE HEAD, AND A LIQUID DISCHARGER APPARATUS

BACKGROUND OF THE INVENTION

1. Field of the Invention

The present invention relates to a liquid discharging method, a liquid jet head, and a liquid discharge apparatus for discharging a desired liquid using air bubbles created by the application of thermal energy that acts upon the liquid. More particularly, the invention relates to a liquid discharge head and a liquid discharge apparatus provided with a movable member and/or a movable separation film which is displaceable by the utilization of the air bubbles thus created.

The present invention is also applicable to a printer for recording on a recording medium, such as paper, thread, fabric, cloth, leather, plastic, glass, wood, or ceramics, as well as applicable to a copying machine, a facsimile equipment provided with communication systems, a word processor and other apparatuses having a printing unit therefor. Further, the present invention is applicable to a recording system for industrial use, which is complexly combined with various processing apparatuses.

Here, the term "recording" referred to in the description of the present invention means not only the provision of images having characters, graphics, or other meaningful representation, but also, it means the provision of those images, such as patterns, that do not present any particular meaning.

2. Related Background Art

There has been known the so-called bubble jet recording method, which is an ink jet recording method whereby to form images on a recording medium by discharging ink from discharge openings by means of acting force exerted by the change of states of ink brought about by the abrupt voluminal changes (creation of air bubbles) when thermal energy or the like is applied to ink in accordance with recording signals. For the recording apparatus that uses the bubble jet recording method, it is generally practiced, as disclosed in the specifications of U.S. Pat. No. 4,723,129 and others, that the apparatus is provided with the discharge openings that discharge ink; the ink paths conductively connected to the discharge openings; and electrothermal transducing elements arranged in each of the ink paths as means for generating energy for discharging ink.

In accordance with such recording method, it is possible to record high quality images at high speeds with a lesser amount of noises. At the same time, the head that executes this recording method makes it possible to arrange the discharge openings for discharging ink in high density, with the excellent advantage, among many others, that images are made recordable in high resolution, and that color images are easily obtainable by use of a smaller apparatus. In recent years, therefore, the bubble jet recording method is widely adopted for many kinds of office equipment, such as a printer, a copying machine, a facsimile equipment. Further, this recording method is utilized even for industrial systems, such as a textile printing, among some others.

Also, in order to obtain high quality images, there has been proposed a driving condition for the provision of a liquid discharging method or the like that may be able to execute excellent ink discharges on the basis of the stabilized air bubble creation that enables ink to be discharged at higher speeds. Also, with a view to making higher recording possible, there has been proposed an improved flow path configuration in order to obtain a liquid discharge head that may be able to perform a higher refilling of liquid at each time liquid is discharged. One example of such proposal is disclosed in the specification of Japanese Patent Application Laid-open No. 63-199972. The invention thus disclosed is such that the backwaves, which are generated along the creation of the air bubble (the pressure exerted in the opposite direction of the discharge opening, that is, the pressure directed to the liquid chamber 1012), are arranged to reside in the initial position which is away from the air bubble creation area formed by each of the heat generating devices. Then, the valve, which is positioned on the side opposite to the discharge opening with respect to the heat generating device, is postured as if to attach to the ceiling by the presence of such backwaves. This valve is then allowed to hand down into the flow path along with the creation of each of the air bubbles. This invention is to suppress the energy loss by controlling part of such backwaves by use of the valve in such a manner as disclosed in the specification of the above-mentioned application.

On the other hand, there have been disclosed in the specifications of Japanese Patent Application Laid-open No. 61-69467, Japanese Patent Application Laid-open No. 55-81172, and U.S. Pat. No. 4,480,259, among some others, a method for discharging liquid by enabling the pressure exerted by bubble generation to be carried over to the discharge liquid, while arranging to make use of the liquid (bubble generating liquid) that creates air bubbles by the application of heat, and the liquid that performs discharging (discharge liquid) separately. In the specification of these publications, the ink that serves as the discharge liquid and the bubble generating liquid are completely separated by means of a movable separation film formed by silicone rubber or the like. Thus, the discharge liquid is not allowed to contact the heat generating devices directly. Here, at the same time, the structure is arranged so that the pressure exerted by the bubbke generation of the bubble generating liquid is carried over to the discharge liquid by utilizing the deformation of the movable separation film. With structure thus arranged, it is attainable to prevent the deposit from being accumulated on the surface of each of the heat generating devices, as well as to make the selection of discharge liquids more freely.

In addition, the structure that uses a large film for separating the entire body of a head into the upper part and lower part thereof is disclosed in the specification of Japanese Patent Application Laid-open No. 59-26270. The large film thus disclosed is nipped aby the two plate members that form liquid flow paths. The plate members are provided for the purpose of preventing liquids from being mixed with each other in the two flow paths thus provided.

Also, there is disclosed in Japanese Patent Application Laid-open No. 5-229122 the structure under which, while providing special features for a bubble generating liquid itself, this liquid is used at a lower boiling point than that of a discharge liquid in order to maintain the bubble generation characteristics of such liquid. There is also the structure that uses a conductive liquid as a bubble generating liquid as disclosed in Japanese Patent Application Laid-open No. 4-329148.

However, since the head that separates the discharge liquid and the bubble generating liquid completely as described above is structured to carry over the pressure exerted at the time of bubble generationto the discharge liquid by means of the deformation of the movable separation film that may result from its expansion, a considerable amount of bubble generation pressure is absorbed by the movable separation film eventually. Also, the amount of deformation cannot be made larger enough. Therefore, although it is possible to separate the discharge liquid and the bubble generating liquid, there is a possibility that the energy efficiency and the discharge force are made lower after all.

SUMMARY OF THE INVENTION

The present invention is designed from the point of views not taken into consideration for the conventional art. It is the main objectives of the invention is to enhance the basic discharge characteristics of the method wherein liquid is discharged fundamentally by the conventional formation of air bubbles in the liquid flow paths (particularly the creation of air bubble following each film boiling), which is elevated to such a high standard that has never been attainable by the application of the conventional art.

The inventors hereof have ardently studied the fundamental principle of liquid droplet discharges with a view to providing a new method for discharging liquid droplets, the head, and the like by the utilization of the air bubbles, which cannot be obtained by the application of the conventional art. Here, while making the studies of the kind, the inventors hereof have conducted a first technical analysis beginning with the operation of the movable member in each of the liquid flow paths, such as to analyze the principle of the mechanism of the movable member in the flow path; a second technical analysis beginning with the principle of liquid droplet discharges by means of the creation of air bubbles; and a third technical analysis beginning with the area of the air bubble formation for the heat generating devices to be used for the air bubble formation.

Then, it has been known that in consideration of the energy given by the air bubble itself to the amount of discharge, the most significant factor that contributes to enhancing the discharge characteristics remarkably is the development component on the downstream side of the air bubble among those factors taken into account in this respect. Here, in other words, it has been found that the enhancement of the discharge efficiency and discharge speed are brought about by the effective transformation of the development component on the downstream side of the air bubble so that it is guided in the direction of liquid discharge. With this finding, the inventors hereof have acquired an extremely high technical standard, as compared with the conventional art, in which the development component on the downstream side of the air bubble can be transferred positively to the free end side of the movable member.

Further, it has been found preferable that the structural elements should be considered with respect to the heat generating area for the formation of air bubbles, such as the one on the downstream side of the line running the center of the area in the flow direction of the liquid for each of the electrothermal transducing devices or with respect to the movable members, the flow paths, and the like, which are related to the development of the air bubbles on the downstream side of the area center or the like on the surface on which bubble generation is effectuated.

Also, with such structure optimally provided, the air bubble generating area and the movable member are arranged to face each other along the flow paths to make it possible to reduce and eliminate the smaller droplets (satellites) which fly with a slight delay from the majority of the flying ink droplets when these droplets and the remaining ink are cut off in the flow path by the pulling force of the surface tension of ink in the vicinity of the discharge opening.

Meanwhile, it is also found possible to enhance the refilling speed significantly by taking the structural arrangement of the movable member and the supply path into consideration.

With the knowledge and overall view acquired by such studies as described above, the inventors hereof have found the principle of excellent liquid discharge and finally designed the invention taken out herein.

The major objectives of the present invention are as follows:

It is a first object of the invention to provide a liquid discharging method, a liquid jet head, and a liquid discharge apparatus, capable of increasing the amount of liquid discharged from discharge openings, and enhancing the refilling speed at the same time.

It is another object of the invention to provide a liquid discharging method, a liquid jet head, and a liquid discharge apparatus, capable of enhancing the durability of the movable member arranged in each flow path.

It is still another object of the invention to provide a liquid discharging method, a liquid jet head, and a liquid discharge apparatus, capable of stabilizing the discharge condition of droplets from the discharge openings.

It is a further object of the invention to provide a liquid discharging method, a liquid jet head, and a liquid discharge apparatus, capable of controlling the amount of displacement of the movable members.

Meanwhile, the inventors hereof have solved the problem that arises when the space should be made smaller for the formation of a gap that should become the air bubble generating area. In other words, when the air bubble should be created in the air bubble generating area, such air bubble is created on the upstream side of the discharge opening in the flow direction of the discharge liquid. However, since the width and length of the air bubble generating area itself are the same as those of the heat generating unit, the movable member is made displaceable only vertically by the creation of each air bubble with respect to the direction of the discharge liquid. Therefore, it becomes impossible to obtain a sufficient discharge speed for the effective discharge operation. Here, the present invention is designed to materialize the efficient discharge operation by giving attention particularly to the fact that such drawback is brought about by the repeated use of the same bubble generating liquid only in the closed small space at all times.

Therefore, it is still another object of the invention to provide a liquid discharging method and a liquid discharge apparatus structured to separate the discharge liquid and the bubble generating liquid essentially or more preferably structured to separate them completely by use of the movable film, which is made capable not only of preventing the pressure from escaping to the upstream side, but also, of guiding the pressure in the direction of the discharge openings so as not to lose the discharge efficiency when the pressure is guided in the direction of liquid discharge by the deformation of the movable film by the application of pressure exerted by foaming. In this manner, the amount of liquid discharge is increased, and the refilling speed is enhanced.

It is still another object of the invention to provide a liquid discharging method, a liquid jet head, and a liquid discharge apparatus, capable of attempting the stabilization of discharge condition of liquid droplets from each of the discharge openings.

Also, it is a further object of the invention to provide a liquid discharging method and a liquid discharge apparatus, capable of reducing the amount of the deposit accumulated on each of the heat generating devices by the adoption of the structure described above, and capable of discharging liquid in good efficiency without giving thermally affecting the liquid to be discharged.

It is still a further object of the invention to provide a liquid discharging method and a liquid discharge apparatus, having more freedom of selection of discharge liquids irrespective of its viscosities and material compositions.

Also, it is another object of the invention to provide a liquid discharging method for discharging liquid using pressure exerted at the time of creating air bubbles in an air bubble generating area for creating them in the liquid. Here, the two air bubble generating areas are arranged to face each other at least partly. Then, the liquid is discharged by use of the pressure exerted in the two air bubble generating areas.

Also, it is another object of the invention to provide a liquid discharging method for discharging liquid using pressure exerted at the time of creating air bubbles in an air bubble generating area for creating them in the liquid by displacing a movable member provided with its free end on the discharge opening side with respect to its movable fulcrum point. Here, the air bubble generating area and the movable member are arranged to be in two sets to face with other at least partly, and by allowing the two movable members to come closer to each other for discharging the liquid.

Also, it is another object of the invention to provide a liquid discharge head which comprises at least a discharge opening for discharging liquid; a discharge liquid flow path provided with air bubble generating area for creating air bubbles, and conductively connected with the discharge opening. Here, the two air bubble generating areas are arranged to face each other at least partly.

Also, it is another object of the invention to provide a liquid discharge head which comprises discharge openings for discharging liquid; discharge liquid flow paths each provided with air bubble generating area for creating air bubbles, and conductively connected with the discharge opening; a substrate provided with heat generating devices each arranged in the air bubble generating area for generating heat for creating the air bubbles; movable members each provided with its free end on the discharge opening side, and arranged in each of the discharge liquid flow paths to face the heat generating device. Then, the liquid is discharged from the discharge openings when the movable members are displaced each by the pressure exerted by the creation of the air bubble. Here, the heat generating device and the movable member are arranged to be in two sets to face each other at least partly.

It is another object of the invention to provide a liquid discharge head which comprises discharge openings for discharging liquid; discharge liquid flow paths each provided with air bubble generating area for creating air bubbles, and conductively connected with the discharge opening; a substrate provided with heat generating devices each arranged in the air bubble generating area for generating heat for creating the air bubbles; movable members each provided with its free end on the discharge opening side, and arranged in each of the discharge liquid flow paths to face the heat generating device. Here, the liquid is discharged from the discharge openings when the movable members are displaced each by the pressure exerted by the creation of the air bubble, and the heat generating device and the movable member are arranged to be in two sets to allow the movable members themselves to face each other at least partly.

Also, it is another object of the invention to provide a method for discharging liquid for discharging liquid by displacing a movable separation film substantially separating a discharge liquid flow path conductively connected with a discharge opening for discharging liquid, and a bubble generating liquid flow path provided with an air bubble generating area for creating air bubble in the liquid from each other at all times on the upstream side than the discharge opening side with respect to the liquid flow in the discharge liquid flow path. Here, the air bubble generating area, the bubble generating liquid flow path, and the movable separation film are arranged to be in two set to allow the movable regions of the movable separation films to face each other at least partly with the discharge liquid flow path being sandwiched between them, and the two movable separation films are displaced to come closer to each other.

Also, it is another object of the present invention to provide a liquid discharge head for a liquid discharge apparatus which comprises discharge liquid flow paths conductively connected with discharge openings for discharging liquid; bubble generating liquid flow paths each provided with the air bubble generating area for creating air bubbles in the liquids; heat generating devices each arranged in the air bubble generating area to generate heat for creating the air bubbles; and movable separation films for separating the discharge liquid flow path and the bubble generating liquid flow path substantially from each other at all times. Here, the liquid is discharged from the discharge openings by displacing the movable separation films by the pressure exerted by the creation of the air bubbles, and the liquid discharge head is provided with the heat generating device, the bubble generating liquid flow path, and the movable separation film being arranged to be in two sets to allow at least parts of the movable ranges of the movable separation films to face each other with the discharge liquid flow path between them.

In accordance with the present invention structured as described above, a set of a heat generating device arranged in the air bubble generating area for generating heat to create air bubbles, and a movable member provided with its free end on the discharge opening side, are arranged in the discharge liquid flow path to face the heat generating device, and then, the two sets of them are arranged to face each other at least partly so that two movable members are displaced to come closer to each other along the creation of the air bubble. It is assumed that the structure thus arranged for discharging liquid in the discharge liquid flow path from each of the discharge openings is the optimal structure, but it is to be understood that the variations of such structure which will be described later are also within the scope of the present invention.

The example of the optimal structure makes it possible to discharge liquid in the discharge liquid flow path from each of the discharge openings by means of the displacements of the two movable members. It is, therefore, possible to increase the amount of liquid discharge more, as well as to enhance the durability of the movable members as compared with the case where the displacement is performed by one movable member.

Also, the floating force is generated on the portion sandwiched between two movable members when each of the air bubbles is expanded to the maximum. This floating force contains the component perpendicular to the liquid flow in the discharge liquid flow path. Therefore, it becomes possible to enhance the refilling speed when the movable members return to the original positions before displacement.

Also, if the two movable members are arranged to be in contact with each other at least partly when each of the air bubbles is expanded to the maximum, it is possible to implement the stabilization of the amount of liquid discharged from each of the discharge openings.

Also, with the adjustment of the area ratio between the two heat generating devices, it becomes possible to control the amount of liquid discharged from each of the discharge openings.

Also, if the structure is arranged so that two movable members are displaced at timings different from each other, it becomes possible to suppress the regression of meniscus, while promoting the refilling of liquid.

Also, if the structure is arranged so that one of the two movable members can regulate the displacement of the other movable member when each of the air bubbles is expanded, it becomes possible to stabilize the discharges.

In addition, the structure is arranged so as to provide the heat generating device arranged in the air bubble generating area for generating heat to create them; the bubble generating liquid flow path provided with the air bubble generating area; and the movable separation film that separates the discharge liquid flow path and the bubble generating liquid flow path substantially from each other at all times in two sets to face each other with the discharge liquid flow path between them. Here, then, if the two movable separation films are displaced to come closer to each other, it is made possible to discharge liquid in the discharge liquid flow path from each of the discharge openings, as well as to increase the amount of liquid discharge more as compared with the case where the displacement is effectuated by use of one movable separation film.

Also, the floating force is generated on the portion sandwiched between two movable separation films when each of the air bubbles is expanded to the maximum. This floating force contains the component perpendicular to the liquid flow in the discharge liquid flow path. Therefore, it becomes possible to enhance the refilling speed when the movable members return to the original positions before displacement.

The structure is arranged so that when the movable separation films are displaced to the discharge liquid flow path side along the creation and development of each of the air bubbles, the portion of the movable separation film on the downstream side is displaced larger to the discharge liquid flow path side than the portion thereof on the upstream side. Therefore, it becomes possible to discharge liquid in the discharge liquid flow path from each of the discharge openings efficiently by the creation of each of the air bubbles in the discharge liquid flow path.

In the case where means for regulating direction, which is provided with its free end on the downstream side than the end portion of the air bubble generating area on the upstream side and its fulcrum point on the upstream side than the aforesaid free end on the discharge liquid flow path side of the movable separation film, respectively, and which is arranged adjacent to the movable separation film, it becomes possible to suppress the displacement of the movable separation film to the bubble generating liquid path when the air bubble is defoamed, and also, to implement the enhancement of the refilling characteristics and the reduction of crosstalks.

When a sagged portion is provided for each of the movable separation films, which extrudes to the bubble generating liquid flow path side at the time of non-foaming, and extrudes to the discharge liquid flow path side at the time of foaming, it becomes possible to guide the pressure exerted by the creation of each air bubbles in the air bubble generating area to the discharge opening side of the discharge liquid flow path stably. Hence, liquid in the discharge liquid flow path can be discharged from each of the discharge openings by means of the created air bubble efficiently and stably.

BRIEF DESCRIPTION OF THE DRAWINGS

FIG. 9A shows the heat signal applied to the heat generating device of the liquid discharge head represented in FIG. 6; and FIG. 9B shows the heat signal applied to the heat generating device of the liquid discharge head represented in FIG. 8.

FIG. 15A is a view which shows it, observed from the discharge opening side; and FIG. 15B is a cross-sectional view which shows it, observed in the direction of the liquid flow path.

FIGS. 24A, 23B, 23C, 23D and 24E are cross-sectional views which illustrate a second example of the liquid discharging method applicable to the present invention.

FIG. 26A shows it, observed from the discharge opening side; FIG. 26B is a cross-sectional view which shows it, observed in the direction of liquid flow path.

DETAILED DESCRIPTION OF THE PREFERRED EMBODIMENTS

Figure 1A:
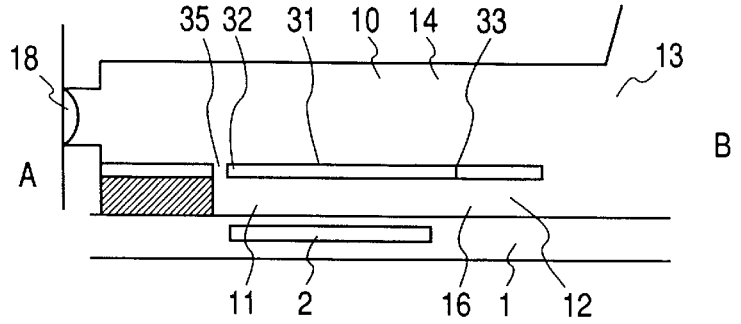
FIGS. 1A, 1B, 1C, and 1D are the cross-sectional views which illustrate one structural example of a liquid discharge head in accordance with the present invention.

Before describing the embodiments specifically in accordance with the present invention, the description will be made, at first, of the most fundamental structure that enables the discharge force and discharge efficiency to be enhanced by controlling the propagating direction of the pressure exerted by foaming, and the development direction of air bubble as well when liquid is discharged in accordance with the present invention.

FIGS. 1A to 1D are the cross-sectional views which illustrate one structural example of the liquid discharge head of the present invention. FIG. 2 is a partially broken perspective view which shows the liquid discharge head represented in FIG. 1.

Now, as shown in FIGS. 1A to 1D, the heat generating device 2 (a heat generating resistor of 40 $\mu$m×105 $\mu$m for the present embodiment) is arranged on an elemental substrate 1 as the one adopted for activating thermal energy on liquid to be discharged from the liquid discharge head of the present embodiment. Then, the liquid flow path 10 is arranged on the elemental substrate corresponding to the heat generating device 2. The liquid flow path 10 is conductively connected with the discharge opening 18. At the same time, it is conductively connected with the common liquid chamber 13 from which liquid is supplied to a plurality of liquid flow paths 10, each of which receives liquid from the common liquid chamber 13 in an amount corresponding to the amount of liquid to be discharged from each of the discharge openings.

Above the elemental substrate where each of the liquid flow paths is arranged, the plate type movable member 31 is arranged in a cantilever fashion, with a flat portion, which is formed by an elastic material, such as metal, to face the heat generating device 2. One end of the movable member is fixed to a base (a supporting member) 34 or the like, which is formed on the wall of the liquid flow path 10 or on the elemental substrate by patterning the photosensitive resin or the like. In this manner, the movable member is supported, and provided with a fulcrum (supporting portion) 33.

The movable member 31 is provided with the fulcrum (supporting portion; fixed end) 33 on the upstream side of the large flow that runs from the common liquid chamber 13 to the discharge opening 18 side through the movable member 31 by the liquid discharge operation. This member is arranged in a position to face the heat generating device 2 with a gap of approximately 15 $\mu$m from the heat generating device 2 to cover it so that its free end (free end portion) 32 is placed on the downstream side with respect to the fulcrum 33. The gap between the heat generating device and the movable member becomes the air bubble generating area. In this respect, the kinds, the configurations, and the arrangement of the heat generating device and movable member are not necessarily limited to those described above. It should be good enough if only the configuration and arrangement thereof are such as to be able to control the development of air bubble and the propagation of pressure as well. Here, the liquid flow path 10 described above is divided into two regions with the movable member 31 serving as the boundary thereof: that is, the portion which is conductively connected directly with the discharge opening 18 is defined as the first liquid flow path 14, and the one which is provided with the air bubble generating area 11 and the liquid supply path 12 as the second liquid flow path 16. With this division, the description will be made of the liquid flow to be dealt with later.

When the heat generating device 2 is heated, liquid residing on the air bubble generating area 11 between the movable member 31 and the heat generating device 2 is thermally activated. Thus, the air bubble is created by means of the film boiling phenomenon occurring in liquid as disclosed in the specification of U.S. Pat. No. 4,723,129. The pressure and air bubble exerted and created on the basis of the creation of the air bubble act upon the movable member preferentially. Therefore, the movable member 31 is displaced centering on the fulcrum 33 as shown in FIGS. 1B, 1C, or shown in FIG. 2 to enable it to open widely on the discharge opening side. By the displacement of the movable member 31 or in accordance with the opening state thereof, the pressure exerted by the creation of air bubble is propagated to the discharge opening side, and also, the development of air bubble itself is guided thereto.

Here, the description will be made of one of the fundamental principles of discharge, which is applied to the present invention.

For the present invention, one of the most important principles is that the free end of the movable member, which is arranged to face the air bubble generating area, is preferentially displaced from the first position in the stationary state to the second position after the displacement by means of the pressure exerted by air bubble or the air bubble itself. Then, with the movable member 31 thus displaced, the pressure exerted by the creation of air bubble and the air bubble itself are guided to the downstream side where each of the discharge openings 18 is arranged.

Now, this principle of discharge will be described further in detail with the comparison between FIG. 3 which schematically shows the conventional structure of liquid flow path without using any movable member, and FIG. 4 which schematically shows the structure of liquid flow path of the present invention.

Figure 3:
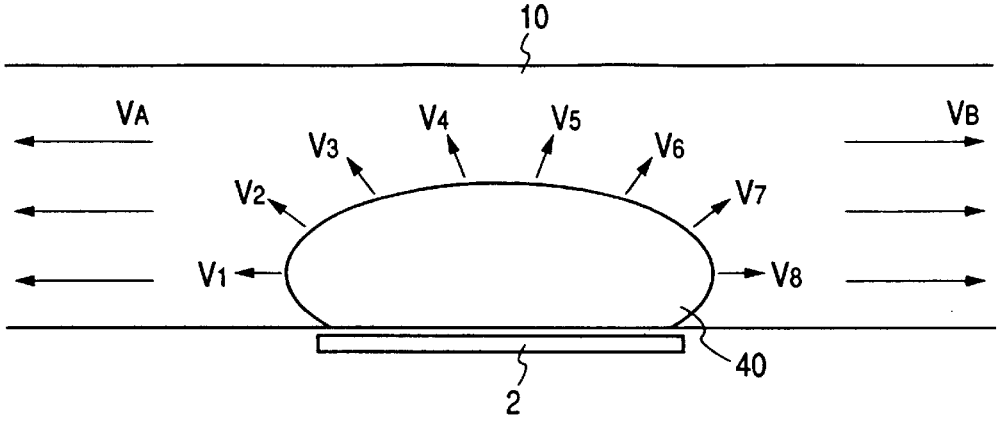
FIG. 3 PRIOR ART
FIG. 3 is a cross-sectional view which shows schematically the propagation of pressure from an air bubble created in the conventional liquid jet head.

FIG. 3 is a view which schematically shows the pressure propagation from the air bubble in the conventional liquid jet head. FIG. 4 is a view which schematically shows the pressure propagation from the air bubble in the liquid discharge head of the present invention. Here, the direction of pressure propagation toward the discharge opening is designated by a reference mark $V_A$, and the direction of pressure propagation toward the upstream side as $V_B$.

As shown in FIG. 3, the conventional head is not provided with any structure that regulates the propagating direction of pressure exerted by the created air bubble 40. As a result, the propagating directions of pressure exerted by the air bubble 40 become those of the normal lines on the surface of the air bubble as indicated by the reference marks $V_1$ to $V_8$, and the pressure propagation is directed variously. Of these directions, those designated by the marks $V_1$ to $V_4$ are provided with the components in the pressure propagating directions toward the $V_A$ that particularly affects the liquid discharge most, that is, the components in the pressure propagating directions nearer to the discharge opening from the position almost half of the air bubble. These are in the important portions that contribute directly to the effectiveness of discharge efficiency, discharge force, discharge speed, and some others. Further, the one designated by the mark $V_1$ functions efficiently because it is nearest in the direction of $V_A$. On the contrary, the one designated by the mark $V_4$ contains a comparatively small directional component toward $V_A$.

Figure 4:
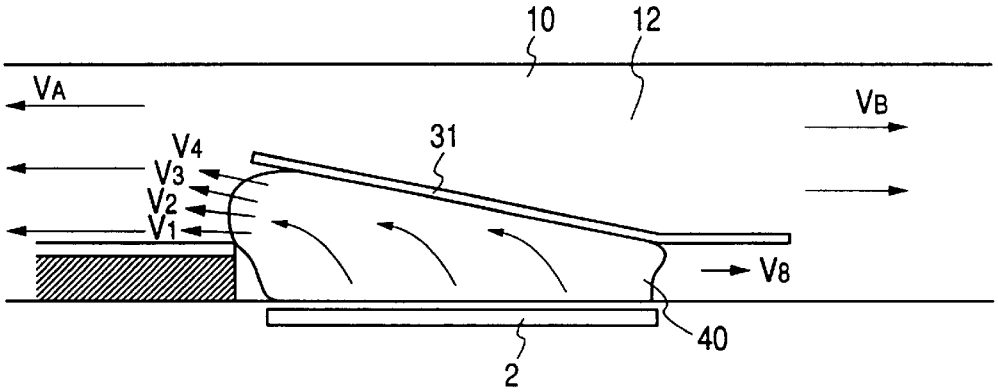
FIG. 4 is a cross-sectional view which shows schematically the propagation of pressure from an air bubble created in the liquid discharge head in accordance with the present invention.

As compared with this structural arrangement, the structure of the present invention shown in FIG. 4 is arranged to provide the movable member 31 which functions to lead the various pressure propagating directions $V_1$ to $V_4$ of the air bubble shown in FIG. 3 to the downstream side (discharge opening side), and to convert them into the pressure propagating direction designated by the reference mark $V_A$. In this manner, the development of the air bubble 40 itself is also directed toward the discharge opening. Then, the pressure exerted by the air bubble 40 becomes directly contributable to the efficient discharge. Also, the developing direction of the air bubble itself is led to the downstream side as in the pressure being propagated in the directions $V_1$ to $V_4$. As a result, the air bubble is developed larger in the downstream side than in the upstream side. Hence, the developing direction of the air bubble itself is controlled by use of the movable member, and the pressure propagating direction of the air bubble is also controlled to make it possible to attain the basic enhancement of the discharge efficiency, discharge force, and discharge speed, among some others.

Now, reverting to FIGS. 1A to 1D, the detailed description will be made of the discharge operation of the liquid discharge head described above.

Figure 1B:
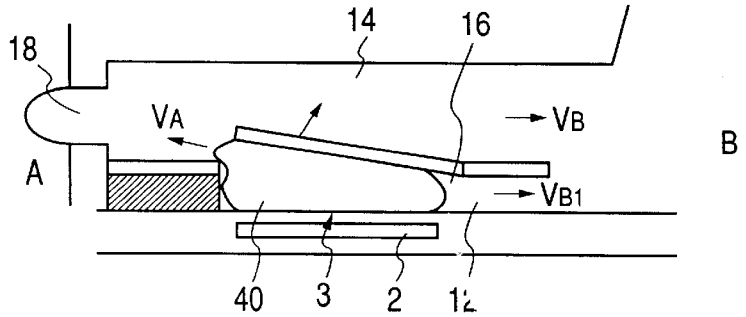
Figure 1C:
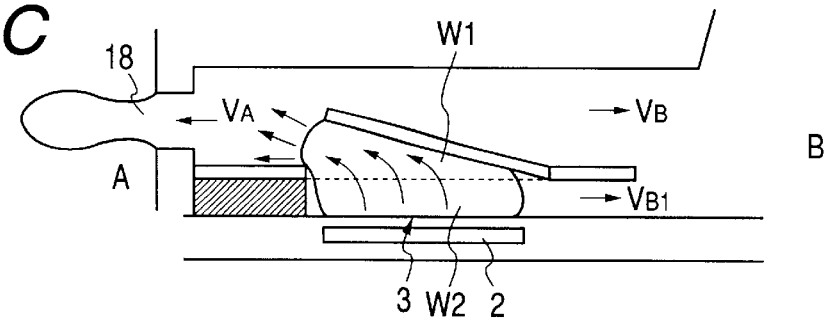
Figure 2:
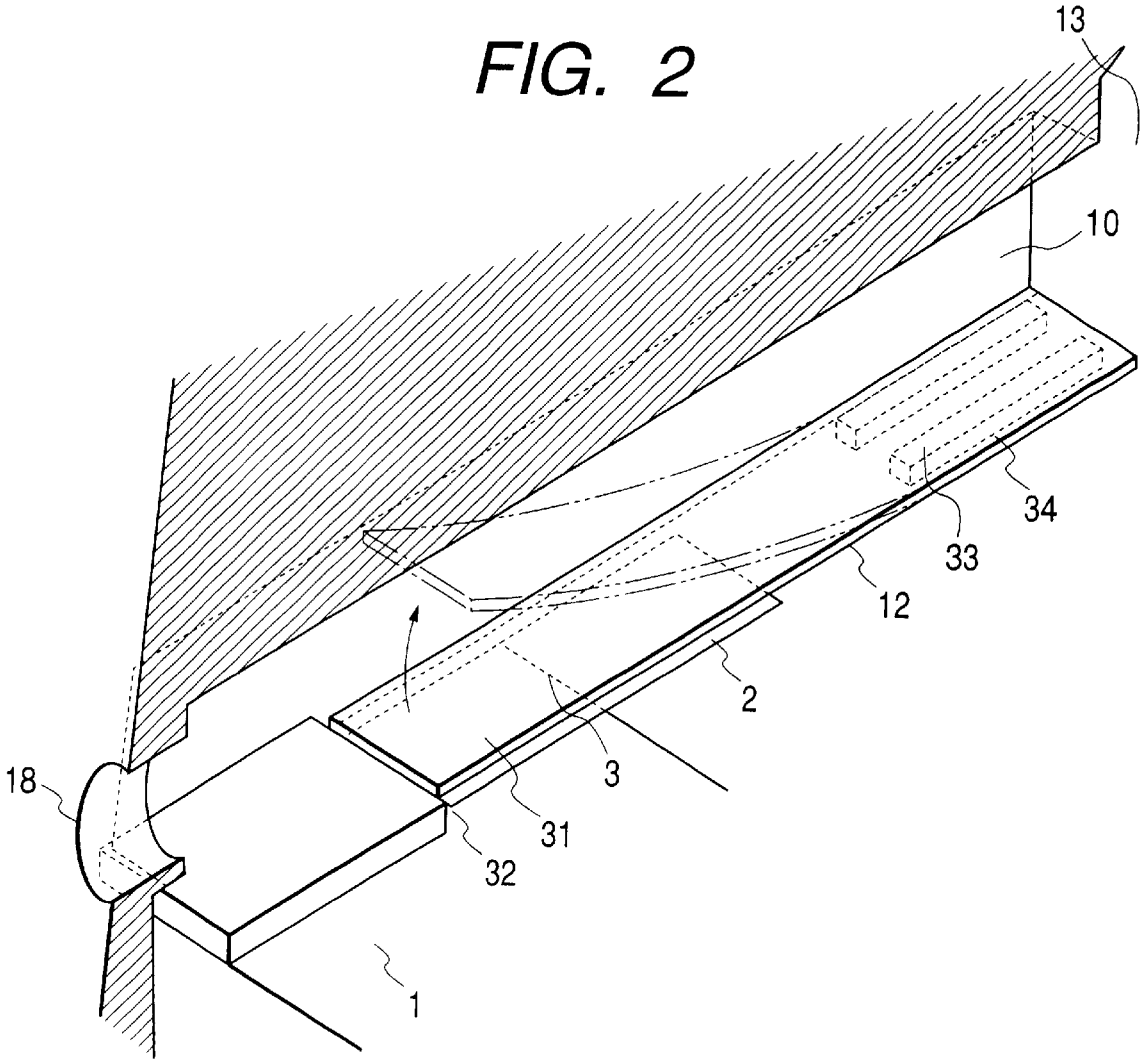
FIG. 2 is a partially broken perspective view which shows the liquid discharge head represented in FIGS. 1A, 1B, 1C and 1D.

FIG. 1A shows the condition before the application of energy, such as electric energy, to the heat generating device 2. What is important here is that the movable member 31 is positioned in a place where an air bubble faces at least the portion on the downstream side with respect to the air bubble created by the application of heat generated by the heat generating device. In other words, the movable member 31 is arranged on the liquid flow path structure and set in the position to cover at least the downstream of the area center 3 of the heat generating device (the downstream of the line orthogonal to the longitudinal direction of the liquid flow path, which runs through the area center 3 of the heat generating device).

FIG. 1B shows the condition that electric energy or the like is applied to the heat generating device 2 to energize it, and by the heat thus generated, a part of liquid filled in the air bubble generating area 11 is heated, hence creating an air bubble following film boiling.

At this juncture, the movable member 31 is displaced from the first position to the second position by the pressure exerted by the creation of the air bubble 40 so that the pressure propagating direction of the air bubble 40 is guided in the direction toward the discharge opening. As described earlier, what is important here is that the free end 32 of the movable member 31 is arranged on the downstream side (discharge opening side), while the fulcrum point 33 is arranged to be positioned on the upstream side (common liquid chamber side), so that at least a part of the movable member should be allowed to face the downstream portion of the heat generating device, that is, the downstream portion of the air bubble.

FIG. 1C shows the condition that the air bubble 40 has developed further. Here, in accordance with the pressure being exerted following the creation of the air bubble 40, the movable member 31 has further displaced. The created air bubble is developed larger on the downstream than the upstream. At the same time, its development becomes greater beyond the first position (position indicated by dotted line) of the movable member. In this manner, the movable member 31 is gradually displaced as the air bubble 40 is being developed. With its gradual displacement, the developing direction of the air bubble is guided uniformly in the direction in which the pressure propagation and sedimentary shift of the air bubble 40 are facilitated, that is, the direction toward the free end side of the movable member, and, conceivably, this gradual displacement contributes to enhancing the discharge efficiency. When the air bubble and the air bubble pressure are guided in the direction toward the discharge opening, the movable member does not hinder this propagation at all. It can control the pressure propagating direction and the developing direction of the air bubble efficiently in accordance with the size of pressure to be propagated.

Figure 1D:
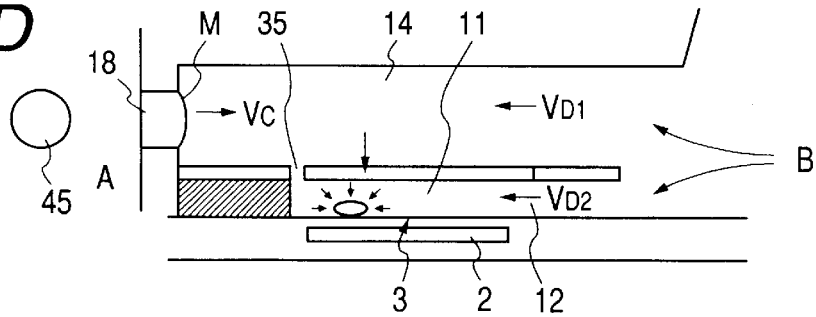

FIG. 1D shows the condition that the air bubble 40 is contracted due to the reduction of its inner pressure after the film boiling described earlier, and it is extinct.

The movable member 31 that has been displaced to the second position returns to the initial position (the first position) shown in FIG. 1A by the restoration force exerted by the negative pressure generated by the contraction of the air bubble and the spring property of the movable member itself as well. Also, when defoaming, liquid flows in from the upstream side at B, namely, the common liquid chamber side, as indicated by the reference marks $V_{D1}$ and $V_{D2}$, as well as from the discharge opening side as indicated by the reference mark $V_C$ in order to compensate the contracted volume of the air bubble, and also, to compensate the voluminal portion of the liquid that has been discharged.

So far, the description has been made of the operation of the movable member following the creation of air bubble and the discharge operation of liquid as well. Hereinafter, the detailed description will be made of the refilling of liquid for the liquid discharge head applicable to the present invention.

After the condition shown in FIG. 1C, the air bubble 40 enters the extinct process through its maximum voluminal condition. Then, liquid flows in the air bubble generating area from the first liquid flow path 14 on the discharge opening 18 side, as well as from the second liquid flow path 16 on the common liquid chamber 13 side, in a volume to compensate the volume that has been extinct. For the conventional liquid flow path structure where no movable member 31 is provided, the volume of liquid that flows in the bubble disappearance position from the discharge opening side and the volume of liquid that flows in it from the common liquid chamber side are determined by the intensity of flow resistance between the portion nearer to the discharge opening than the air bubble generating area, and the portion nearer to the common liquid chamber (that is, brought about by the flow path resistance and the liquid inertia).

Therefore, if the flow resistance is smaller on the side nearer to the discharge opening, a large amount of liquid flows in the defoaming position from the discharge opening side to allow the regressive amount of meniscus to become larger. Particularly, the more it is intended to enhance the discharge efficiency by making the flow resistance smaller on the side nearer to the discharge opening, the greater becomes the regression of the meniscus M at the time of bubble removing. As a result, the refilling time takes longer to hinder the implementation of a higher printing.

In contrast, since the movable member 31 is provided for the structure hereof, the regression of the meniscus comes to a stop at the point where the movable member has returned to the original position when bubble removing, provided that the upper side of the volume W of the air bubble is defined as W1 and the air bubble generating area 11 side as W2 with the first position of the movable member 31 serving as boundary. After that, the remaining voluminal portion of the W2 is compensated mainly by the liquid supplied from the second flow path 16, which flows as indicated by the reference mark $V_{D2}$. In this way, while the amount corresponding to approximately a half of the volume W of the air bubble has become the regressive amount of the meniscus in accordance with the conventional art, it is possible for the present invention to suppress the regressive amount of meniscus to approximately a half of the volume W1 which is already much smaller than the regressive amount required for the conventional art.

Further, it is possible to compulsorily conduct the liquid supply for the voluminal portion of the W2 mainly from the upstream side ($V_{D2}$) of the second liquid flow path along the movable member 31 on the surface side of the heat generating device by the utilization of the pressure exerted at the time of bubble removing. As a result, a higher refilling can be materialized.

Here, characteristically, when refilling is executed using the pressure exerted at the time of deforming for the conventional head, the vibration of meniscus becomes greater, leading to the degradation of image quality. However, with the high-speed refilling hereof, it is possible to make the vibration of the meniscus extremely small, because the liquid flow is suppressed on the area of the first liquid flow path 14 on the discharge opening side and the air bubble generating area 11 on the discharge opening side as well.

Thus, with the structure applicable to the present invention, it is possible to attain the compulsory refilling to the air bubble generating area through the second liquid flow path 16 of the liquid supply path 12, and also, it is possible to attain the high-speed refilling by suppressing the regression and vibration of the meniscus as referred to above. As a result, the stabilized discharges and high-speed repetition of discharges can be performed reliably. Also, when applying it to recording, the enhancement of image quality and high-speed recording can be materialized.

Further, the structure applicable to the present invention dually provides the effective functions as given below. In other words, it is possible to suppress the pressure propagation (back waves) resulting from the creation of the air bubble to the upstream side. Inside an air bubble created on a heat generating device 2, most of the pressure exerted by it on the common liquid chamber side (upstream side) becomes a force (the back waves) that pushes back liquid to the upstream side. The back waves result not only in the pressure existing on the upstream side, but also, in the shifting amount of liquid that may be caused by them, which inevitably exert the inertial force following such shift of liquid flow. The presence of the back waves may also produce unfavorable effect on the performance of liquid refilling into the liquid flow paths, hence hindering the attempted high-speed driving. Here, with the structure applicable to the present invention, such unfavorable action working upon the upstream side is suppressed at first by means of the movable member 31. Then, it is made possible to enhance the performance of refilling supply of liquid still more.

Now, the description will be made of the structure and effects which are more characteristic of the structure applicable to the present invention.

The second liquid flow path 16 of this structure is provided with a liquid supply path 12 having the inner wall (where the surface of the heat generating device does not fall down largely), which is essentially connected with the heat generating device 2 flatly on the upstream thereof. In such a case, the liquid supply to the air bubble generating area 11 and to the surface of the heat generating device is executed along the surface of the movable member 31 on the side nearer to the air bubble generating area 11 as indicated by the reference mark $V_{D2}$. As a result, the stagnation of liquid on the surface of the heat generating device 2 is suppressed to make it easier to remove the deposition of gas remaining in liquid, as well as the so-called remaining bubbles yet to be defoamed. Also, there is no possibility that the heat accumulation on liquid becomes too high. In this respect, it is possible to preform more stabilized creation of air bubbles repeatedly at high speeds. Here, the description has been made of the liquid supply path 12 having an inner wall, which is essentially flat, but this structure is not necessarily limited to such configuration. It should be good enough if only the liquid supply path as a smooth inner wall connected with the surface of the heat generating device smoothly, and is configured so that there is no possibility that liquid is stagnated on each of the heat generating devices, nor there is a possibility that any large disturbance of flow takes place when supplying liquid.

Also, the liquid supply to the air bubble generating area is performed from the $V_{D1}$ through the side portion (slit 35)

of the movable member. However, in order to guide the pressure to the discharge opening more effectively at the time of foaming, a large-sized movable member is used as shown in FIGS. 1A to 1D so as to cover the air bubble generating area entirely (to cover the surface of the heat generating device). Then, if the mode is such that the flow resistance of liquid becomes greater in the air bubble generating area 11 and the area nearer to the discharge opening of the first liquid flow path 14, the flow of liquid from the aforesaid $V_{D1}$ toward the air bubble generating area 11 is hindered. Nevertheless, the head structure hereof is provided with the flow $V_{D2}$ for supplying liquid to the air bubble generating area. Therefore, the liquid supply performance becomes extremely high, and there is no possibility that the liquid supply performance is lowered even if the structure is arranged so that the movable member 31 covers the air bubble generating area 11 for the enhancement of the discharge efficiency.

Figure 5:
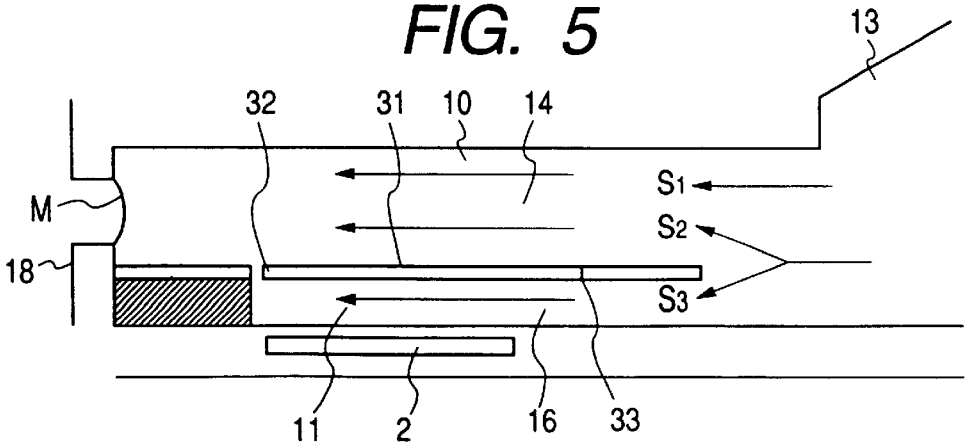
FIG. 5 is a cross-sectional view which illustrates schematically the flow of liquid in the liquid discharge head in accordance with the present invention.

Now, the free end 32 and the fulcrum point 33 of the movable member 31 are arranged so that the free end is relatively positioned on the downstream side than the fulcrum point as shown in FIG. 5, for example.

FIG. 5 is a view which schematically illustrates the liquid flow in the liquid jet heat in accordance with the present invention.

The present embodiment is structured as shown in FIG. 5, which makes it possible to efficiently materialize the function of and the effect in guiding the pressure propagating direction and the developing direction of the air bubble in the direction toward the discharge opening side at the time of bubble generation as described earlier. Further, the positional relationship as represented in FIG. 5 not only presents the function and effect with respect to liquid discharge, but also, makes it possible to make the flow resistance smaller with respect to the liquid that flows in the liquid flow path 10 when the liquid is supplied. Therefore, a high-speed refilling is effectively attained. This is possible because the free end and the fulcrum point 33 are arranged not to present any resistance to the flows $S_1$, $S_2$, and $S_3$ which run in the liquid flow path 10 (including the first liquid flow path 14, and the second liquid flow path 16) when the regressive meniscus M caused by the discharge operation is restored to the discharge opening 18 by means of capillary attraction or when the liquid is supplied at the time of bubble removing.

To supplement the description of this arrangement, the free end 32 of the movable member 31 is extensively arranged to face the heat generating device 2 as described earlier with respect to the structure shown in FIGS. 1A to 1D so that this end is positioned on the downstream side of the area center 3 (the line orthogonal to the longitudinal direction of the liquid flow path, which runs through the area center (the center) of the heat generating device) that divides the heat generating device 2 into the upstream region and the downstream region. In this manner, the pressure or the air bubble created on the downstream side of the area center 3 of the heat generating device, which largely contributes to the liquid discharge, is received by the movable member 31 to guide this pressure or this air bubble to the discharge opening side, hence materializing the basic enhancement of the discharge efficiency and discharge force.

Here, in addition, various effects also become obtainable by the initialization of the upstream side of the air bubble.

Further, it is conceivable that the instantaneous mechanical displacement of the free end of the movable member 31, which is performed with the structure arranged as applicable to the present invention, should contribute effectively to the execution of liquid discharges.

Now, with reference to the accompanying drawings, the description will be made of the embodiments in accordance with the present invention.

(First Embodiment)

FIGS. 6A to 6F are views which illustrate the liquid discharge head in accordance with a first embodiment of the present invention.

As shown in FIGS. 6A to 6F, the present embodiment is provided with a discharge opening 18 arranged for an orifice plate 18*a*; heat generating devices 2*a* and 2*b* arranged on the elemental substrates 1*a* and 1*b*, respectively, to cause thermal energy to act upon liquid; the discharge liquid flow path 15 having in it bubble generating areas 11*a* and 11*b* positioned to face the heat generating devices 2*a* and 2*b* for creating the air bubble of the liquid, which is conductively connected with the discharge opening 18; and movable members 31*a* and 31*b* arranged in the discharge liquid flow path 15, each having the free end on the discharge opening 18 side, and each of them being arranged to face the respective heat generating devices 2*a* and 2*b*. The movable members 31*a* and 31*b* are fixed to the elemental substrates 1*a* and 1*b*, respectively, through each of the bases 33*a* and 33*b*. Here, a reference numeral 18*b* designates the adhesive layer for fixing the orifice plate 18*a*.

Now, hereunder, the description will be made of the operation of the liquid discharge head structured as described above.

Figure 6A:
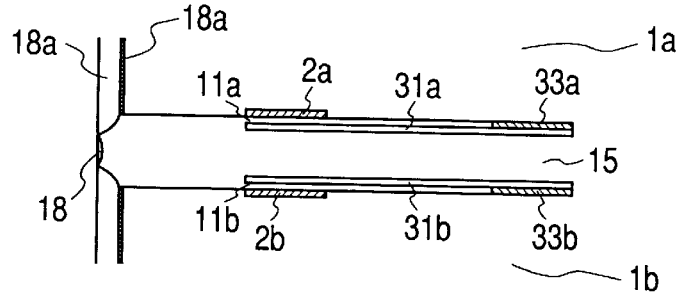
FIGS. 6A, 6B, 6C, 6D, 6E, and 6F are cross-sectional views which schematically illustrate the liquid discharge head in accordance with a first embodiment of the present invention.

In the state shown in FIG. 6A, when the heat generating devices 2*a* and 2*b* are heated, air bubbles 40*a* and 40*b* are created in the air bubble generating areas 11*a* and 11*b*, respectively. By means of the pressure exerted by the created air bubbles, the movable members 31*a* and 31*b* are displaced, respectively, in the directions opposite to the heat generating devices 2*a* and 2*b*. In other words, the movable members 31*a* and 31*b* are displaced in the directions to enable them to come closer to each other, and then, to be in contact with each other (see FIG. 6B). At this juncture, on the portion which is sandwiched between the movable members 31*a* and 31*b*, the stagnated portion Y takes place in the ink flow.

Figure 6B:
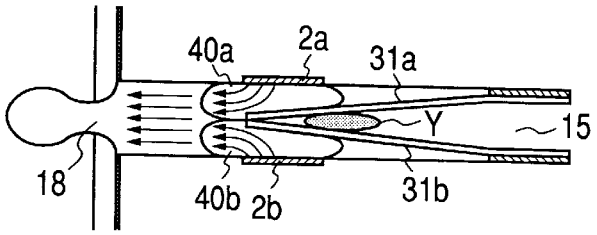
Figure 6C:
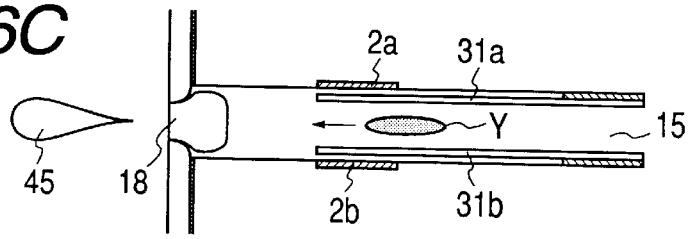
Figure 6D:
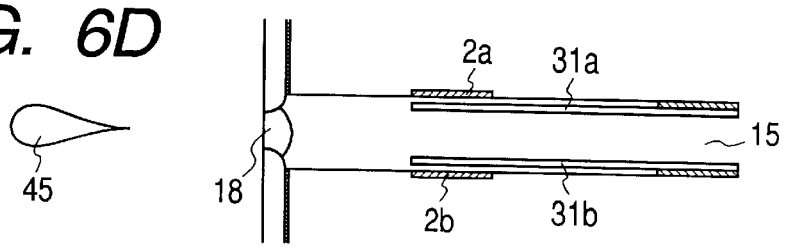
Figure 6E:
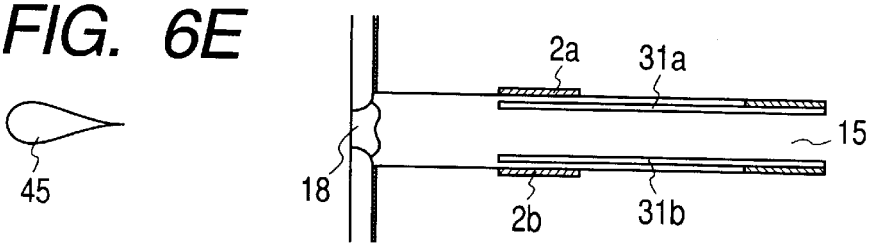

Here, when the movable members 31*a* and 31*b* are displaced in the direction to allow them to come closer to each other, the pressure waves generated by the creation of air bubbles are activated on the discharge opening 18 side symmetrically at the upper and lower parts in FIG. 6B along the discharge liquid flow path 15.

Also, the movable members 31*a* and 31*b* are in contact with each other when the air bubbles 40*a* and 40*b* are created. Therefore, it is possible to stabilize the volume of liquid that should be discharged from the discharge opening 18.

After that, when the air bubbles 40*a* and 40*b* become extinct, respectively, the movable members 31*a* and 31*b* are restored to the original positions before displacement. In this way, a droplet 45 is discharged from the discharge opening 18 (see FIG. 6C). Here, since the flows of liquid in the discharge liquid flow path 15 are symmetrical at the upper and lower parts in FIG. 6C, the satellite discharge is reduced when the droplet 45 is discharged from the discharge opening 18. Also, on the stagnated portion Y, there occurs the floating force containing the component perpendicular to the liquid flow. As a result, the attenuation vibration of the movable members 31*a* and 31*b* are promoted, thus making it possible to enhance the refilling speed. In this respect, the enhancement of the refilling speed is also obtainable by the suppression of the back waves formed by the movable members 31*a* and 31*b*.

Figure 6F:
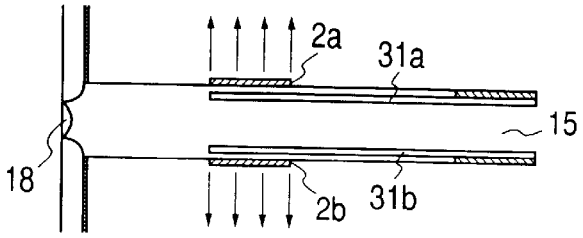

Here, the heat generating devices are arranged on both sides, upper and lower, of the discharge liquid flow path 15 as shown in FIGS. 6A to 6F, thus making it possible to disperse the rectifying flux to the elemental substrates 1*a* and 1*b* from the quantity of heat generated on each of the heat generating devices (see FIG. 6F).

(Second Embodiment)

Figure 7:
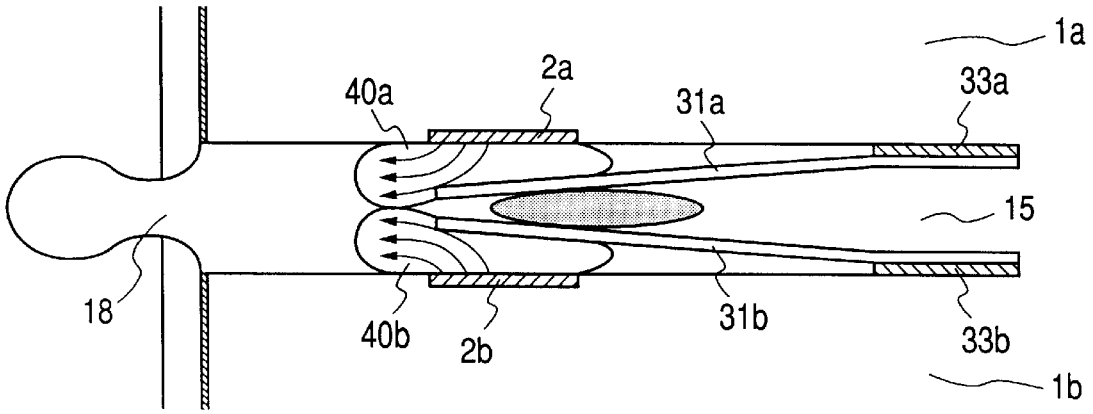
FIG. 7 is a cross-sectional view which shows schematically the liquid discharge head in accordance with a second embodiment of the present invention.

FIG. 7 is a view which shows the liquid discharge head in accordance with a second embodiment of the present invention and illustrates it in a state at the time of air bubble creation.

As shown in FIG. 7, the present embodiment is different from the one illustrated in FIGS. 6A to 6F only in that although the movable members 31*a* and 31*b* are displaced in the direction to allow them to come closer to each other, the members are not in contact with each other when the air bubbles 40*a* and 40*b* are created.

With the liquid discharge head thus structured, the contact between the air bubbles 40*a* and 40*b* is promoted, and at the same time, it becomes easier for them to be developed toward the discharge opening 18 side.

(Third Embodiment)

Figure 8:
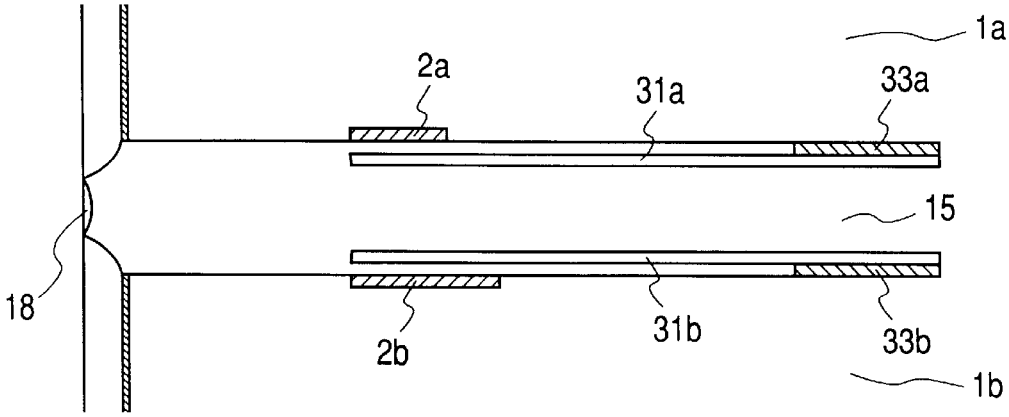
FIG. 8 is a cross-sectional view which shows schematically the liquid discharge head in accordance with a third embodiment of the present invention.

FIG. 8 is a view which shows the liquid discharge head in accordance with a third embodiment of the present invention.

As shown in FIG. 8, the present embodiment is different from the one illustrated in FIGS. 6A to 6F only in that the sizes of the heat generating devices 2*a* and 2*b* differ from each other.

Hereunder, the operation of the present embodiment will be described.

Figure 9A:
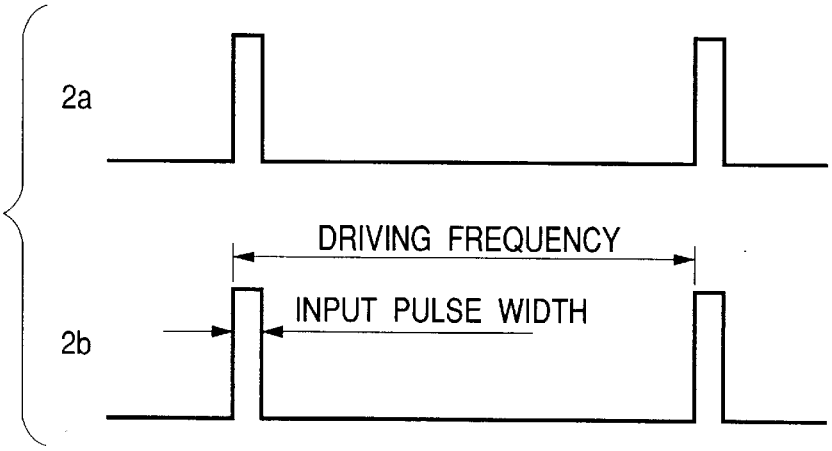
FIGS. 9A and 9B are views which illustrate the operation of the liquid discharge head represented in FIG. 8.
Figure 9B:
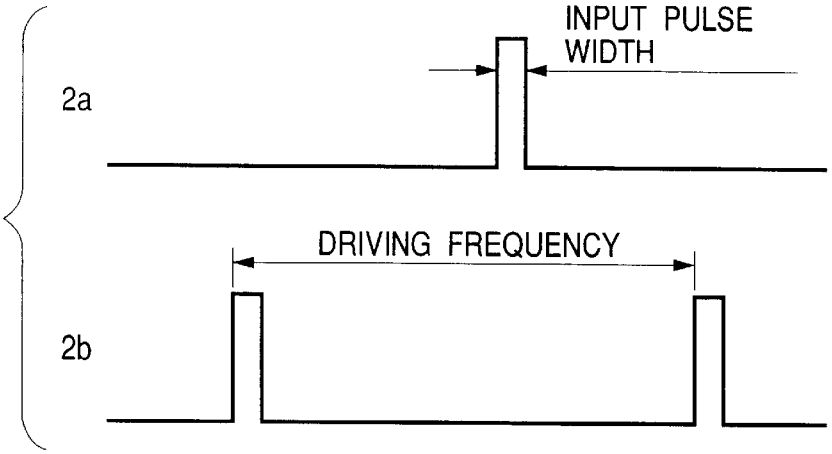

FIGS. 9A and 9B are views which illustrate the operation of the liquid discharge head represented in FIG. 8. FIG. 9A shows the heat signals applicable to the heat generating devices 2*a* and 2*b* of the liquid discharge head represented in FIGS. 6A to 6F. FIG. 9B shows the heat signals applicable to the heat generating devices 2*a* and 2*b* of the liquid discharge head represented in FIG. 8.

For the liquid discharge head shown in FIGS. 6A to 6F, the signals having the synchronized timing are applied to the heat generating devices 2*a* and 2*b*, respectively, as shown in FIG. 9A. However, for the liquid discharge head shown in FIGS. 9A to 9B, the signals having the timing which differs from each other are applied to the heat generating devices 2*a* and 2*b*, respectively, as shown in FIG. 9B.

Hereunder, the description will be made of the operation when the heat signals shown in FIG. 9B are applied to the heat generating devices 2*a* and 2*b* of the liquid discharge head represented in FIG. 8.

FIGS. 10A to 10D are views which illustrate the operation when the heat signals shown in FIG. 9B are applied to the heat generating devices 2*a* and 2*b* of the liquid discharge head represented in FIG. 8.

At first, when the heat signal is applied to the heat generating device 2*b*, an air bubble 40*b* is created only on the heat generating device 2*b*. Then, the movable member 31*b* is displaced in the direction opposite to the heat generating device 2*b*. Thus, liquid in the discharge liquid flow path 15 is pushed out from the discharge opening 18 (see FIG. 10A).

After that, when the heat signal is no longer applied to the heat generating device 2*b*, the air bubble 40*b* created on the heat generating device 2*b* becomes defoamed. The movable member 31*b* is restored to the original position before displacement. Thus, a droplet 45 is discharged from the discharge opening 18.

Figure 10A:
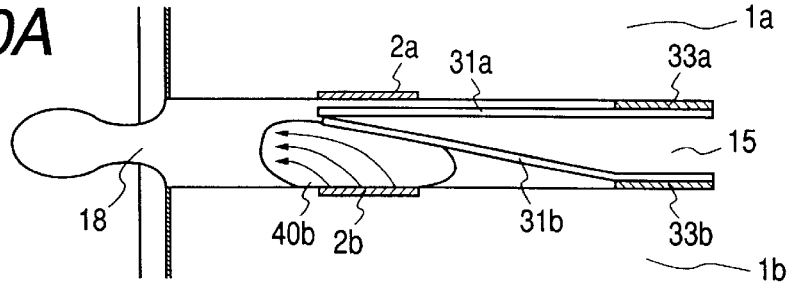
FIGS. 10A, 10B, 10C, and 10D are cross-sectional views which schematically illustrate the operation when the heat signal shown in FIG. 9B is applied to the liquid discharge head represented in FIG. 8.
Figure 10B:
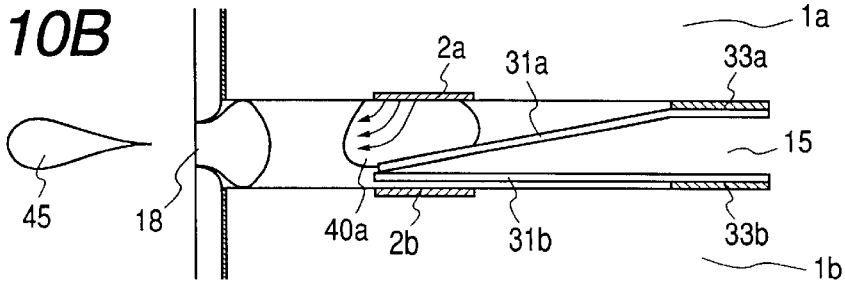

Then, when the heat signal is applied to the heat generating device 2*a*, an air bubble 40*a* is created only on the heat generating device 2*a*. Then, the movable member 31*a* is displaced in the direction opposite to the heat generating device 2*a* (FIG. 10B). With the creation of the air bubble 40*a*, liquid in the discharge liquid flow path 15 is compulsorily refilled, thus implementing the refilling.

Figure 10C:
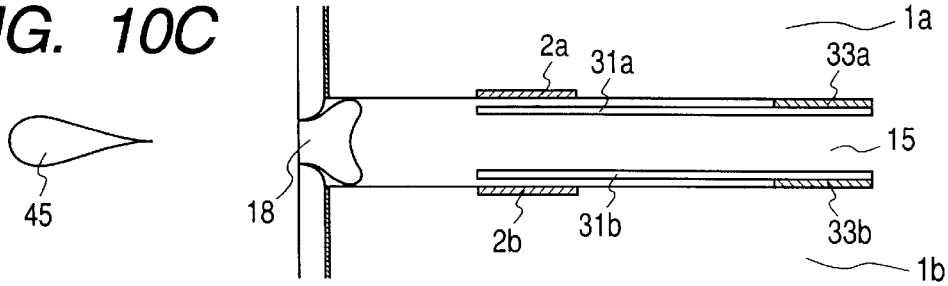
Figure 10D:
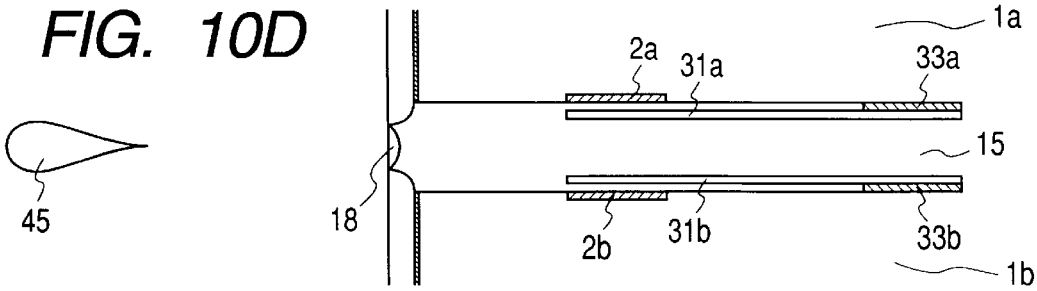

After that, when the heat signal is no longer applied to the heat generating device 2*a*, the air bubble 40*a* created on the heat generating device 2*a* becomes defoamed. The movable member 31*a* is restored to the original position before displacement (FIG. 10C, and FIG. 10D).

With the series of operation described above, it becomes possible to suppress the movement of meniscus, and promote the refilling as well.

Also, by the adjustment of the area ratio between the heat generating devices 2*a* and 2*b*, it becomes possible to control the discharge amount of liquid in the discharge liquid flow path 15.

(Fourth Embodiment)

Figure 11:
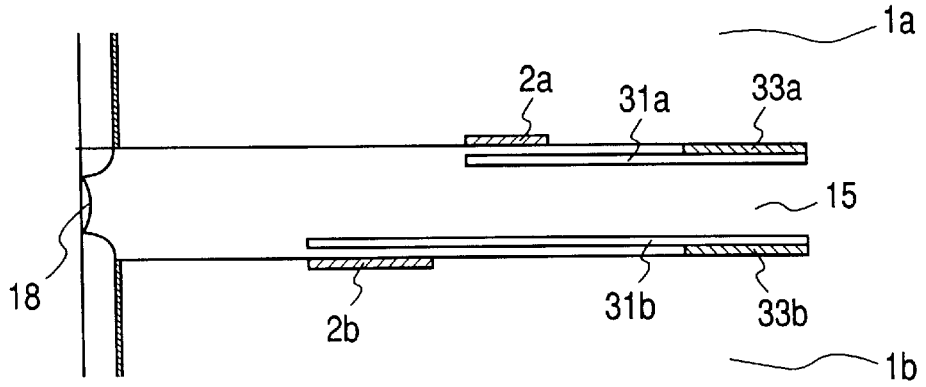
FIG. 11 is a cross-sectional view which shows schematically the liquid discharge head in accordance with a fourth embodiment of the present invention.

FIG. 11 is a view which shows the liquid discharge head in accordance with a fourth embodiment of the present invention.

As shown in FIG. 11, the present embodiment is different from those represented in FIG. 8 and FIGS. 10A to 10D only in that the heat generating device 2*a* is positioned more on the upstream side than the heat generating device 2*b*, and also, the free end of the movable member 31*a* is arranged more on the upstream side than that of the movable member 31*b*, respectively.

Now, hereunder, the operation of the present embodiment will be described.

Figure 13:
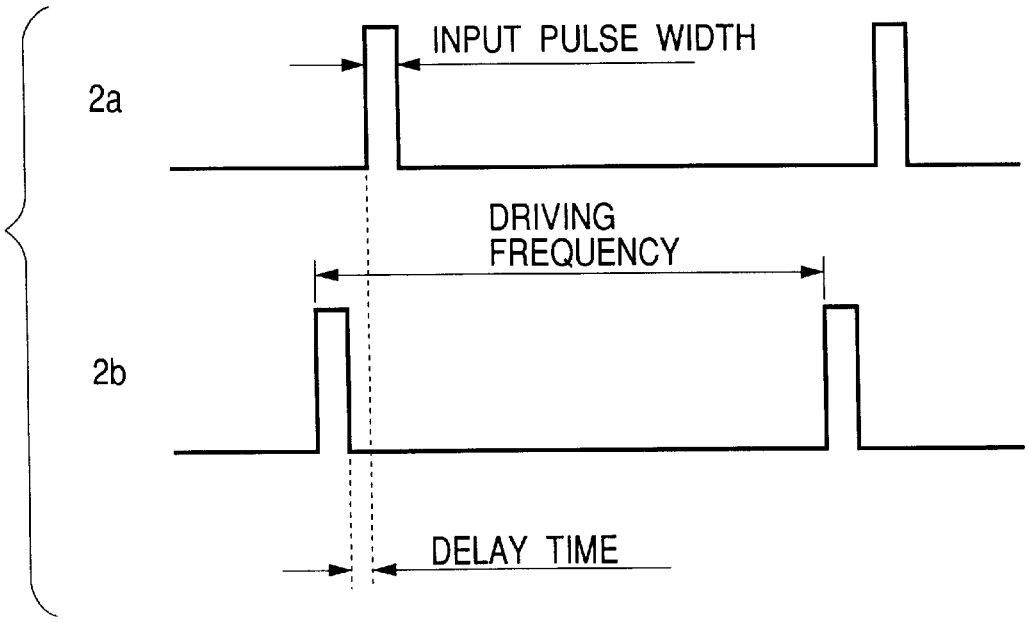
FIG. 13 is a view which schematically shows the heat signal applied to the liquid discharge head represented in FIGS. 12A, 12B, 12C, and 12D.

FIGS. 12A to 12D are views which illustrate the operation of the liquid discharge head represented in FIG. 11. Also, FIG. 13 is a view which shows the heat signals applied to the heat generating devices 2*a* and 2*b* of the liquid discharge head represented in FIGS. 12A to 12D.

Figure 12A:
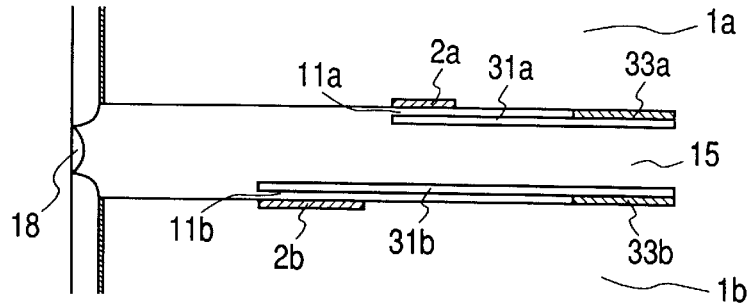
FIGS. 12A, 12B, 12C, and 12D are cross-sectional views which schematically illustrate the operation of the liquid discharge head represented in FIG. 11.
Figure 12B:
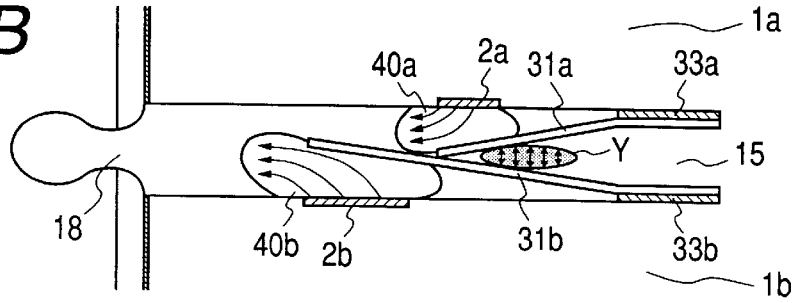

When the heat generating devices 2*a* and 2*b* are heated in a state shown in FIG. 12A, air bubbles 40*a* and 40*b* are created in the air bubble generating areas 11*a* and 11*b*, respectively. Then, by the pressure exerted by the creation of each air bubble, each of the movable member 31*a* and 31*b* is displaced in the direction opposite to each of the heat generating devices 2*a* and 2*b*. In other words, the movable members 31*a* and 31*b* are displaced in the directions to allow them to come closer to each other, and then, to be in contact with each other (FIG. 12B). At this juncture, the portion Y where ink flow is stagnated takes place in the portion sandwiched between the movable members 31*a* and 31*b*.

Here, when the movable member 31*a* and 31*b* are displaced in the direction to allow them to come closer to each other, the pressure waves generated by the creation of air bubbles are activated on the discharge opening 18 side symmetrically at upper and lower part in FIG. 12B. At this juncture, however, since the heat generating device 2*a* is positioned more on the upstream side than the heat generating device 2*b*, and also, the free end of the movable member 31*a* is arranged more on the upstream side than that of the movable member 31*b*, the displacement of the movable member 31*b* is regulated by the presence of the movable member 31*a*.

Figure 12C:
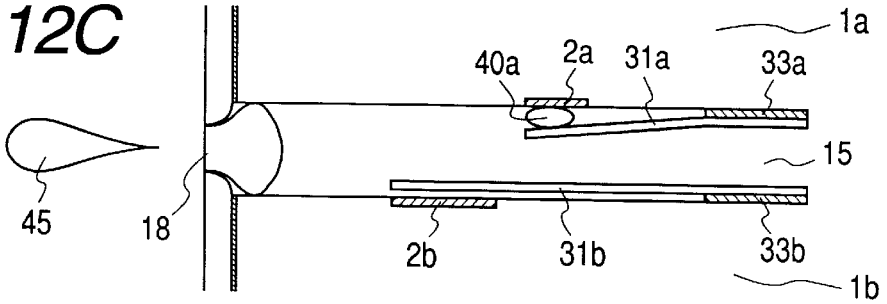
Figure 12D:
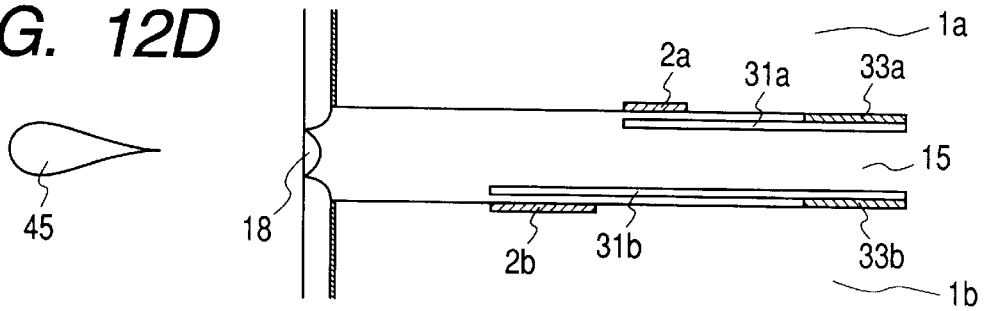

After that, when the air bubbles 40*a* and 40*b* become extinct, the movable members 31*a* and 31*b* are restored to the original positions before displacement, respectively. Then, liquid in the discharge liquid flow path 15 is discharged from the discharge opening 18. However, if a delay time is set as shown in FIG. 13 between the heat signals applicable to the heat generating devices 2*a* and 2*b*, it becomes possible to modulate the amount of liquid discharge (FIGS. 12C and 12D).

For the present embodiment, the description has been made of the structure where the movable member 31*a* and 31*b* are in contact with each other when the air bubbles are created, but it is still possible for the movable member 31*a* to regulate the displacement of the movable member 31*b* even if the movable members 31*a* and 31*b* are not allowed to be in contact with each other when the air bubbles are created.

Now, hereunder, the description will be made of a method for manufacturing the liquid discharge head described above.

Figure 14:
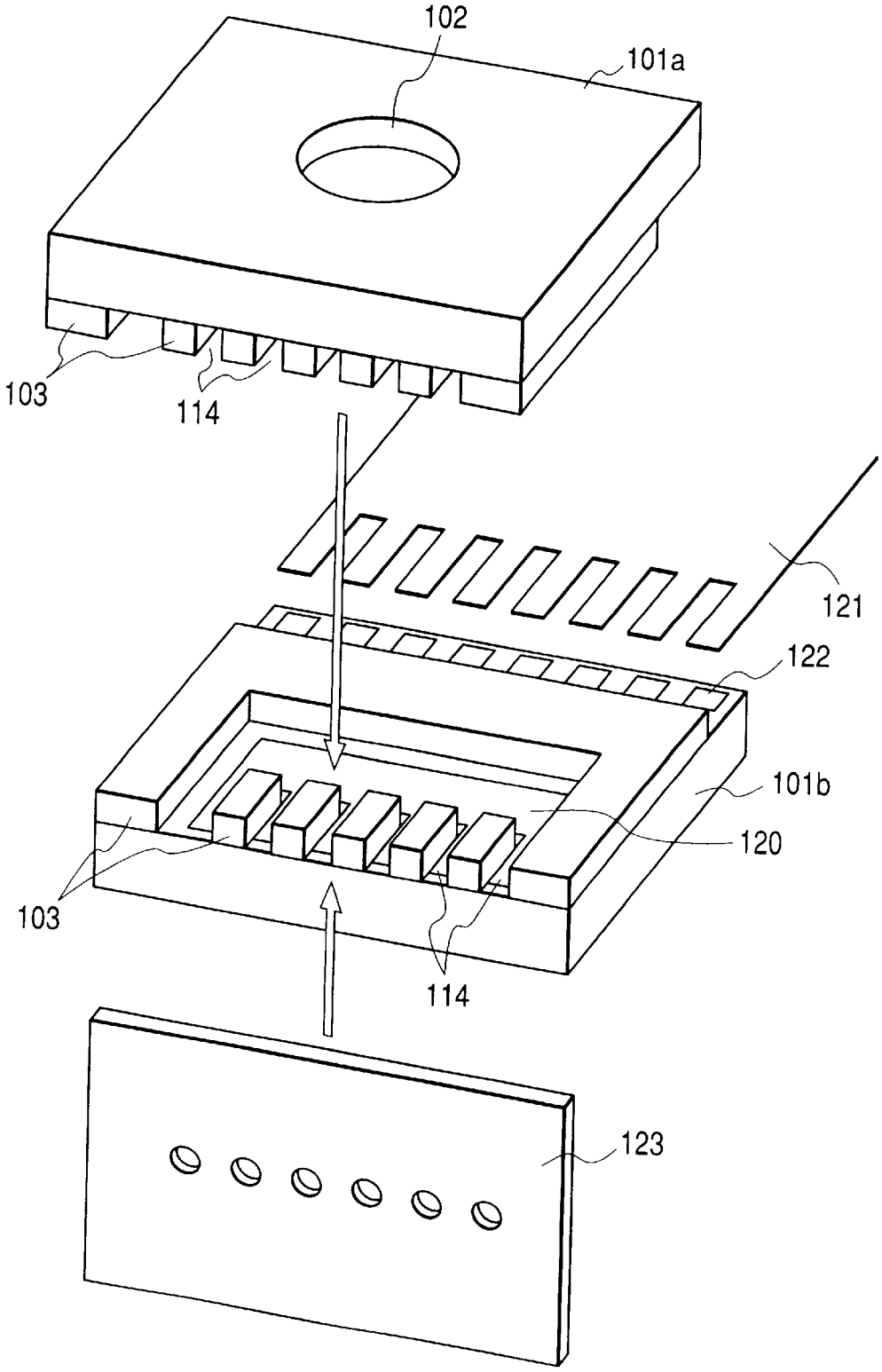
FIG. 14 is a view which shows one example of the method for manufacturing the liquid discharge head in accordance with the present invention.

FIG. 14 is a view which shows one example of the method for manufacturing the liquid discharge head of the present invention.

As shown in FIG. 14, this head is structured by the combination of a member which is provided with the discharge liquid supply opening 102, nozzle walls 103, and an elemental substrate 101*a*; a member provided with a common liquid chamber 102, an elemental substrate 101*b* having electric connection pads 122 on it, and nozzle walls 103; an electric connector 121 to be coupled with the electric connection pads 122; movable members 131; and an orifice plate 123. In this respect, the orifice plate 123 is adhesively bonded to the end face of the nozzle walls 103 in alignment therewith after bonding agent (not shown) is applied to it.

Figure 15A:
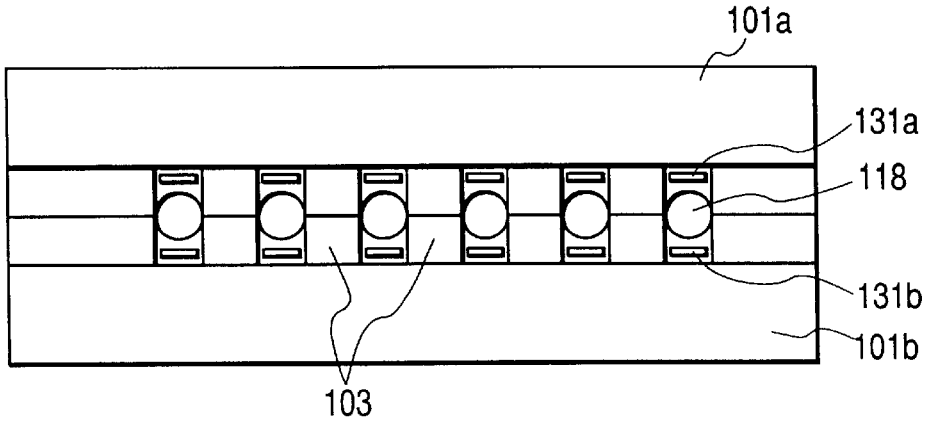
FIGS. 15A and 15B are views which illustrate one structural example of the liquid discharge head in accordance with the present invention.
Figure 15B:
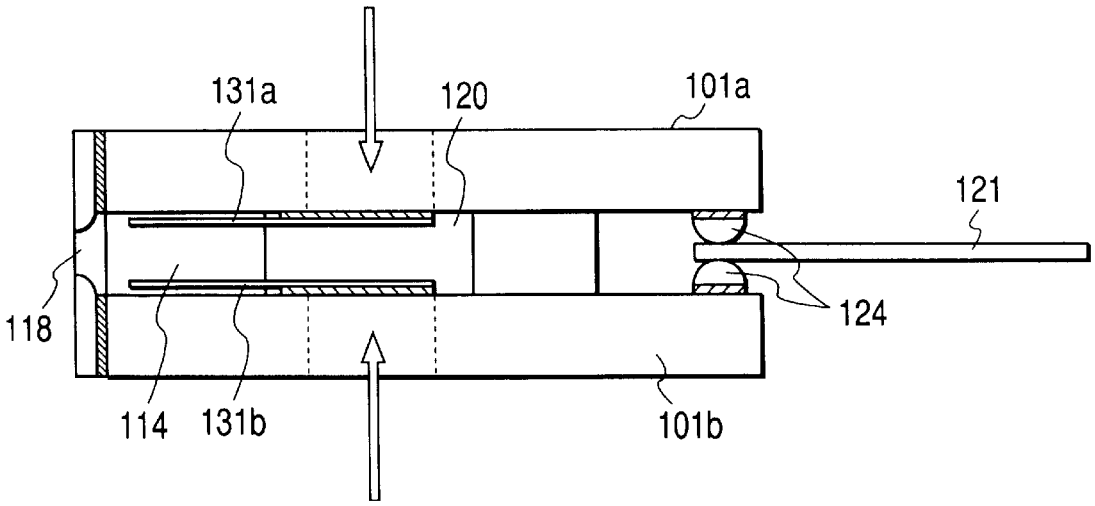

FIGS. 15A and 15B are views which illustrate one structural example of the liquid discharge head of the present invention. FIG. 15A is a view thereof, observed from the discharge opening side. FIG. 15B is a cross-sectional view thereof, observed in the direction of the liquid flow path.

As shown in FIGS. 15A and 15B, the discharge liquid flow path 114 and the common liquid chamber 120 are arranged to be sandwiched between two elemental substrates 101*a* and 101*b*. In the vicinity of the elemental substrates 101*a* and 101*b* arranged for the discharge liquid flow path 114, the movable members 131*a* and 131*b*, each having the free end on the discharge opening side, are provided along the elemental substrates 101*a* and 101*b*, respectively. Also, the elemental substrates 101*a* and 101*b* are connected with the electric connector 121 through the bumps 124. In this manner, electric signals are received from the outside.

The liquid discharging method and the liquid discharge apparatus that use "the movable members having free ends", which are described as the first to fourth embodiments hereof, are the preferable modes embodying the present invention on the assumption that at least a part of a movable member faces the other one of them, respectively. As the technical thought of the invention, however, the structures formed by the following combinations are also included in the modes embodying the present invention.

In accordance with the present invention, the structural examples, which are arranged to attain the enhancement of discharge speed and the uniformity of volume, including the anticipated discharge efficiency, can be developed further by means of the analysis of the technical thought under which the embodiments are made as described above. In other words, the above embodiments are important in that there exist the air bubbles which are regulated and developed in the discharging direction or to the discharge opening side by means of the movable members each having the free end, respectively. From the different point of view, the representative constituent may be defined as a plurality of such developed air bubbles, at least a part of them being arranged to face each other (more preferably, to face all of them symmetrically).

Therefore, as means for forming the air bubbles which are regulated and developed as described above, it may be possible to use separation films themselves (which may present the elastic deformation or configuration changes by means of the created air bubbles) or to use, in combination, the movable members, each having free end that may regulate the deformation of the separation films, which will be described later. These means demonstrate excellent performance in a better condition than the conventional ones, although the discharge performance slightly becomes inferior to the structural example using the plural movable members as described above.

(Fifth Embodiment)

FIGS. 16A to 16I are cross-sectional views which illustrate the liquid discharge head in accordance with a fifth embodiment of the present invention, taken in the direction of the flow path thereof.

As shown in FIGS. 16A to 16I, the liquid supplied from the common liquid chamber (not shown) for use of discharge is filled in the discharge liquid flow path 53 which is conductively connected with the discharge opening 51 directly. Also, the liquid for bubble generation use is filled in the first and second bubble generating liquid flow paths 54*a* and 54*b*, which are provided with the air bubble generating areas 57*a* and 57*b*, respectively. The bubble generating liquid is caused to generate a bubble(s) when thermal energy is given by means of the heat generating devices 52*a* and 52*b*, respectively. In this respect, the discharge liquid flow path 53 is sandwiched by the bubble generating liquid flow paths 54*a* and 54*b*, and between the discharge liquid flow path 53, and the bubble generating liquid flow paths 54*a* and 54*b*, the movable separation films 55*a* and 55*b* are arranged to face each other to separate the discharge liquid flow path 53, and the bubble generating liquid flow paths 54*a* and 54*b* from each other. Also, the heat generating device 52*a* and 52*b* are arranged to face each other. Here, the movable separation films 55*a* and 55*b*, and the orifice plate 59 are closely fixed each other. As a result, there is no possibility that the liquids in the respective liquid flow paths are mixed.

Figure 16A:
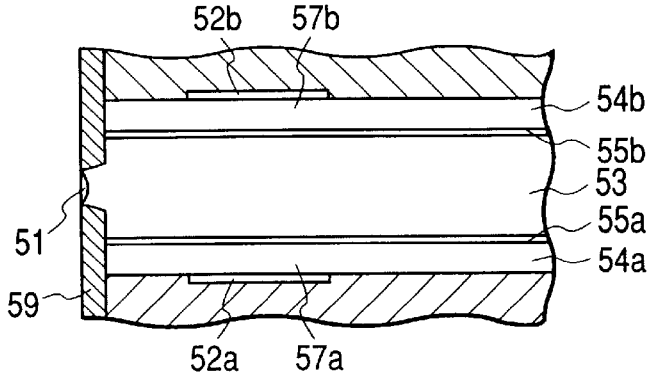
FIGS. 16A, 16B, 16C, 16D, 16E, 16F, 16G, 16H and 16I are cross-sectional views which illustrate the liquid discharging method in accordance with a fifth embodiment of the present invention, taken in the direction of liquid flow path.
Figure 16B:
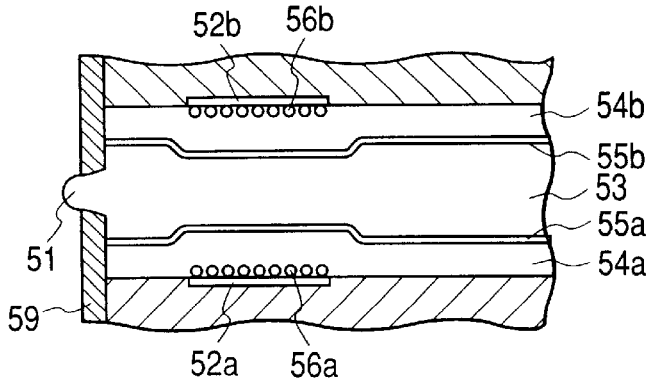

In the initial state shown in FIG. 16A, liquid in the discharge liquid flow path 53 is sucked nearer to the discharge opening 51 by means of the attraction of the capillary tube. Here, in accordance with the present embodiment, the discharge opening 51 is positioned on the downstream side in the direction of the liquid flow with respect to the projection areas of the heat generating devices 52*a* and 52*b* to the discharge liquid flow path 53.

In this state, when thermal energy is given to the heat generating devices 52*a* and 52*b*, the heat generating devices 52*a* and 52*b* are heated abruptly. The surfaces thereof, which are in contact with the bubble generating liquid in the air bubble generating areas 57*a* and 57*b*, give heat to the bubble generating liquid to generate the bubble(see FIG. 16B). The air bubbles 56*a* and 56*b* created by this heat bubble generation are those based on the film boiling phenomenon as disclosed in the specification of U.S. Pat. No. 4,723,129, which are created with extremely high pressure. The pressure thus generated becomes pressure waves to propagate bubble generating liquid in the bubble generating liquid flow paths 54*a* and 54*b*, thus acting upon the movable separation films 55*a* and 55*b*. In this manner, the portions of the movable separation films 55*a* and 55*b*, which face the air bubble generating areas 57*a* and 57*b*, respectively, are displaced in the directions to part from the heat generating devices 52*a* and 52*b*, that is, displaced in the direction to allow them to come closer to each other. Thus, the discharge of liquid in the discharge liquid flow path 53 is initiated.

Figure 16C:
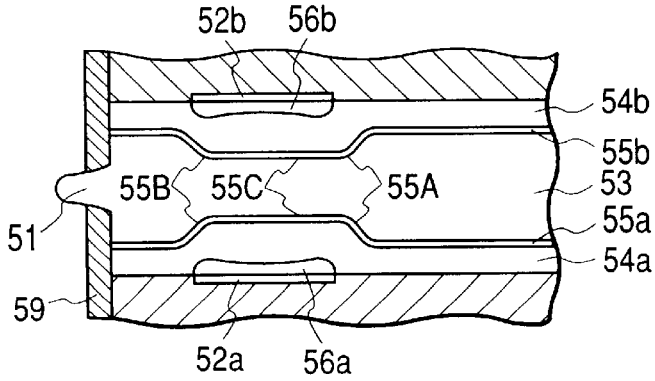

The air bubbles 56*a* and 56*b* created on the entire surfaces of the heat generating devices 52*a* and 52*b* are developed abruptly, and expanded after having presented the film status, respectively (see FIG. 16C). The expansion of the air bubbles 56*a* and 56*b*, which is brought about by the extremely high pressure exerted in the initial state of its creation, enables each of the movable separation films 55*a* and 55*b* to be displaced further. Hence, the discharge of liquid in the liquid discharge flow path 53 from the discharge opening 51 is in progress.

Figure 16D:
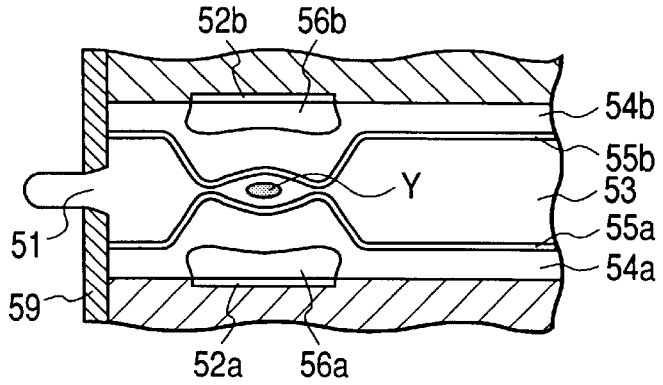

After that, when the air bubbles 56*a* and 56*b* are further developed, the displacements of the movable separation films 55*a* and 55*b* become greater (FIG. 16D). Here, in the state shown in FIG. 16D, the movable separation films 55*a* and 55*b* are continuously stretched in such a manner that the displacement on the upstream side at 55A and the displacement on the downstream side at 55B are almost equal with respect to the central portion 55C of the area where the movable separation films 55*a* and 55*b* face the heat generating devices 52*a* and 52*b*.

Figure 16E:
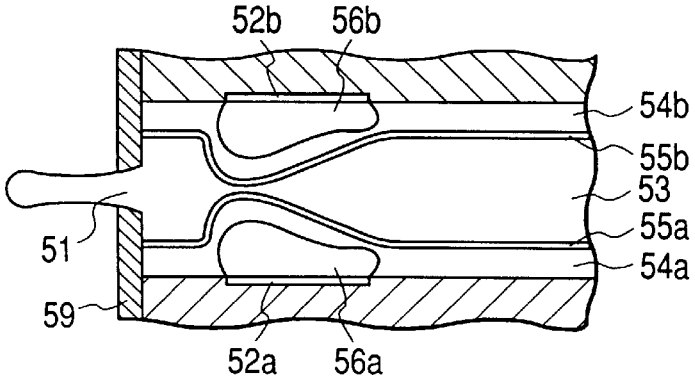
Figure 16F:
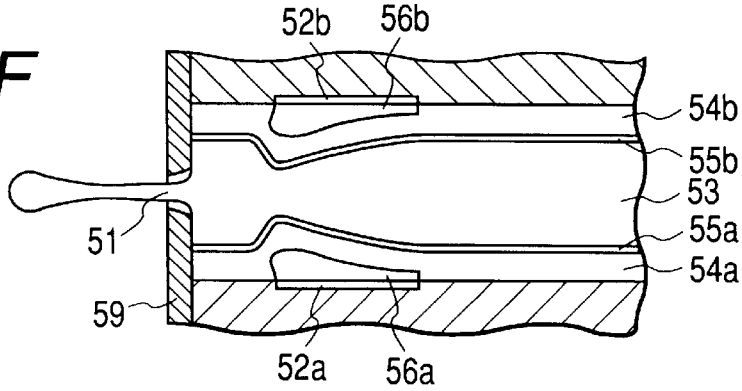

Then, when the air bubbles 56*a* and 56*b* are further developed, the portion 5B of the air bubbles 56*a* and 56*b* and the movable separation films 55*a* and 55*b*, which are continuously displaced on the downstream side is displaced relatively larger to the discharge opening 51 side than the portion 55A thereof on the upstream side. Here, the portions that have been displaced most themselves come closer to and face each other. In this manner, the liquid in the discharge liquid flow path 53 is caused to shift to the discharge opening side directly (FIG. 16E).

As described above, there is a process in which the movable separation films 55*a* and 55*b* are displaced in the discharge direction on the downstream side so that the liquid is caused to shift to the discharge opening side directly. Therefore, the discharge efficiency is further enhanced. In this respect, with the provision of two movable separation film which face each other, the action of each of the movable separation films 55*a* and 55*b* can cooperate with each other to enhance the discharge efficiency still more. Also, with the stretching of the movable separation films 55*a* and 55*b* arranged to face each other, the width of the flow path of the discharge liquid flow path 53 becomes narrower. In such state, the liquid in the discharge liquid flow path 53 moves to the discharge opening 51 side. As a result, the energy loss on the upstream side is further reduced, hence increasing the amount of liquid discharge accordingly. Also, the stretching of the movable separation films 55*a* and 55*b* is smaller on the upstream side. Therefore, the movement of liquid to the upstream side becomes relatively smaller to make it possible to effectively actuate the refilling of liquid (from the upstream side) to the displacement area of the movable separation films 55*a* and 55*b*, particularly in nozzles.

Figure 16G:
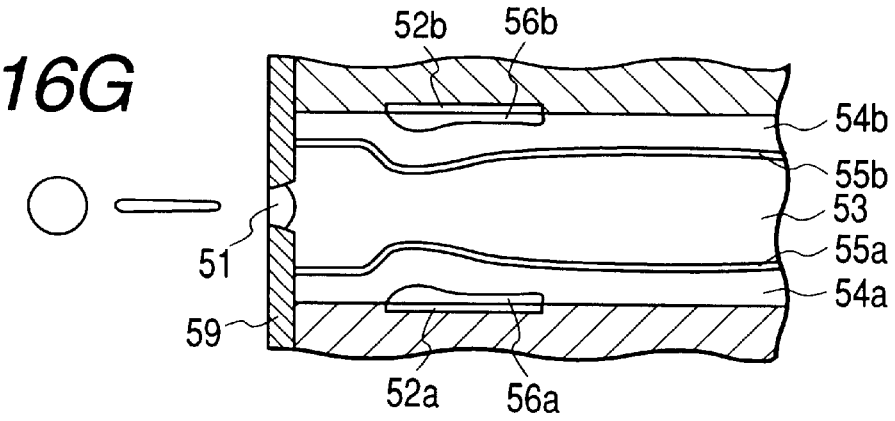
Figure 16H:
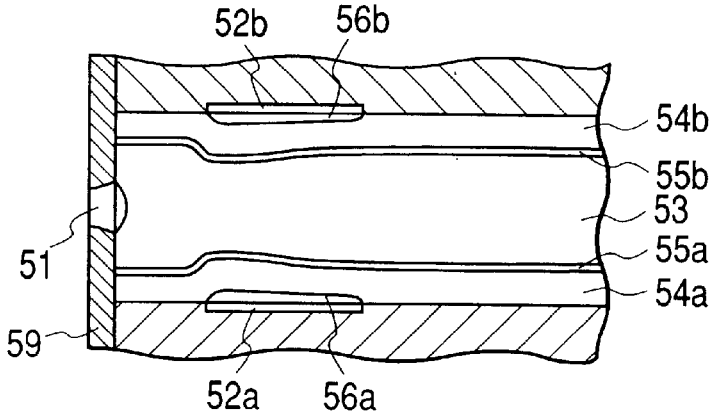

After that, when the air bubbles 56*a* and 56*b* begin to be disappeared (FIG. 16F), the displacement amounts of the movable separation films 55*a* and 55*b* become smaller accordingly. In this manner, the liquid is discharged from the discharge opening 51 (FIG. 16G).

Figure 16I:
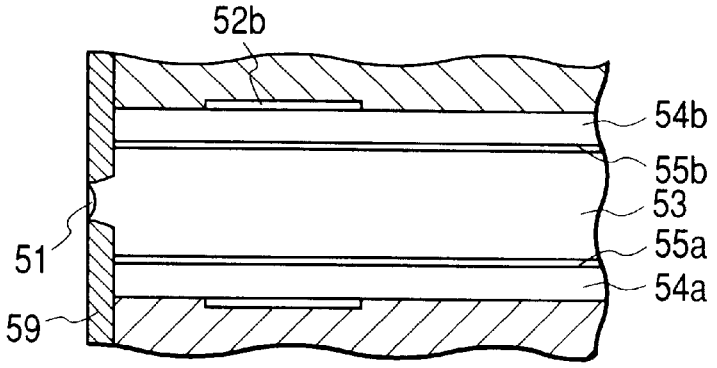

Further, as the air bubbles 56*a* and 56*b* are being disappeared, the displacement amount of the movable separation films 55*a* and 55*b* become smaller still (FIG. 16H), and the movable separation films 55*a* and 55*b* are restored to the original positions before displacement when the air bubbles 56*a* and 56*b* have been disappeared completely (FIG. 16I).

Here, in FIG. 16D, there occurs the stagnated portion Y in the portion sandwiched between the movable separation films 55*a* and 55*b* where the flow of liquid becomes slower in the discharge liquid flow path 53. Therefore, even if any vibrating component is contained in each of the movable separation films 55*a* and 55*b*, its attenuation is promoted, hence enhancing the stabilization of discharges.

(Sixth Embodiment)

FIGS. 17A to 17I are cross-sectional views which illustrate the liquid discharge head in accordance with a sixth embodiment of the present invention, taken in the direction of the flow path thereof.

As shown in FIGS. 17A to 17I, the liquid supplied from the common liquid chamber (not shown) for use of discharge is filled in the discharge liquid flow path 513 which is conductively connected with the discharge opening 511 directly. Also, the liquid for bubble generation use is filled in the first and second bubble generating liquid flow paths 514*a* and 514*b*, which are provided with the air bubble generating areas 517*a* and 517*b*, respectively. The bubble generating liquid is caused to generate the bubble when thermal energy is given by means of the heat generating devices 512*a* and 512*b*, respectively. In this respect, the discharge liquid flow path 513 is sandwiched by the bubble generating liquid flow paths 514*a* and 514*b*, and between the discharge liquid flow path 513, and the bubble generating liquid flow paths 514*a* and 514*b*, the movable separation films 515*a* and 515*b* are arranged to face each other to separate the discharge liquid flow path 513, and the bubble generating liquid flow paths 514*a* and 514*b* from each other. Also, the heat generating device 512*a* and 512*b* are arranged to face each other. Here, the movable separation films 515*a* and 515*b*, and the orifice plate 519 are closely fixed each other. As a result, there is no possibility that the liquids in the respective liquid flow paths are mixed.

Figure 17A:
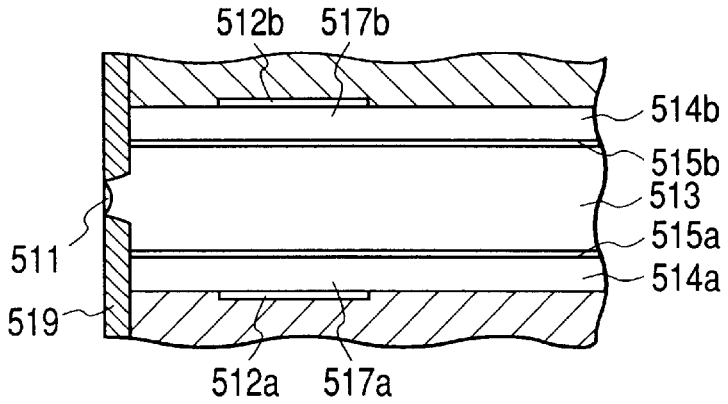
FIGS. 17A, 17B, 17C, 17D, 17E, 17F, 17G, 17H and 17I are cross-sectional views which illustrate the liquid discharging method in accordance with a sixth embodiment of the present invention, taken in the direction of liquid flow path.
Figure 17B:
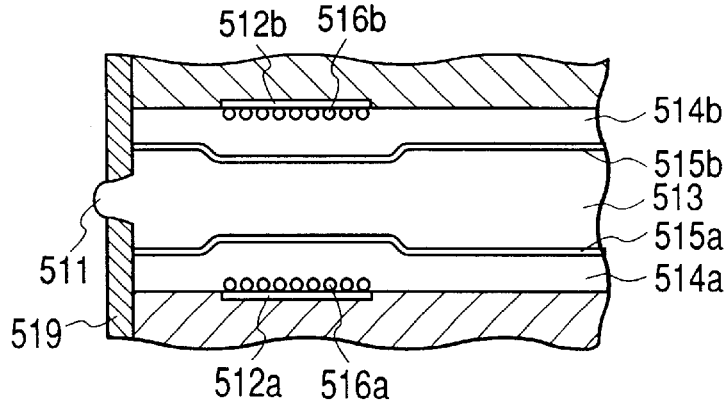

In the initial state shown in FIG. 17A, liquid in the discharge liquid flow path 513 is sucked nearer to the discharge opening 511 by means of the attraction of the capillary tube. Here, in accordance with the present embodiment, the discharge opening 511 is positioned on the downstream side in the direction of the liquid flow with respect to the projection areas of the heat generating devices 512*a* and 512*b* to the discharge liquid flow path 513.

In this state, when thermal energy is given to the heat generating devices 512*a* and 512*b*, the heat generating devices 512*a* and 512*b* are heated abruptly. The surfaces thereof, which are in contact with the bubble generating liquid in the air bubble generating areas 517*a* and 517*b*, give heat to the bubble generating liquid to generate the bubble (see FIG. 17B). At this juncture, the pressure thus exerted by bubble generation becomes pressure waves to propagate bubble generating liquid in the bubble generating liquid flow paths 514*a* and 514*b*, thus acting upon the movable separation films 515*a* and 515*b*. In this manner, the portions of the movable separation films 515*a* and 515*b*, which face the air bubble generating areas 517*a* and 517*b*, respectively, are displaced in the directions to part from the heat generating devices 512*a* and 512*b*, that is, displaced in the direction to allow them to come closer to each other. Thus, the discharge of liquid in the discharge liquid flow path 513 is initiated.

Figure 17C:
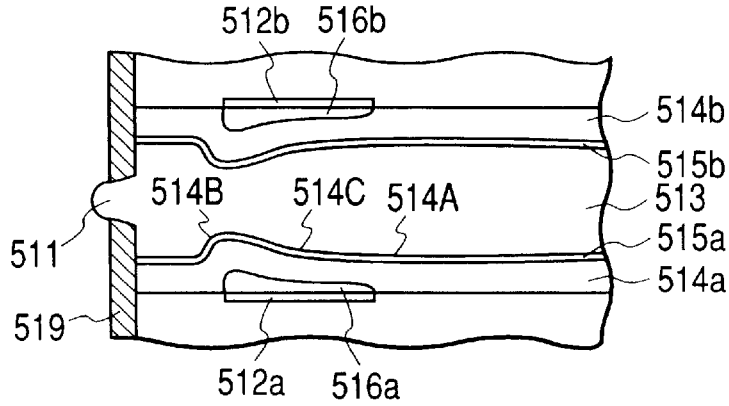

The air bubbles 516*a* and 516*b* created on the entire surfaces of the heat generating devices 512*a* and 512*b* are developed abruptly, and present themselves in the form of film, respectively (see FIG. 17C). The expansion of the air bubbles 516*a* and 516*b*, which is brought about by the extremely high pressure exerted in the initial state of its creation, enables each of the movable separation films 515*a* and 515*b* to be displaced further. Hence, the discharge of liquid in the liquid discharge flow path 513 from the discharge opening 511 is in progress. At this juncture, as shown in FIG. 17C, the portion of the movable separation films 515*a* and 515*b* on the downstream side at 515B is displaced from the initial stage relatively larger in the movable area than that on the upstream side at 515A. In this way, the liquid in the discharge liquid flow path 513 can move efficiently to the discharge opening 511 from the initial stage.

Figure 17D:
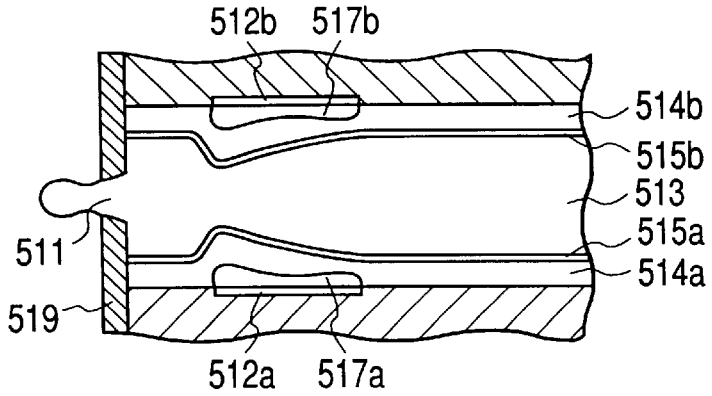

After that, when the air bubbles 516*a* and 516*b* are further developed, the developments of the air bubbles 516*a* and 516*b* are promoted from the state shown in FIG. 17C. Along the promoted developments of the air bubbles 516*a* and 516*b*, the displacements of the movable separation films 515*a* and 515*b* become greater (FIG. 17D). Here, particularly, the portion of the movable area on the downstream side at 515B is displaced larger still to the discharge opening side than the portion on the upstream side at 515A and the central portion at 515C. As a result, the direct movement of the liquid in the discharge liquid flow path 513 to the discharge opening 511 side is accelerated. At the same time, since the displacement in the portion on the upstream side at 515A is smaller in the entire process of this operation, the liquid movement to the upstream side becomes smaller. In this manner, it becomes possible to enhance the discharge efficiency, and the discharge speed in particular. At the same time, it becomes possible to effectively activate the refilling of the liquid in the nozzles, particularly into the displacement area of the movable separation films 515*a* and 515*b*.

Figure 17E:
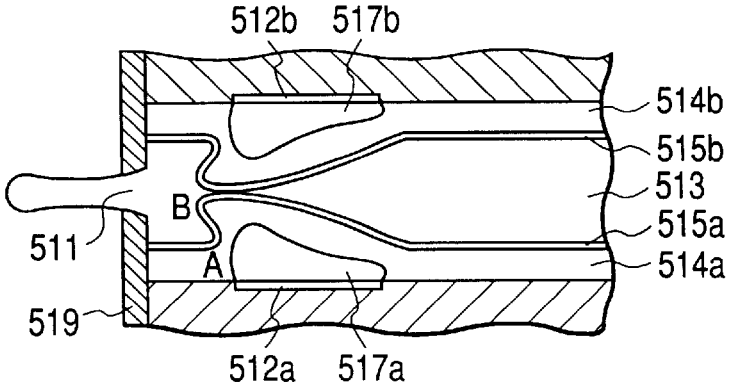
Figure 17F:
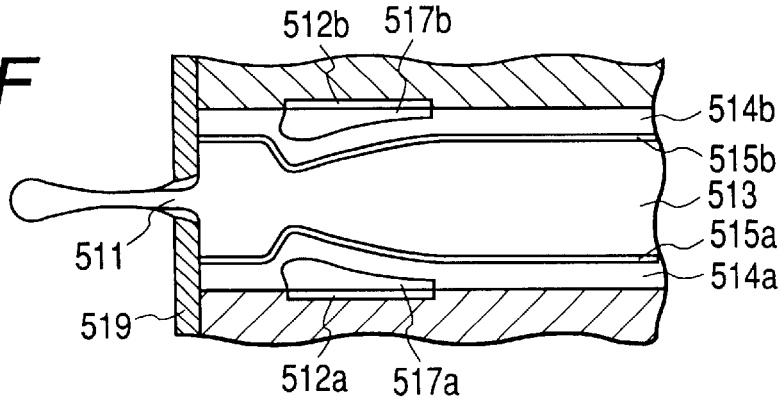

Then, when the air bubbles 516*a* and 516*b* are further developed, the portion of the air bubbles 516*a* and 516*b* on the downstream side at 515B and the central portion at 515C are further displaced and stretched to the discharge opening 511 side, hence implementing the effects described above, that is, enhancing the discharge efficiency and discharge speed (FIG. 17E). Particularly, with the configuration of the movable separation films 515*a* and 515*b* in this case, not only those represented by the sectional shape, but also, the displacement and stretching thereof become greater in the width direction of the liquid flow path. As a result, the acting region becomes larger for the intended movement of the liquid in the discharge liquid flow path 513 to the discharge opening 511 side, and the discharge effect is enhanced synergically. Here, since the displacement configuration of the movable separation films 515*a* and 515*b* resembles that of the human nose, this configuration is called "nose type" in particular. In this respect, it is to be understood that this nose type also includes the "S-letter type" where, as shown in FIG. 17E, the point B present on the upstream side in the initial state is positioned on the downstream side than the point A present on the downstream side in the initial state, and the configuration in which the A and B points are equally positioned as well. Also, in accordance with the present embodiment, the movable separation films 515*a* and 515*b* are stretched until these films are in contact with each other. In this manner, it becomes easier to obtain the effect as described above.

Figure 17G:
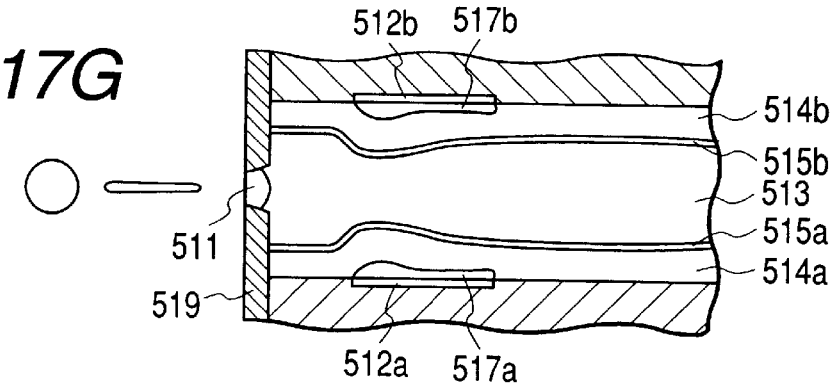
Figure 17H:
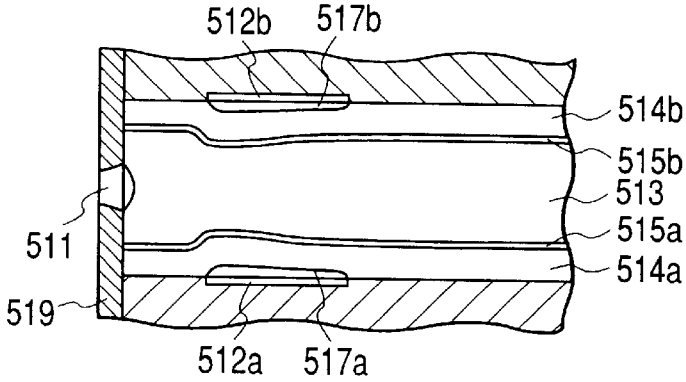

Now, after that, when the air bubbles 516*a* and 516*b* begin to be disappeared (FIG. 17F), the displacement amounts of the movable separation films 515*a* and 515*b* become smaller accordingly. In this manner, the liquid is discharged from the discharge opening 511 (FIG. 17G).

Figure 17I:
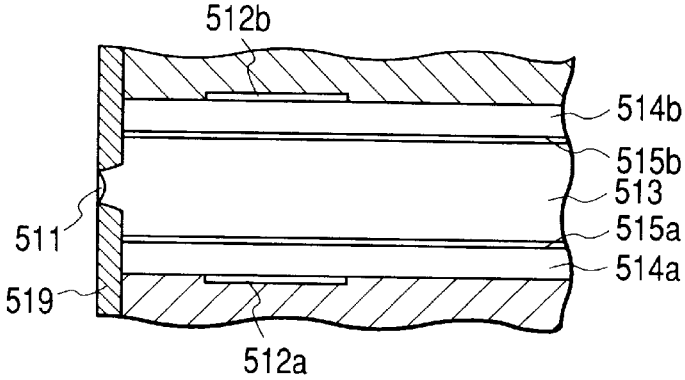

Further, as the air bubbles 516*a* and 516*b* are being disappeared, the displacement amount of the movable separation films 515*a* and 515*b* become smaller still (FIG. 17H), and the movable separation films 515*a* and 515*b* are restored to the original positions before displacement when the air bubbles 516*a* and 516*b* have been disappeared completely (FIG. 17I).

(Seventh Embodiment)

FIGS. 18A to 18E are cross-sectional views which illustrate the liquid discharge head in accordance with a seventh embodiment of the present invention, taken in the direction of the flow path thereof.

As shown in FIGS. 18A to 18E, the liquid supplied from the common liquid chamber (not shown) for use of discharge is filled in the discharge liquid flow path 523 which is conductively connected with the discharge opening 521 directly. Also, the liquid for bubble generation use is filled in the first and second bubble generating liquid flow paths 524*a* and 524*b*, which are provided with the air bubble generating areas 527*a* and 527*b*, respectively. The bubble generating liquid is caused to generate the bubble when thermal energy is given by means of the heat generating devices 522*a* and 522*b*, respectively. In this respect, the discharge liquid flow path 523 is sandwiched by the bubble generating liquid flow paths 524*a* and 524*b*, and between the discharge liquid flow path 523, and the bubble generating liquid flow paths 524*a* and 524*b*, the movable separation films 525*a* and 525*b* are arranged to face each other to separate the discharge liquid flow path 523, and the bubble generating liquid flow paths 524*a* and 524*b* from each other. Also, the heat generating device 522*a* and 522*b* are arranged to face each other. Also, the movable separation films 525*a* and 525*b* are provided with the sagged portions 525*c* and 525*d* which are sagged largely on the downstream side where these portions face the heat generating devices 522*a* and 522*b*, respectively. The movable separation films 525*a* and 525*b* and the orifice plate 529 are closely fixed each other.

Figure 18A:
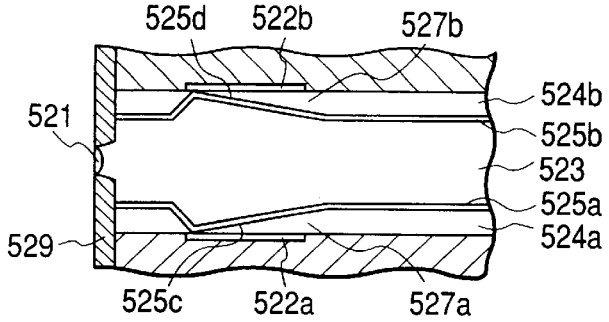
FIGS. 18A, 18B, 18C, 18D, and 18E are cross-sectional views which illustrate the liquid discharging method in accordance with a seventh embodiment of the present invention, taken in the direction of liquid flow path.

In the initial state shown in FIG. 18A, liquid in the discharge liquid flow path 523 is sucked nearer to the discharge opening 521 by means of the attraction of the capillary tube. Here, in accordance with the present embodiment, the discharge opening 521 is positioned on the downstream side in the direction of the liquid flow with respect to the projection areas of the heat generating devices 522*a* and 522*b* to the discharge liquid flow path 523. Also, the sagged portions 525*c* and 525*d* are sagged to extrude to the bubble generating liquid flow paths 524*a* and 524*b* sides, respectively.

In this state, when thermal energy is given to the heat generating devices 522*a* and 522*b*, the heat generating devices 522*a* and 522*b* are heated abruptly. The surfaces thereof, which are in contact with the bubble generating liquid in the air bubble generating areas 527*a* and 527*b*, give heat to the bubble generating liquid to generate bubble. At this juncture, the pressure thus exerted by bubble generation becomes pressure waves to propagate bubble generating liquid in the bubble generating liquid flow paths 524*a* and 524*b*, thus acting upon the movable separation films 525*a* and 525*b*. In this manner, the sagged portions 525*c* and 525*d* of the movable separation films 525*a* and 525*b* are displaced in the directions to part from the heat generating devices 522*a* and 522*b*, that is, displaced in the direction to allow them to come closer to each other, and caused to extrude to the discharge liquid flow path 523 side, respectively. Thus, the discharge of liquid in the discharge liquid flow path 523 is initiated (see FIG. 18B).

Figure 18B:
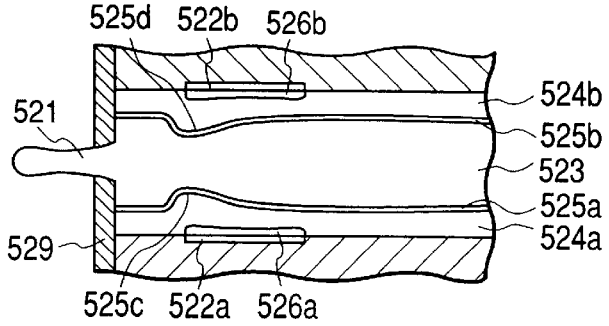
Figure 18C:
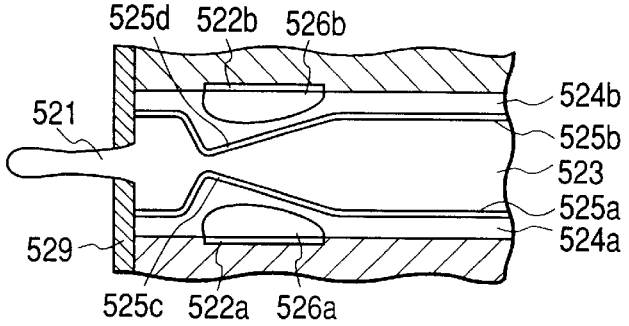

Then, when the air bubbles 526*a* and 526*b* are further developed, the developments of the air bubbles 526*a* and 526*b* are promoted from the state shown in FIG. 18B. Along with this promotion, the displacements of the sagged portions 525*c* and 525*d* of the movable separation films 525*a* and 525*b* become greater (FIG. 18C). Here, since the two movable separation films 525*a* and 525*b* are arranged to face each other, the propagating direction of the pressure exerted by the creation of air bubbles 526*a* and 526*b* is in the stabilized state on the discharge opening 521 side.

Figure 18D:
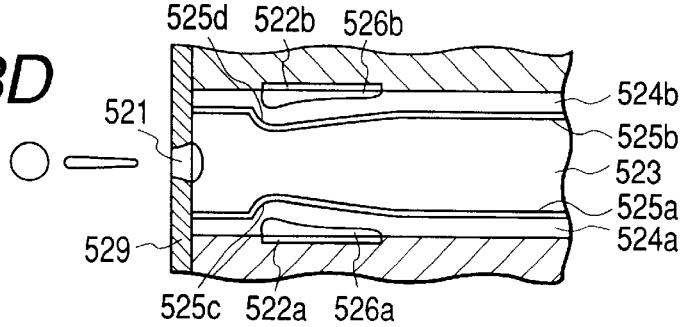

After that, when the air bubbles 526*a* and 526*b* begin to be disappeared (FIG. 18C), the displacement amounts of sagged portions 525*c* and 525*d* of the movable separation films 525*a* and 525*b* become smaller accordingly. In this manner, the liquid is discharged from the discharge opening 521 (FIG. 18D).

Figure 18E:
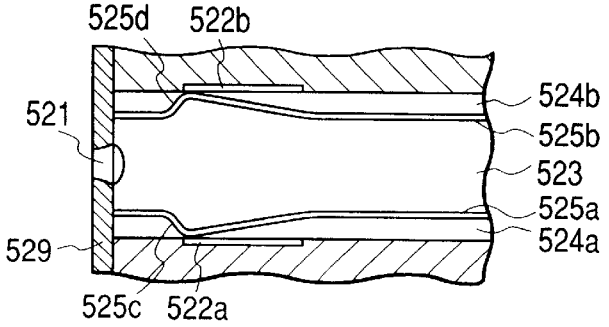

Further, the air bubbles 526*a* and 526*b* are being disappeared, and when the air bubbles 526*a* and 526*b* have been disappeared completely, the movable separation films 525*a* and 525*b* are restored to the original position before displacement by means of the negative pressure exerted following the contraction of the air bubbles 526*a* and 526*b*, as well as by the spring property of the movable separation films 525*a* and 525*b* themselves (FIG. 18E).

In accordance with the present embodiment, it is possible to enhance the discharge efficiency still more by the application of energy used for the film stretching, because there is provided the sagging portions as described above.

(Eighth Embodiment)

Figure 19A:
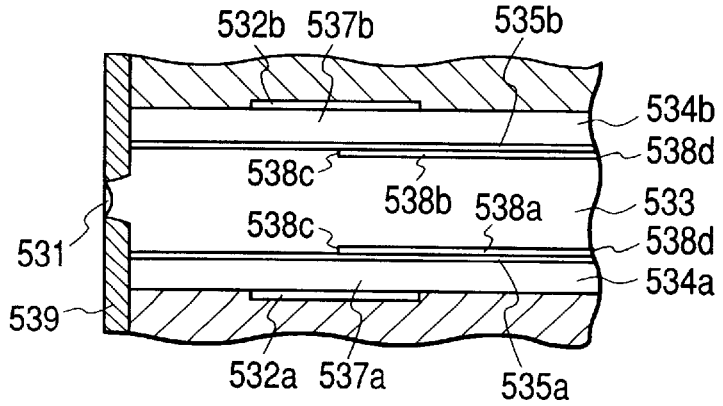
FIGS. 19A, 19B and 19C are cross-sectional views which illustrate the liquid discharging method in accordance with an eighth embodiment of the present invention, taken in the direction of liquid flow path.
Figure 19B:
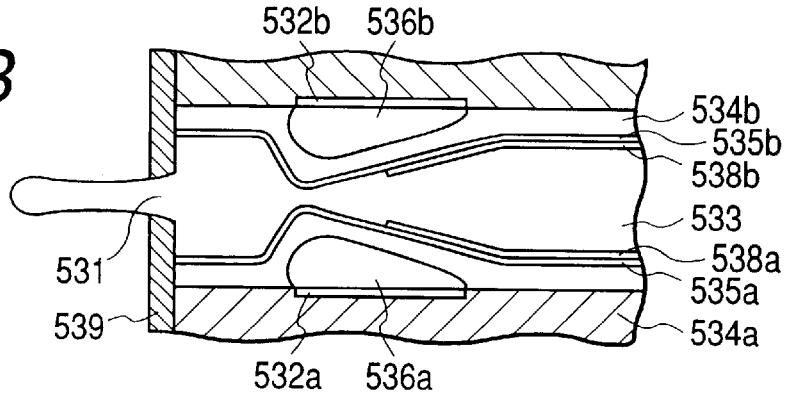
Figure 19C:
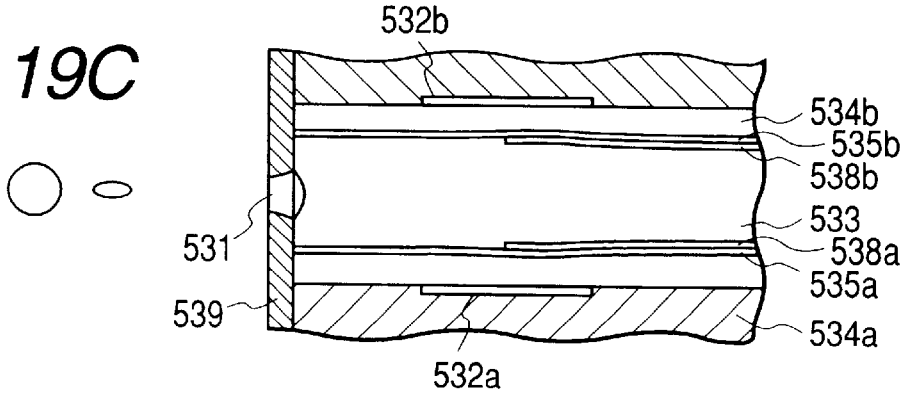

FIGS. 19A to 19C are cross-sectional views which illustrate the liquid discharge head in accordance with an eighth embodiment of the present invention, taken in the direction of the flow path thereof.

As shown in FIGS. 19A to 19C, the liquid supplied from the common liquid chamber (not shown) for use of discharge is filled in the discharge liquid flow path 533 which is conductively connected with the discharge opening 531 directly. Also, the liquid for bubble generation use is filled in the first and second bubble generating liquid flow paths 534*a* and 534*b*, which are provided with the air bubble generating areas 537*a* and 537*b*, respectively. The bubble generating liquid is caused to generate the bubble when thermal energy is given by means of the heat generating devices 532*a* and 532*b*, respectively. In this respect, the discharge liquid flow path 533 is sandwiched by the bubble generating liquid flow paths 534*a* and 534*b*, and between the discharge liquid flow path 533, and the bubble generating liquid flow paths 534*a* and 534*b*, the movable separation films 535*a* and 535*b* are arranged to face each other to separate the discharge liquid flow path 533, and the bubble generating liquid flow paths 534*a* and 534*b* from each other. Also, the heat generating device 532*a* and 532*b* are arranged to face each other. Also, on the discharge liquid flow path 533 side of the movable separation films 535*a* and 535*b*, there are provided free ends 538*c* and 538*c* on the air bubble generating areas 537*a* and 537*b*, and fulcrum points 538*d* and 538*d* farther on the upstream side, while the movable members 538*a* and 538*b*, which serve as means for regulating the directions in which these members are displaceable, are arranged along the movable separation films 535*a* and 535*b*, respectively. The movable separation films 535*a* and 535*b* and the orifice plate 539 are closely fixed to each other.

In the initial state shown in FIG. 19A, liquid in the discharge liquid flow path 533 is sucked nearer to the discharge opening 531 by means of the attraction of the capillary tube. Here, in accordance with the present embodiment, the discharge opening 531 is positioned on the downstream side in the direction of the liquid flow with respect to the projection areas of the heat generating devices 532*a* and 532*b* to the discharge liquid flow path 533.

In this state, when thermal energy is given to the heat generating devices 532*a* and 532*b*, the heat generating devices 532*a* and 532*b* are heated abruptly. The surfaces thereof, which are in contact with the bubble generating liquid in the air bubble generating areas 537*a* and 537*b*, give heat to the bubble generating liquid to foam. At this juncture, the pressure thus exerted by bubble generation becomes pressure waves to propagate bubble generating liquid in the bubble generating liquid flow paths 534*a* and 534*b*, thus acting upon the movable separation films 535*a* and 535*b*. In this manner, the movable separation films 535*a* and 535*b* are displaced in the directions to part from the heat generating devices 532*a* and 532*b*, that is, displaced in the direction to allow them to come closer to each other. Thus, the discharge of liquid in the discharge liquid flow path 523 is pushed out from the liquid discharge opening 531 of the discharge liquid flow path 533. At this juncture, however, the displacements of the movable separation films 535*a* and 535*b* are regulated by means of the movable members 538*a* and 538*b* (FIG. 19B). Here, since the free ends of the movable members 538*a* and 538*b* are positioned on the air bubble generating areas 537*a* and 537*b*, while the fulcrum points thereof are provided farther on the upstream side, the movable separation films 535*a* and 535*b* are displaced more largely on the downstream side than the upstream side.

After that, when the air bubbles 536*a* and 536*b* begin to be disappeared, the displacement amounts of the movable separation films 535*a* and 535*b* become smaller accordingly. In this manner, the liquid is discharged from the discharge opening 531. Then, when the air bubbles 536*a* and 536*b* have been disappeared completely, the movable separation films 535*a* and 535*b* are restored to the original position before displacement (FIG. 19C).

In this respect, for the present embodiment the description has been made of the example in which the movable members are provided both for the two movable separation films. However, it may be possible to arrange the movable member only for one of them. In this case, it becomes possible to implement balancing the displacements of the two movable separation films more appropriately for the further stabilization of discharging direction.

Also, by the provision of the movable members, it is possible to suppress the liquid movement to the upstream side, thus implementing the enhancement of refilling characteristics and the reduction of crosstalks as well, among some others. Such effects as these become more conspicuous when two sets of the pair of the movable member and movable separation film are arranged to face each other.

(Ninth Embodiment)

FIGS. 20A to 20F are cross-sectional views which illustrate the liquid discharge head in accordance with a ninth embodiment of the present invention, taken in the direction of the flow path thereof.

As shown in FIGS. 20A to 20F, the liquid supplied from the common liquid chamber (not shown) for use of discharge is filled in the discharge liquid flow path 543 which is conductively connected with the discharge opening 541 directly. Also, the liquid for bubble generation use is filled in the first and second bubble generating liquid flow paths 544*a* and 544*b*, which are provided with the air bubble generating areas 547*a* and 547*b*, respectively. The bubble generating liquid is caused to generate the bubble when thermal energy is given by means of the heat generating devices 542*a* and 542*b*, respectively. In this respect, the discharge liquid flow path 543 is sandwiched by the bubble generating liquid flow paths 544*a* and 544*b*, and between the discharge liquid flow path 543, and the bubble generating liquid flow paths 544*a* and 544*b*, the movable separation films 545*a* and 545*b* are arranged to face each other to separate the discharge liquid flow path 543, and the bubble generating liquid flow paths 544*a* and 544*b* from each other. Also, the heat generating device 542*a* and 542*b* are arranged to face each other. Also, the heat generating device 542*a* is arranged on the downstream side than the heat generating device 542*b*. Also, the movable separation films 545*a* and 545*b* and the orifice plate 549 are closely fixed to each other.

Figure 20A:
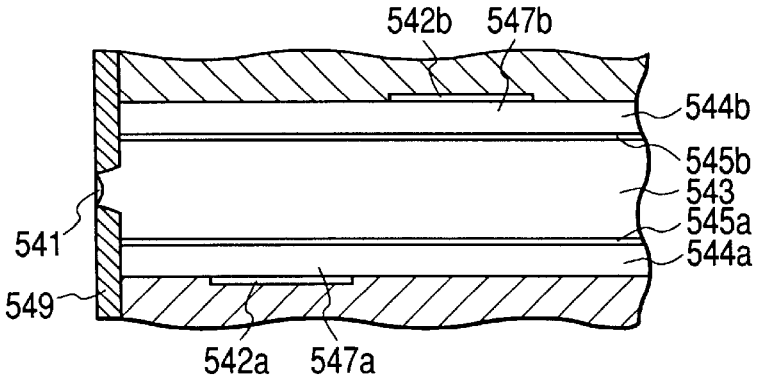
FIGS. 20A, 20B, 20C, 20D, 20E and 20F are cross-sectional views which illustrate the liquid discharging method in accordance with a ninth embodiment of the present invention, taken in the direction of liquid flow path.

In the initial state shown in FIG. 20A, liquid in the discharge liquid flow path 543 is sucked nearer to the discharge opening 541 by means of the attraction of the capillary tube. Here, in accordance with the present embodiment, the discharge opening 541 is positioned on the downstream side in the direction of the liquid flow with respect to the projection areas of the heat generating devices 542*a* and 542*b* to the discharge liquid flow path 543.

Figure 20B:
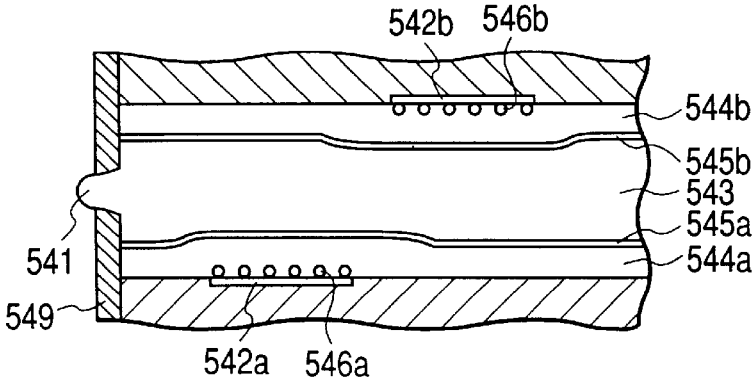

In this state, when thermal energy is given to the heat generating devices 542*a* and 542*b*, the heat generating devices 542*a* and 542*b* are heated abruptly. The surfaces thereof, which are in contact with the bubble generating liquid in the air bubble generating areas 547*a* and 547*b*, give heat to the bubble generating liquid to generate the bubble (FIG. 20B). At this juncture, the pressure thus exerted by bubble generation becomes pressure waves to propagate bubble generating liquid in the bubble generating liquid flow paths 544*a* and 544*b*, thus acting upon the movable separation films 545*a* and 545*b*. In this manner, the portions of the movable separation films 545*a* and 545*b*, which are in contact with the air bubble generating areas 547*a* and 547*b*, are displaced in the directions to part from the heat generating devices 542*a* and 542*b*. Then, the discharge of liquid in the discharge liquid flow path 543 is initiated to be made from the discharge opening 541.

Figure 20C:
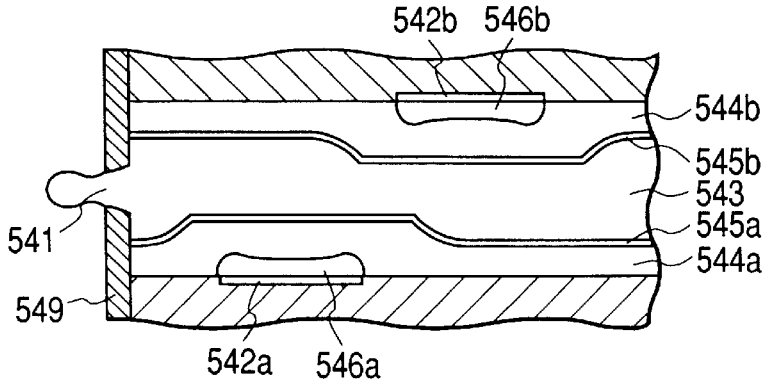
Figure 20D:
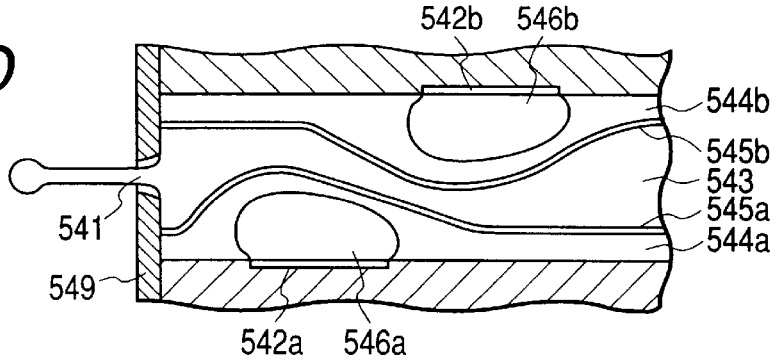

The air bubbles created on the entire surface of the heat generating devices 542*a* and 542*b* are developed rapidly to present themselves in the form of film (FIG. 20C). The expansion of the air bubbles 546*a* and 546*b* brought about by the extremely high pressure exerted in the initial stage causes the movable separation films 545*a* and 545*b* to be further displaced. In this manner, the discharge of liquid in the discharge liquid flow path 543 from the discharge opening 541 is in progress.

After that, when the air bubbles 546*a* and 546*b* are further developed, the movable separation films 545*a* and 545*b* are further displaced, while acting upon each other. In this way, the liquid in the discharge liquid flow path 543 moves directly to the discharge opening 541 side.

With the provision of such process in which the movable separation films 545*a* and 545*b* are displaced in the discharging direction on the downstream side so as to move the liquid directly to the discharge opening 541 side, the discharge efficiency is enhanced. Here, since the two movable separation films are arranged to face each other, the actions of the movable separation films 545*a* and 545*b* can cooperate with each other to further enhance the discharge efficiency.

In accordance with the present embodiment, the heat generating devices 542*a* and 542*b* are arranged to be in the shifted positions. Therefore, the movable separation films 545*a* and 545*b* are displaced along such shifted positions to enable the area having a greater flow resistance to be longer. As a result, the movement of liquid to the upstream side becomes relatively smaller, which effectively contributes to liquid refilling in the nozzles, particularly to the displacement areas of the movable separation films 545*a* and 545*b*.

Figure 20E:
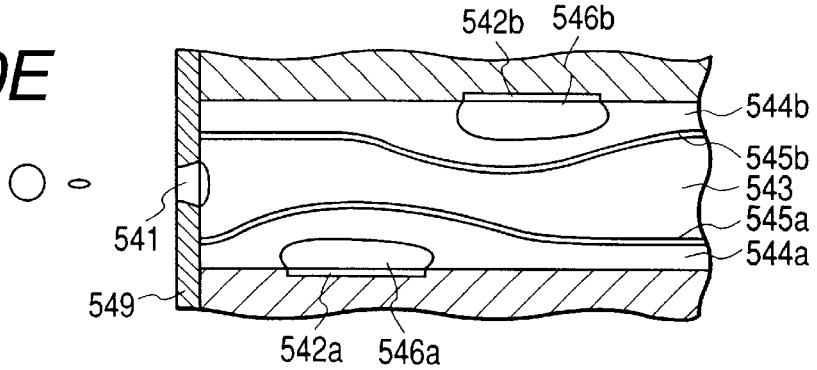

After that, when the air bubbles 546*a* and 546*b* begin to be disappeared, the displacement amounts of the movable separation films 545*a* and 545*b* become smaller accordingly. In this manner, the liquid is discharged from the discharge opening 541 (FIG. 20E).

Figure 20F:
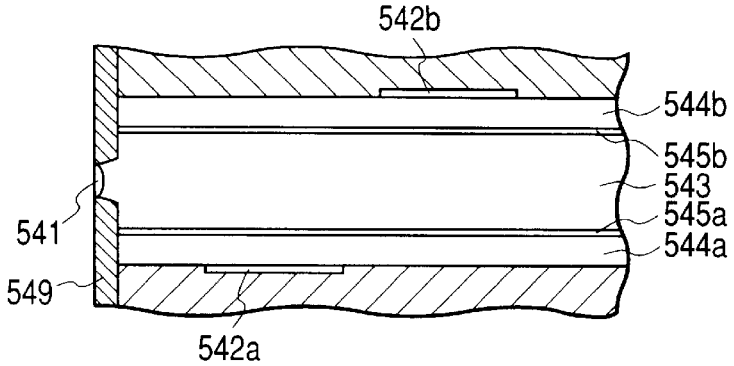

Then, when the air bubbles 546*a* and 546*b* have been disappeared completely, the movable separation films 545*a* and 545*b* are restored to the original position before displacement (FIG. 20F).

In this respect, for the present embodiment, the heat generating device 542*a* is arranged farther on the downstream side than the heat generating device 543*b*. However, the present invention is not necessarily limited to this positional arrangement. The same effects as those described above are obtainable if only the heat generating devices 542*a* and 542*b* are arranged to be in shifted positions.

Also, by shifting the bubble generation timing of the heat generating devices 542*a* and 542*b* from each other, it may be possible to implement the reduction of energy loss with respect to the upstream side, and the enhancement of the refilling characteristics as well, among some others.

Now, hereunder, the description will be made of the embodiments in which the bubble generation timing of the heat generating devices is shifted from each other.

(Tenth Embodiment)

FIGS. 21A to 21D are cross-sectional views which illustrate the liquid discharge head in accordance with a tenth embodiment of the present invention, taken in the direction of the flow path thereof. Also, FIGS. 22A and 22B are views which illustrate the displacement timing of the movable separation films in accordance with the liquid discharging method represented in FIGS. 21A to 21D: FIG. 22A shows the displacement time of the movable separation film 555*b*; and FIG. 22B shows the displacement timing of the movable separation film 555*a*.

As shown in FIGS. 21A to 21D, the liquid supplied from the common liquid chamber (not shown) for use of discharge is filled in the discharge liquid flow path 553 which is conductively connected with the discharge opening 551 directly. Also, the liquid for bubble generation use is filled in the first and second bubble generating liquid flow paths 554*a* and 554*b*, which are provided with the air bubble generating areas 557*a* and 557*b*, respectively. The bubble generating liquid is caused to generate the bubble when thermal energy is given by means of the heat generating devices 552*a* and 552*b*, respectively. In this respect, the discharge liquid flow path 553 is sandwiched by the bubble generating liquid flow paths 554*a* and 554*b*, and between the discharge liquid flow path 553, and the bubble generating liquid flow paths 554*a* and 554*b*, at least parts of the displacement areas of the movable separation films 545*a* and 545*b* are arranged to face each other to separate the discharge liquid flow path 553, and the bubble generating liquid flow paths 554*a* and 554*b* from each other. Also, the heat generating device 552*a* and 552*b* are arranged to face each other. Also, the heat generating device 552*a* is arranged on the downstream side than the heat generating device 552*b*. As shown in FIGS. 22A and 22B, thermal energy for use of bubble generation is at first given to the heat generating device 552*b*, and then, with a slight delay, thermal energy is given to the heat generating device 552*a*. Also, the movable separation films 555*a* and 555*b* and the orifice plate 559 are closely fixed to each other.

Figure 21A:
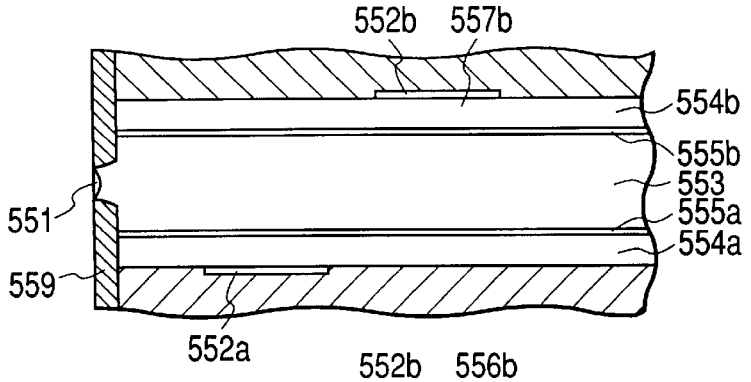
FIGS. 21A, 21B, 21C and 21D are cross-sectional views which illustrate the liquid discharging method in accordance with a tenth embodiment of the present invention, taken in the direction of liquid flow path.
Figure 22A:
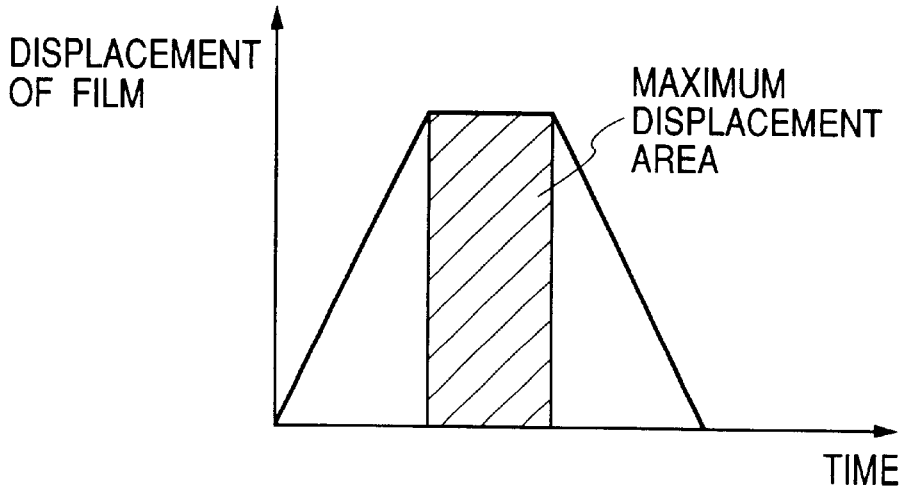
FIG. 22A and FIG. 22B are views which illustrate the displacement timing of the movable separation film in accordance with the liquid discharging method illustrated in FIGS. 21A, 21B, 21C and 21D.
Figure 22B:
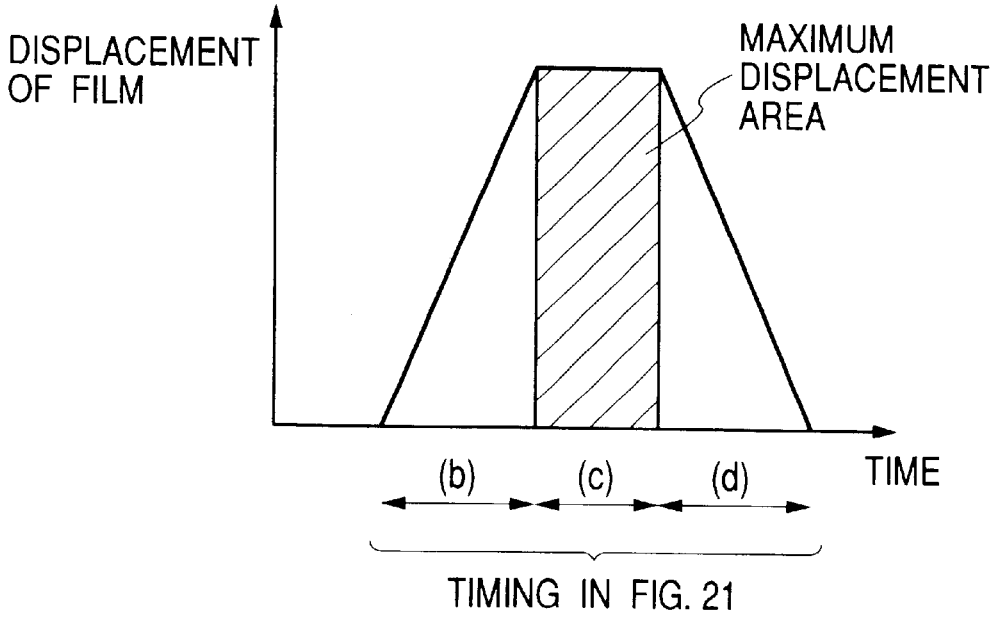

In the initial state shown in FIG. 21A, liquid in the discharge liquid flow path 553 is sucked nearer to the discharge opening 551 by means of the attraction of the capillary tube. Here, in accordance with the present embodiment, the discharge opening 551 is positioned on the downstream side in the direction of the liquid flow with respect to the projection areas of the heat generating devices 552*a* and 552*b* to the discharge liquid flow path 553.

Figure 21B:
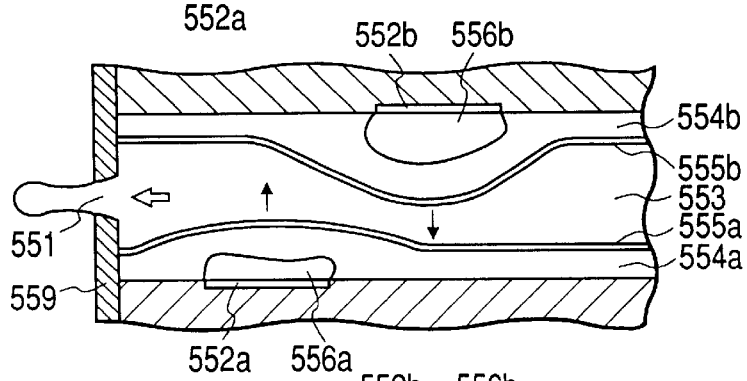

In this state, when thermal energy is given to the heat generating devices 552*a* and 552*b*, the heat generating devices 552*a* and 552*b* are heated abruptly. The surfaces thereof, which are in contact with the bubble generating liquid in the air bubble generating areas 557*a* and 557*b*, give heat to the bubble generating liquid to foam. At this juncture, in accordance with the present embodiment, the arrangement is made so that thermal energy for bubble generation use is at first given to the heat generating device 552*b*, and then, with a slight delay, thermal energy is given to the heat generating device 552*a*. Therefore, an air bubble 546*b* is created at first in the air bubble generating area 557*b* on the heat generating device 552*b*. Thus, the movable separation film 555*b* is displaced to the discharge liquid flow path 553 side. After that, an air bubble 556*a* is created in the air bubble generating area 557*a* on the heat generating device 552*a* to enable the movable separation film 555*a* to be displaced to the discharge liquid flow path 553 side (FIG. 21B). In this way, it is possible to reduce the movement of liquid in the discharge flow path 553 to the upstream side in order to enhance the discharge efficiency.

Figure 21C:
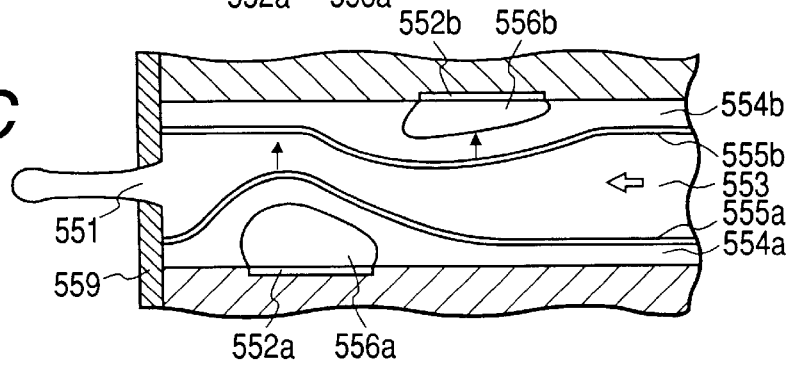

When the movable separation film 555*a* has been displaced to the discharge liquid flow path 553 side so as to stretch it to the maximum, the movable separation film 555*b* has already begun to contract. Therefore, liquid is sucked more from the upstream side than from the discharge opening 551 side, hence contributing to the enhancement of refilling effectively (FIG. 21C).

Figure 21D:
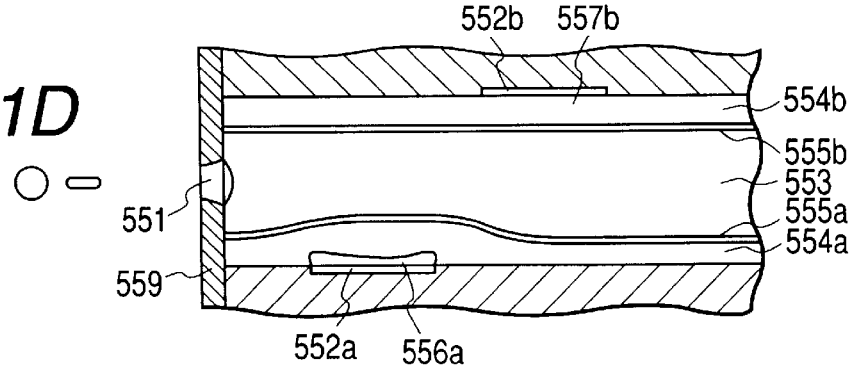

After that, when the air bubbles 546*a* and 546*b* begin to be disappeared, the displacement amounts of the movable separation films 545*a* and 545*b* become smaller accordingly. In this manner, the liquid is discharged from the discharge opening 541 (FIG. 21D).

In this respect, the mode, in which the portion of the movable separation film on the downstream is displaced to the discharge opening side relatively larger than that of the upstream side with respect to the liquid flow direction in the discharge liquid flow path, is one of the preferable modes embodying the present invention. However, it is to be understood that the present invention is not limited to the mode described above.

For example, the mode, in which the portions of the movable separation films on the downstream and upstream sides are displaced almost the same in the processes after the one represented in FIG. 16E, is also within the scope of the present invention.

Also, a higher thought of the present invention is that it should be good enough if means for enhancing the discharge force are such that at least a part thereof to face each other, and then, one is means for discharging to guide the development of air bubble to the discharge opening side, and the other is means for forming air bubble for use of discharging.

With such higher thought in view, it should be good enough if only a facing area is provided for a structure or for the development of air bubble to the discharge opening side in relation to the film or the air bubble itself. Here, therefore, the following combinations can be listed among some others:

(1) A method or an apparatus that performs discharging in which the developed air bubble formed by the first movable member provided with the above-mentioned free end (hereinafter referred to as the structure A) and the developed air bubble formed by the second movable member provided with the above-mentioned free end (hereinafter referred to as the area B) face each other at least partly.

(2) A method or an apparatus that performs discharge in which the separation film developed by means of air bubble to the discharge opening side, which is formed by the orientation of the displacement of the separation film to the discharge opening side (hereinafter referred to as the structure C, the details of which will be described later) and the portion that contributes to the discharge of air bubble by means of created film boiling (hereinafter referred to as the structure D) face each other at least partly.

(3) A method or an apparatus that performs discharging in which the developed separation film obtainable by forming the structure C described above by the movable member having the above-mentioned free end (hereinafter referred to as the structure E) and the structure D described above face each other at least partly.

(4) A method or an apparatus that performs discharging in which the "the structure A and structure C described above" or "the structure A and structure D described above" face each other at least partly.

(Examples of the Separation Film Applicable to the Execution of the Present Invention)

Hereinafter, the description will be made of the examples of the separation films to be used for the present invention as described above.

FIGS. 23A to 23E, FIGS. 24A to 24E and FIGS. 25A to 25C are views which illustrate the examples of the liquid discharging method applicable to the present invention. The discharge opening is arranged in the end portion of the first liquid flow path. On the upstream side of the discharge opening (with respect to the flow direction of discharge liquid in the first liquid flow path), there is arranged the displacement area of the movable separation film which is displaceable in accordance with the development of a created air bubble. Also, the second liquid flow path contains bubble generating liquid or it is filled with bubble generating liquid (preferably, capable of being refilled or more preferably, capable of moving bubble generating liquid), which is provided with the air bubble generating area.

In accordance with this example, the air bubble generating area is also positioned on the upstream zone than the discharge opening side with respect to the flow direction of the discharge liquid described above. In addition, the separation film is made longer than the length of the electrothermal transducing device that forms the air bubble generating area, which is provided as the movable area. However, with respect to the flow direction described above, the separation film should be provided with a fixed portion (not shown) between the end portion of the electrothermal transducing device on the upstream side and the common liquid chamber of the first liquid flow path or preferably, on the aforesaid end portion on the upstream side. Therefore, the essential range in which the separation film can move is readily understandable from the representation of FIGS. 23A to 23E, FIGS. 24A to 24E and FIGS. 25A to 25C.

Each state of the movable separation film represented in FIGS. 23A to 23E, FIGS. 24A to 24E and FIGS. 25A to 25C is the element that represents all of those obtainable from the elasticity of the movable separation film itself, the thickness thereof, or any other additional structures to it.

In this respect, as the structures that specifically implement the above-mentioned displacement processes which are characteristics of the present invention, the following embodiments can be listed for illustration; additionally, however, the present invention includes any other structures under which the above-mentioned displacement processes can be achieved within the range of the technical thought of the present invention.

Here, the representative structural example of the apparatus is described in accordance with the present invention. The term "directional regulation" referred to hereunder includes such constituents as the structure of the movable separation film itself (for example, the distribution of elastic modules, and the combination of the portions that present the stretching deformation and non-deformation, among some others) or additional members that act upon the movable separation film or some other movable members described earlier, which embody the present invention or the structure formed by the first liquid flow path or the like, as well as any others formed by the combinations of these elements.

(First Example)

FIGS. 23A to 23E are cross-sectional views which illustrate the first example of the liquid discharging method applicable to the present invention, taken in the direction of flow path thereof, (the case where the displacement process of the present invention takes place from the midway of the discharging process).

As shown in FIGS. 23A to 23E, in accordance with the present mode, the first liquid supplied for the first common liquid chamber 243 is filled in the first liquid flow path 203 which is directly connected with the discharge opening 201. Also, in the second liquid flow path 204 which is provided with the air bubble generating area 207, the liquid for bubble generation use is filled, which is caused to generate the bubble when thermal energy is given by means of the heat generating device 202. In this respect, between the first liquid flow path 203 and the second liquid flow path 204, a movable separation film 205 is arranged to separate them from each other. Here, the movable separation film 205 and the orifice plate 209 are closely fixed with each other. As a result, there is no possibility that liquids in each of the flow paths are allowed to be mixed.

Here, the movable separation film 205 is not provided usually with any directivity when it is displaced by the creation of air bubble in the air bubble generating area 207. In some cases, the movable separation film may be displaced rather toward the common liquid chamber side where a higher degree of freedom is available for displacement.

For this example, attention is given to this movement of the movable separation film 205. Means for regulating the displacement is provided for the movable separation film 205 itself, which may act upon it directly or indirectly. With the provision of such means, it is made possible to direct the displacement of the movable separation film 205 resulting from the creation of air bubble to the discharge opening side.

Figure 23A:
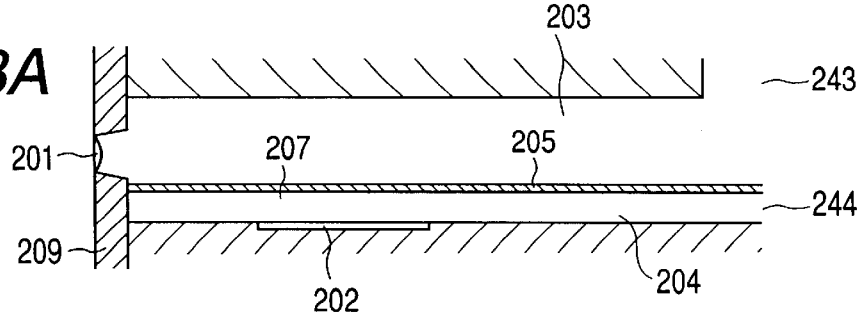
FIGS. 23A, 23B, 23C, 23D and 23E are cross-sectional views which illustrate a first example of the liquid discharging method applicable to the present invention.

In the initial state shown in FIG. 23A, liquid in the first liquid flow path 203 is sucked nearer to the discharge opening 201 by means of the attraction of the capillary tube. Here, in accordance with the present example, the discharge opening 201 is positioned on the downstream side in the direction of the liquid flow with respect to the projection area of the heat generating device 202 to the first liquid flow path 203.

Figure 23B:
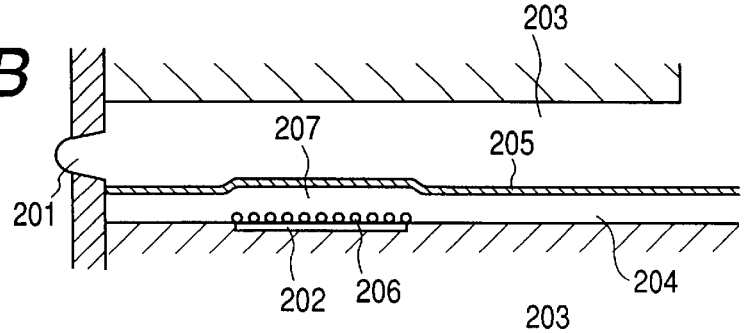

In this state, when thermal energy is given to the heat generating devices 202 (for the present example, a heat generating resistor in the shape of 40 $\mu$m×105 $\mu$m), the heat generating device 202 is heated abruptly. The surface thereof, which is in contact with the second liquid in the air bubble generating area 207 gives heat to the liquid to generate the bubble (FIG. 23B). The air bubble 206 thus created by the heat bubble generation is an air bubble created on the basis of such film boiling as disclosed in the specification of U.S. Pat. No. 4,723,129. It is created on the entire surface of the heat generating device at a time accompanied by extremely high pressure. At this juncture, the pressure thus exerted becomes pressure waves to propagate the second liquid in the second liquid flow paths 204, thus acting upon the movable separation film 205. In this manner, the movable separation film 205 is displaced to initiate the discharge of the second liquid in the first liquid flow path 203.

Figure 23C:
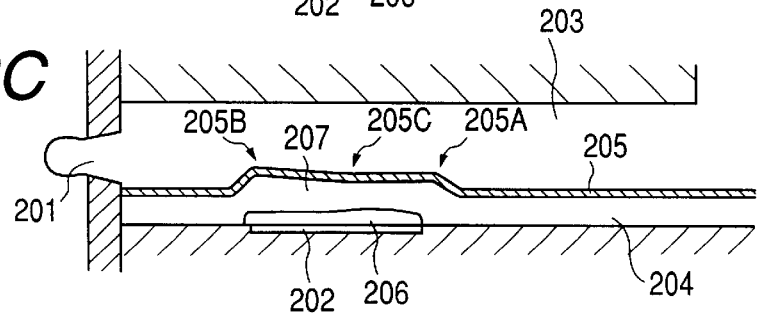

The air bubble 206 created on the entire surface of the heat generating device 202 is developed rapidly to present itself in the form of film (FIG. 23C). The expansion of the air bubble 206 brought about by the extremely high pressure exerted in the initial stage causes the movable separation film 205 to be further displaced. In this manner, the discharge of the first liquid in the first liquid flow path 203 from the discharge opening 201 is in progress.

Figure 23D:
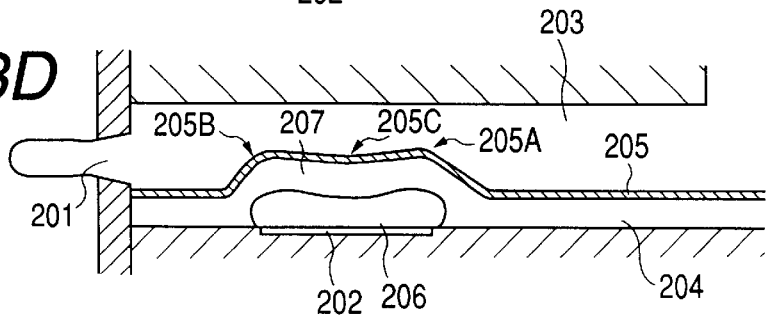

After that, the air bubble 206 is further developed. Then, the displacement of the movable separation film 205 becomes larger (FIG. 23D). Here, the movable separation film 205 is continuously stretched in the state shown in FIG. 23D so that the displacement thereof on the portion at 205A on the upstream side and that on the portion at 205B on the downstream side are made substantially equal with respect to the central portion at 205C of the area of the movable separation film 205 that faces the heat generating device 202.

After that, when the air bubble 206 is further developed, the portions of the air bubble 206 and the displacing movable separation film 205 on the downstream side at 205B are displaced relatively larger in the direction toward the discharge opening side than the portions thereof on the upstream side at 205A. In this manner, the first liquid in the first liquid flow path 203 is moved directly in the direction toward the discharge opening 201 (FIG. 23E).

Here, with the provision of the displacement process of the movable separation film 205 in the discharge direction on the downstream side thereof, which enables liquid to move directly in the direction toward the discharge opening, it becomes possible to enhance the discharge efficiency. Further, the movement of liquid to the upstream side becomes relatively smaller, which acts effectively upon the liquid refilling (liquid supply form the upstream side) into the nozzles, particularly onto the displacement area of the movable separation film 205.

Figure 23E:
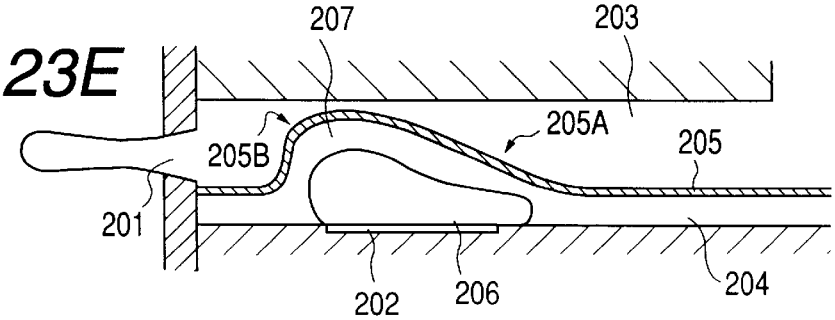

Also, in the case where the movable separation film 205 itself is displaced in the direction toward the discharge opening so that its state may change as represented in FIGS. 23D and 23E, respectively, it becomes possible not only to enhance the discharge efficiency as well as the refilling efficiency, but also, to implement the increase of the discharge amount by carrying the first liquid residing in the projection area of the heat generating device 202 in the first liquid flow path in the direction toward the discharge opening.

(Second Example)

FIGS. 24A to 24E are cross-sectional views which illustrate the second example of the liquid discharging method applicable to the present invention, taken in the direction of flow path thereof, (the example being such that the displacement process of the present invention is arranged from the initial stage of the processes provided for the method).

This example is structured in the same manner as the first example fundamentally. As shown in FIGS. 24A to 24E, the first liquid supplied for the first common liquid chamber 243 is filled in the first liquid flow path 213 which is directly connected with the discharge opening 211. Also, in the second liquid flow path 214 which is provided with the air bubble generating area 217, the liquid for bubble generation use is filled, which is caused to generate the bubble when thermal energy is given by means of the heat generating device 212. In this respect, between the first liquid flow path 213 and the second liquid flow path 214, a movable separation film 215 is arranged to separate them from each other. Here, the movable separation film 215 and the orifice plate 219 are closely fixed with each other. As a result, there is no possibility that liquids in each of the flow paths are allowed to be mixed.

Figure 24A:
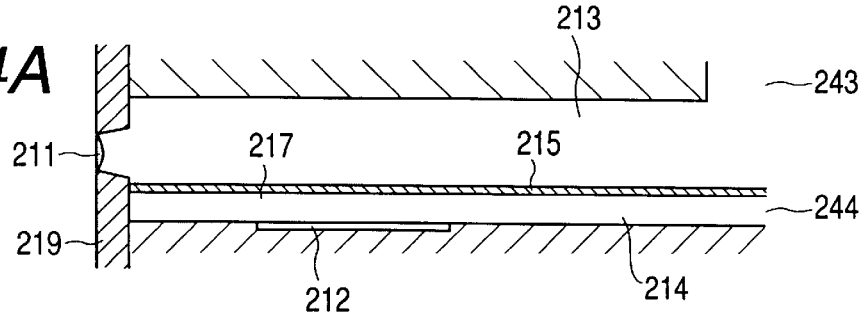

In the initial state shown in FIG. 24A, liquid in the first liquid flow path 213 is sucked nearer to the discharge opening 211 by means of the attraction of the capillary tube. Here, in accordance with the present example, the discharge opening 211 is positioned on the downstream side in the direction of the liquid flow with respect to the projection area of the heat generating device 212 to the first liquid flow path 203.

Figure 24B:
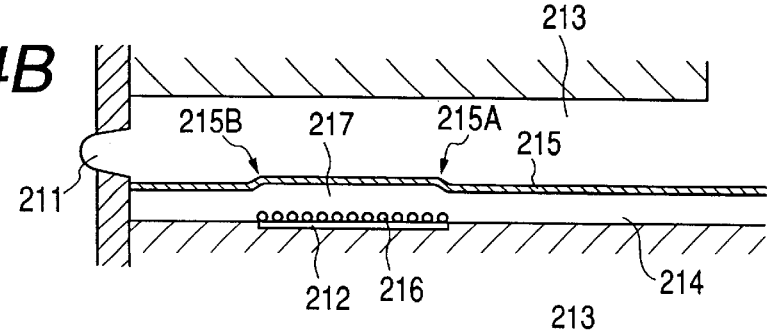

In this state, when thermal energy is given to the heat generating devices 212 (for the present example, a heat generating resistor in the shape of 40 $\mu$m×115 $\mu$m), the heat generating device 212 is heated abruptly. The surface thereof, which is in contact with the second liquid in the air bubble generating area 217 gives heat to the liquid to generate the bubble (FIG. 24B). The air bubble 216 thus created by the heat bubble generation is an air bubble created on the basis of such film boiling as disclosed in the specification of U.S. Pat. No. 4,723,129. It is created on the entire surface of the heat generating device at a time accompanied by extremely high pressure. At this juncture, the pressure thus exerted becomes pressure waves to propagate the second liquid in the second liquid flow paths 214, thus acting upon the movable separation film 215. In this manner, the movable separation film 215 is displaced to initiate the discharge of the second liquid in the first liquid flow path 213.

Figure 24C:
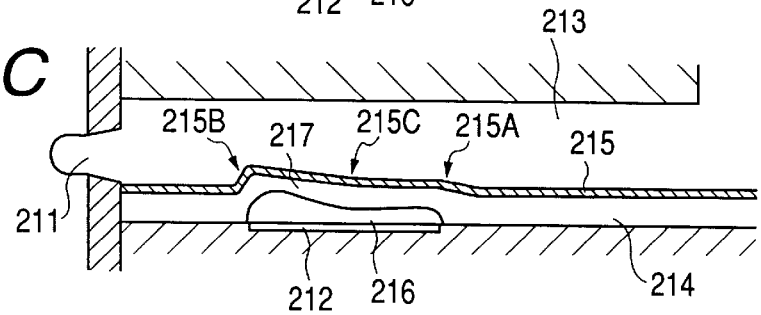

The air bubble 216 created on the entire surface of the heat generating device 212 is developed rapidly to present itself in the form of film (FIG. 24C). The expansion of the air bubble 216 brought about by the extremely high pressure exerted in the initial stage causes the movable separation film 215 to be further displaced. In this manner, the discharge of the first liquid in the first liquid flow path 213 from the discharge opening 201 is in progress. At this juncture, as shown in FIG. 24C, the portion of the movable separation film 215 on the downstream side at 215B is largely displaced in the movable area from the initial stage than the portion thereof on the upstream side at 215A. In this way, the first liquid in the first liquid flow path 213 is efficiently moved to the discharge opening 211 side even from the initial stage.

Figure 24D:
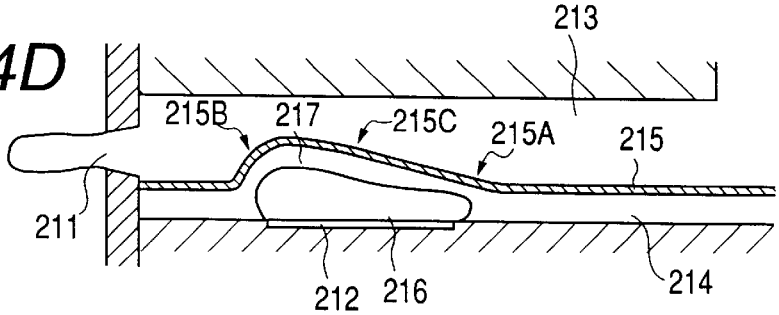

After that, when the air bubble 216 is further developed, the displacement of the movable separation film 215 and the development of the air bubble are prompted from the state shown in FIG. 24C. Along with this promotion, the displacement of the movable separation film 215 is displaced larger still (FIG. 24D). Particularly, the displacement of the movable separation film 215 on the portion on the downstream side at 215B becomes greater than the displacement of the portion on the downstream side at 215A and the central portion at 215C. Therefore, the movement of the first liquid in the first liquid flow path 213 is accelerated in the direction toward the discharge opening directly, while the displacement of the portion on the upstream side at 215A is smaller in the entire process. As a result, the movement of liquid is smaller in the direction toward the upstream side.

In this way, it becomes possible to enhance the discharge efficiency, particularly the discharge speed, and to produce favorable effect on the liquid refilling in the nozzles, and the voluminal stabilization of the discharge droplets as well.

Figure 24E:
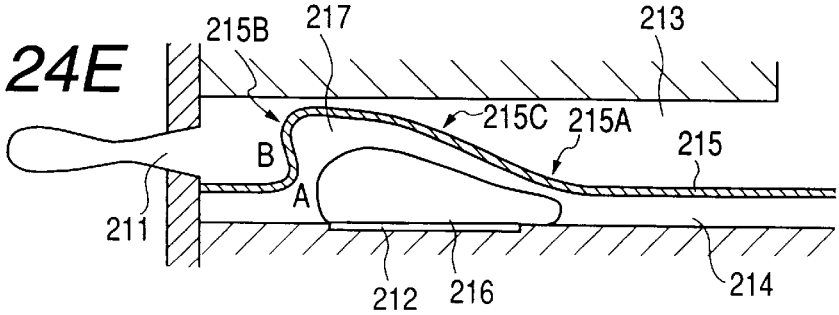

After that, when the air bubble 216 is further developed, the portions of the movable separation film 205 on the downstream side at 215B and in the central portion at 215C are displaced and stretched further in the direction toward the discharge opening side than the portions thereof on the upstream side at 205A. In this manner, the enhancement of the above-mentioned effects, namely, the discharge efficiency and the discharge speed, are implemented (FIG. 24C). Particularly, in this case, the displacement and stretching are made greater not only with respect to the sectional configuration of the movable separation film 215, but also, to the width direction of the liquid flow path. Therefore, the acting area, in which the first liquid is in the direction toward the discharge opening, becomes larger, hence making it possible to enhance the discharge efficiency multiplicatively. Here, the displacement configuration of the movable separation film 215 resembles the shape of human nose. Thus, this is called "nose type". Also, it is to be understood that as shown in FIG. 24E, the nose type includes the "S-letter type" where the point S positioned on the upstream side in the initial stage is allowed to be positioned on the downstream side of the point A positioned on the downstream side in the initial stage, as well as the configuration where as shown in FIG. 8, the points A and B are equally positioned.

(Example of the Displacement of the Movable Separation Film).

Figure 25A:
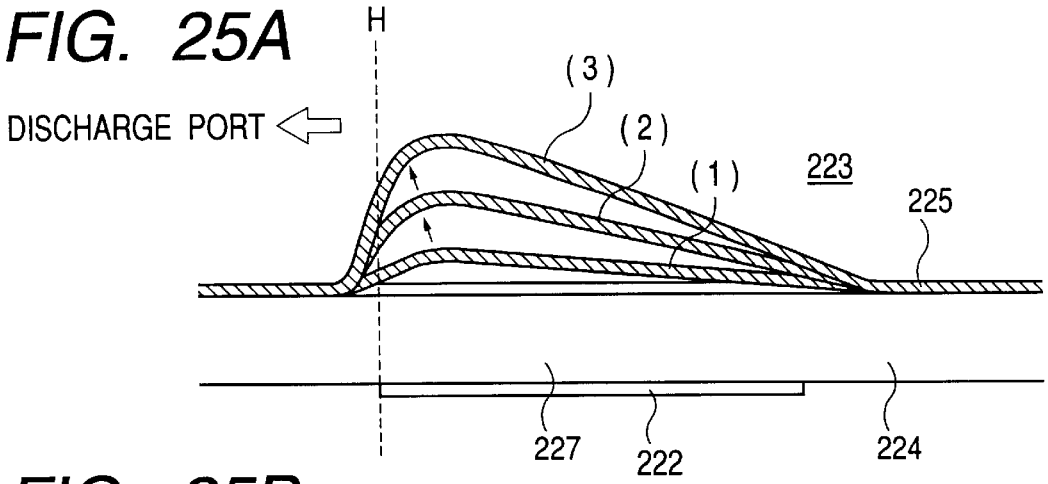
FIGS. 25A, 25B and 25C are cross-sectional views which illustrate the displacement processes of the movable separation film in accordance with the liquid discharging method applicable to the present invention, taken in the direction of flow path.
Figure 25B:
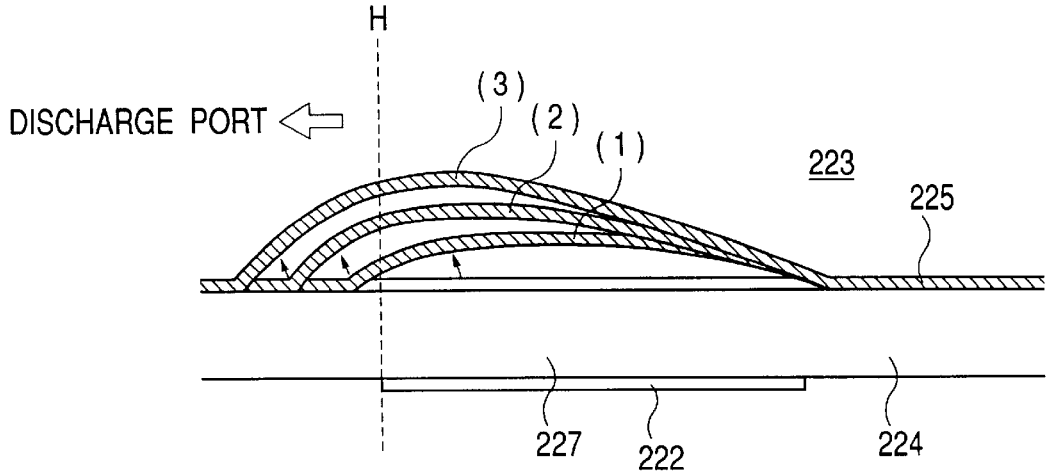
Figure 25C:
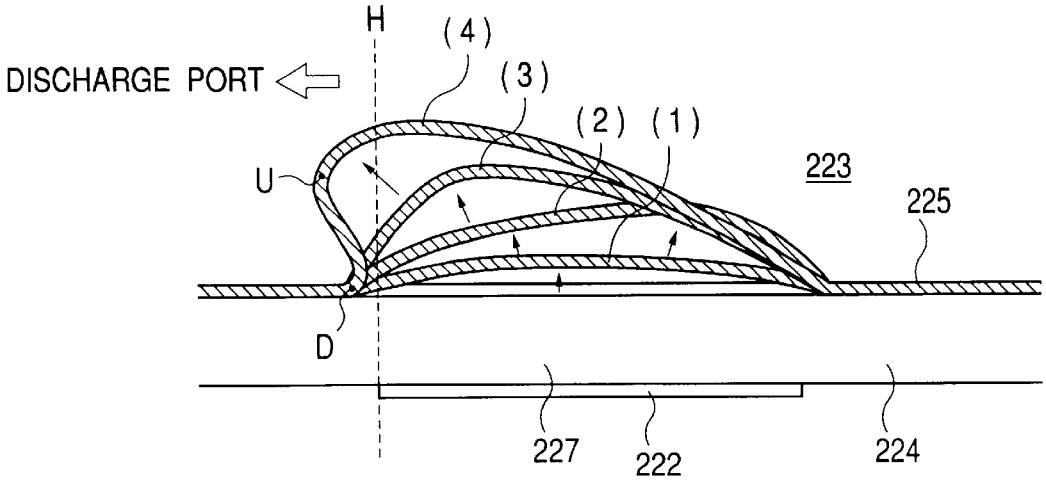

FIGS. 25A to 25C are cross-sectional views which illustrate the displacement process of the movable separation film for the liquid discharging method applicable to the present invention, taken in the direction of flow path thereof.

In this respect, the description will be made by giving attention particularly to the movable range and the displacement of the movable separation film, and the provision of figures of the air bubble, the first liquid flow path, and the discharge opening will be omitted. However, in any one of FIGS. 25A to 25C, the fundamental structure is arranged in such a manner that the vicinity of the projection area of the heat generating device 222 is the air bubble generating area 227 in the second liquid flow path 224, and that the second liquid flow path 224 and the first liquid flow path 223 are separated essentially by means of the movable separation film 225 at all times from the initial stage. Also, with the end portion of the heat generating device 222 (indicated by line H in FIGS. 25A to 25C) serving as the boundary, the discharge opening is arranged on the downstream side, and the supply unit of the first liquid is arranged on the upstream side. Here, the term "upstream side" and the term "downstream side" referred to in the present example and on are meant to describe the direction of liquid flow in the flow path, observed from the central portion of the movable range of the movable separation film.

In FIG. 25A, the movable separation film 225 is displaced in order of (1), (2), and (3) from the initial state, and there provided from the initial stage the process in which the downstream side is displaced larger than the upstream side. This process, in particular, makes it possible to enhance the discharge efficiency, and at the same time, to implement the enhancement of discharge speed, because it can act upon the displacement on the downstream side to push out the first liquid in the first liquid flow path 223 in the direction toward the discharge opening side. Here, in FIG. 25A, it is assumed that the movable range described above is substantially constant.

In FIG. 25B, as the movable separation film 225 is displaced in order of (1), (2), and (3), the movable range of the movable separation film 225 is shifted or expanded to the discharge opening side. In this mode, the upstream side of the movable range is fixed. Here, the downstream side of the movable separation film 225 is displaced larger than the upstream side, and at the same time, the development of the air bubble itself is also made in the direction toward the discharge opening side. Therefore, the discharge efficiency is enhanced still more.

In FIG. 25C, the movable separation film 225 is displaced from the initial state indicated by the number (1) to the state indicated by the number (2) uniformly both the upstream and downstream sides or in condition that the upstream side is displaced slightly larger. However, when the air bubble is further developed from the state indicated by the number (3) to the number (4), the downstream side is displaced larger than the upstream side. In this way, the first liquid even in the upper part of the movable region can be moved in the direction toward the discharge port side, hence enhancing the discharge efficiency, as well as increasing the amount of discharge.

Further, in FIG. 25C, the point U where the movable separation film 225 exists in the process indicated by the number (4) is displaced farther on the discharge opening side than the point D positioned farther on the downstream than the point U in the initial state. Therefore, the portion which is expanded and extruded into the discharge opening side makes it possible to enhance the discharge efficiency still more. Here, this configuration is called the "nose type" as described earlier.

The liquid discharging methods provided with the processes described above are applicable to the present invention. Each of the processes represented in FIGS. 25A to 25C is not necessarily adopted individually, but it is assumed that a process that contains the respective components is also applicable to the present invention. Also, the process that contains the nose type is not necessarily limited to the one represented in FIG. 25C. Such process may be introduced into the ones represented in FIGS. 25A and 25B. Also, the movable separation films used for the structure represented in FIGS. 18A to 18E may be such as to be provided with the sagged portions in advance irrespective of whether or not the films can be expanded. Also, the thickness of any one of the movable separation films shown in figures does not present any particular meaning in terms of dimensions.

Here, the "means for regulating direction" referred to in the specification hereof includes all the means that may result in the "displacement" defined in the application hereof, but it is derived from the structure or characteristics of the movable separation film itself, and uses at least one of the actions or arrangement relationships of the movable separation films with the air bubble generating areas, the relationships with the flow resistance on the circumference of the air bubble generating areas, the members that act upon the movable separation films directly or indirectly, or the members (means) for regulating the displacement or expansion of the movable separation films. Therefore, the invention hereof includes in the embodiments thereof a plurality (more than two) of means for regulating direction described above as a matter of course. However, in the embodiments that have been given above, there is no description as to any arbitrary combination of the plural means for regulating direction. Here, it is to be understood that the present invention is not necessarily limited to the embodiments described above.

Figure 26A:
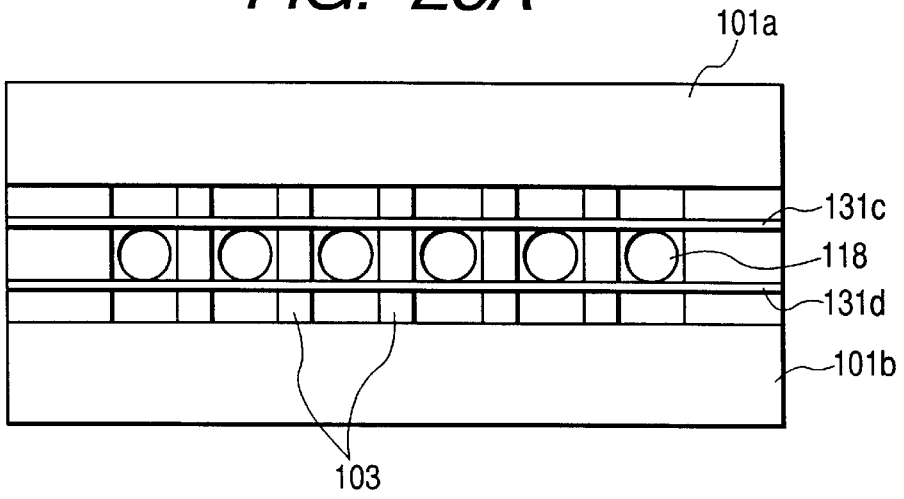
FIG. 26A and FIG. 26B are views which illustrate one structural example of the liquid discharge head in accordance with the present invention.
Figure 26B:
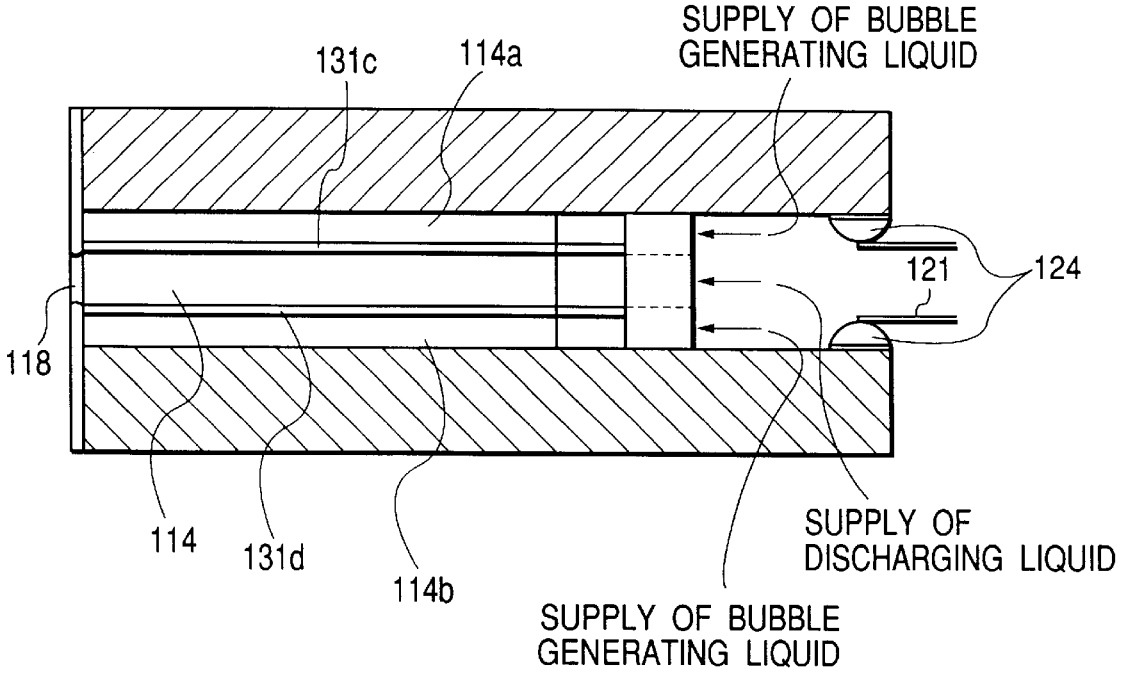

FIGS. 26A and 26B show an arrangement of the liquid discharging head according to the present invention. FIG. 26A is a view from the discharge port 118 and FIG. 26B is a cross-sectional view in a direction of the liquid flow path.

As shown in FIGS. 26A and 26B, a discharging liquid flow path 114 is sandwiched between two element substrates 101*a* and 111*b*, and bubble generating liquid flow paths 114*a* and 114*b* are provided above and below the discharging liquid flow path 114. Movable separation films 131*c* and 131*d* for permanently substantially separating the discharging liquid flow path and the bubble generating liquid flow paths are provided between the discharging liquid flow path and the bubble generating liquid flow paths. In addition, the element substrates 101*a* and 101*b* are connected to an electrically connecting member 121 through a bump 114, and therefore an electrical signal from the outside is inputted to the element substrates 101*a* and 101*b*. A reference numeral 103 denotes a nozzle wall.

Now, hereunder, the description will be made of a liquid discharge apparatus having mounted on it a liquid discharge head described above.

Figure 27:
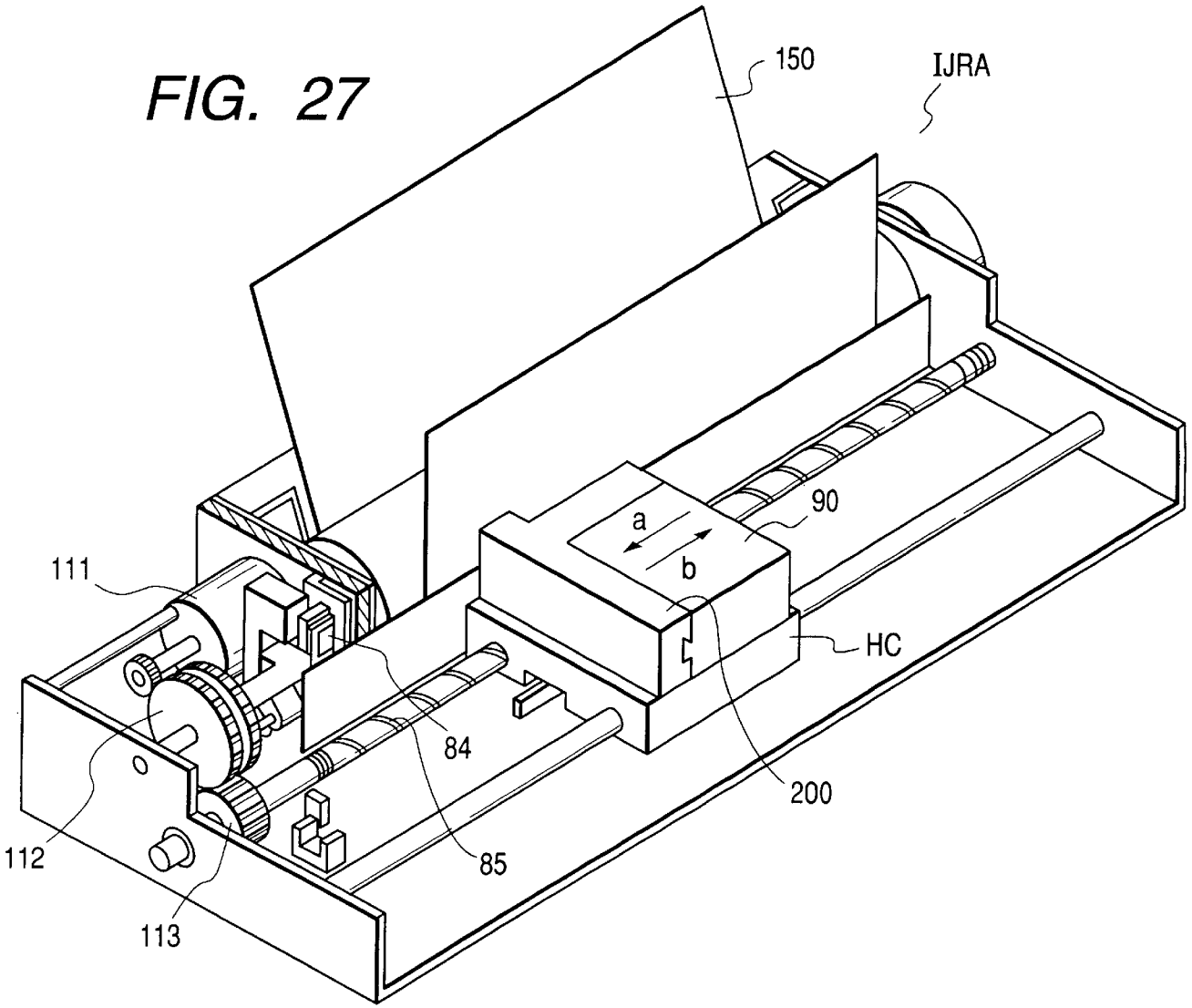
FIG. 27 is a view which schematically shows the structure of the liquid discharge apparatus in accordance with the present invention.

FIG. 27 is a view that schematically shows such liquid discharge apparatus in accordance with the present invention.

For the present embodiment, the description will be made of an ink jet recording apparatus that uses particularly ink as its discharge liquid. The carriage HC thereof mounts a head cartridge on which a liquid tank unit 90 and a liquid discharge head unit 200 are detachably mountable. The carriage reciprocates in the width direction of a recording medium 150, such as a recording sheet, to be carried by means for carrying the recording medium.

When driving signals are supplied from means for supplying driving signals (not shown) to liquid discharging means on the carriage, recording liquid is discharged from the liquid discharge head to the recording medium in accordance with the signals thus supplied.

Also, for the liquid discharge apparatus of the present embodiment, there are provided a motor 111 serving as the driving source that drives means for carrying the recording medium, and the carriage as well; and gears 112 and 113, and the carriage shaft 115, which transmit the driving force from the driving source to the carriage, among some others. With this recording apparatus and the liquid discharging method used therefor, it is possible to obtain recorded objects in good images by discharging liquid to various kinds of recording media.

Figure 28:
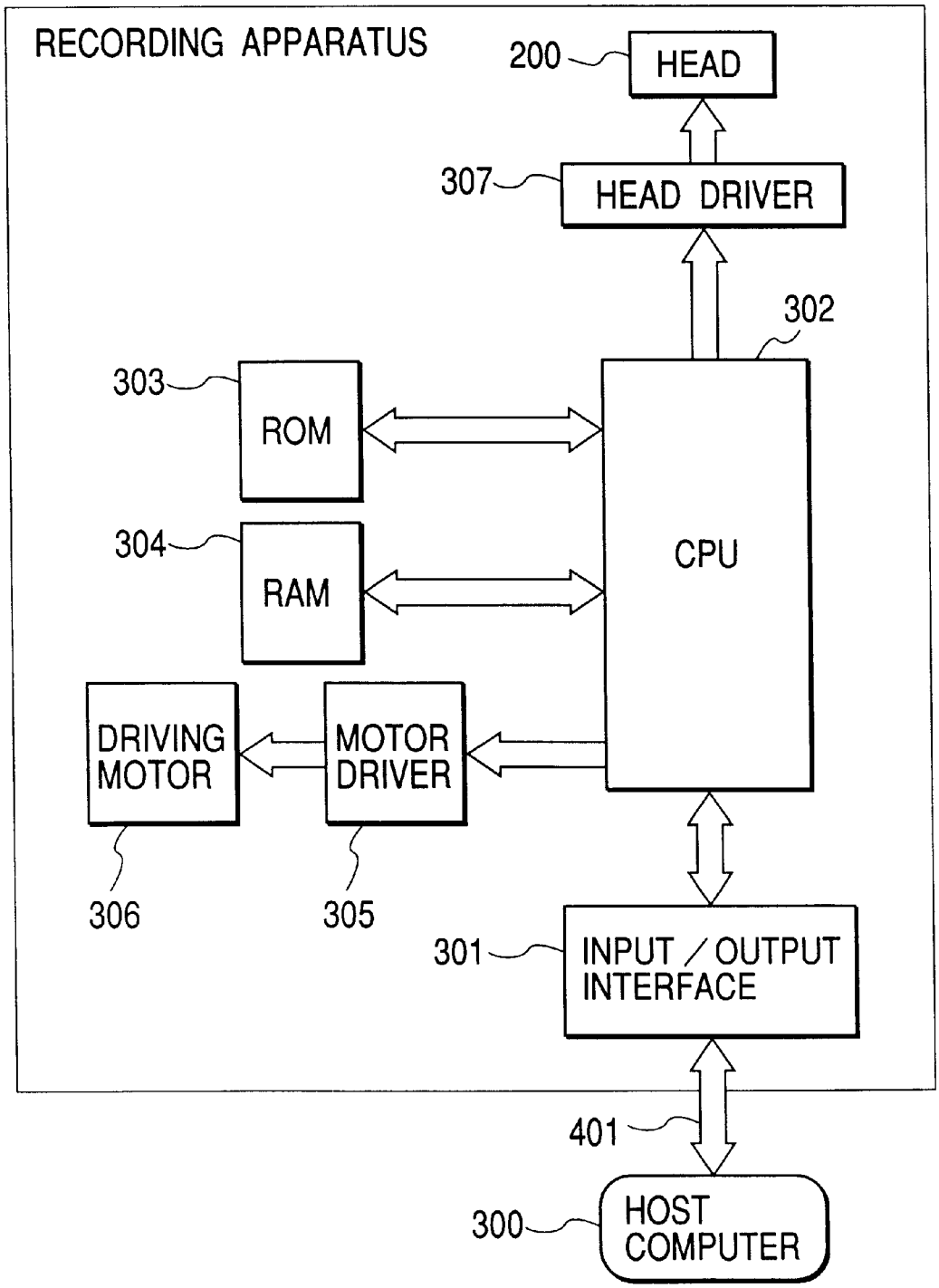
FIG. 28 is a block diagram which shows the entire structure of the apparatus which operates the ink discharge recording to which are applied the liquid discharging method and the liquid discharge head in accordance with the present invention.

FIG. 28 is a block diagram which illustrates the operation of the entire body of the apparatus for the performance of ink jet recording to which the liquid discharging method and the liquid discharge head of the present invention are applicable.

The recording apparatus receives printing information from a host computer 300 as control signals. The printing information is provisionally stored on the input interface 301 in the interior of the printing device. Then, at the same time, the printing information is converted into the data that can be processed in the recording apparatus, and inputted into the CPU 302 that dually serves as means for supplying head driving signals. Using the RAM 304 and other peripheral units the CPU 302 processes the data thus received by the CPU in accordance with the control program stored on the ROM 303, hence converting them into the printing data (image data).

What is claimed is:

1. A liquid discharging method for discharging liquid using pressure exerted by creation of a bubble in a bubble generating area for creating such bubble in said liquid, comprising:

displacing a movable member provided with its free end on a discharge opening side with respect to its movable fulcrum point, wherein said bubble generating area and said movable member are arranged to be in two sets to face each other at least partly, and allowing said two movable members to come closer to each other for discharging said liquid through the discharge opening.

2. A liquid discharging method according to claim 1, wherein said two movable members are contacted with each other at least partly along the creation of the bubble and the development thereof.

3. A liquid discharging method according to claim 1, wherein said two movable members are displaced at timings different from each other.

4. A liquid discharging method according to claim 1, wherein the free end of one of said two movable members regulates the displacement of the other of said two movable members at the time of bubble expansion.

5. A liquid discharge head comprising:

a discharge opening for discharging liquid;

a liquid flow path provided with a bubble generating area for creating a bubble, and communicated with said discharge opening;

a substrate provided with a heat generating element arranged in said bubble generating area for generating heat for creating the bubble; and a movable member provided with a free end in said liquid flow path to face said heat generating element;

wherein liquid is discharged from said discharge opening by displacing said movable member by pressure exerted by creation of the bubble, and wherein said heat generating element and said movable member are arranged to be in two sets to face each other at least partly so that one of said movable members can come closer to the other of said movable members.

6. A liquid discharge head according to claim 5, wherein said two movable members and said two heat generating elements are the same size as each other.

7. A liquid discharge head according to claim 5, wherein said two movable members are in contact with each other at least partly at a maximum expansion of the bubble.

8. A liquid discharge head according to claim 5, wherein said two movable members are the same size as each other, and said two heat generating elements are sized differently from each other.

9. A liquid discharge head according to claim 5, wherein said two movable members are displaced at timings different from each other.

10. A liquid discharge head comprising:

a discharge opening for discharging liquid;

a liquid flow path provided with a bubble generating area for creating a bubble, and communicated with said discharge opening;

a substrate provided with a heat generating element arranged in the bubble generating area for generating heat for creating the bubble; and a movable member provided with a free end on said discharge opening side, and arranged in said liquid flow path to face said heat generating element;

wherein the liquid is discharged from said discharge opening when said movable member is displaced by pressure exerted by creation of the bubble, and wherein said heat generating element and said movable member are arranged to be in two sets to allow said movable members to face each other at least partly through said liquid flow path.

11. A liquid discharge head according to claim 10, wherein said two movable members are in contact with each other at least partly at a maximum expansion of the bubble.

12. A method for discharging liquid comprising:

displacing a movable separation film substantially separating a liquid flow path communicated with a discharge opening for discharging liquid and a bubble generating liquid flow path provided with a bubble generating area for creating a bubble in said liquid, the movable separation film substantially separating the liquid flow path and the bubble generating liquid flow path from each other at all times on an upstream side relative to said discharge opening side with respect to liquid flow in said liquid flow path, wherein said bubble generating area, said bubble generating liquid flow path, and said movable separation film are arranged to be in two sets to allow the movable regions of said movable separation films to face each other at least partly with said liquid flow path being sandwiched between, and wherein said two movable separation films are displaced to come closer to each other.

13. A liquid discharging method according to claim 12, wherein a portion of at least one movable separation film on the downstream side of said two movable separation films with respect to said flow direction of liquid is displaced relatively larger than a portion of said movable separation film on the upstream side thereof.

14. A liquid discharging method according to claim 13, wherein maximum displacement portions of said two movable separation films are allowed to closely face each other.

15. A liquid discharging method according to claim 13, wherein said displacing step takes place midway or thereafter in the creation of the bubble.

16. A liquid discharging method according to claim 13, wherein said displacing step continues substantially from the initial state and thereafter in the creation of the bubble.

17. A liquid discharging method according to claim 13, wherein said displacing step includes the period of displacing range of said movable separation film being expanded from its initial state gradually at least to said downstream side.

18. A liquid discharging method according to claim 13, wherein said displacing step is performed by means for regulating a discharging direction of at least one of said two movable separation members.

19. A liquid discharging method according to claim 13, wherein said displacing step is performed in configuration where said two movable separation films are regulated in advance.

20. A liquid discharging method according to claim 13, wherein said displacing step is performed by regulating the creation of said bubble in the bubble generating liquid flow path.

21. A liquid discharging method according to claim 13, wherein said displacing step is performed by displacing the portion of the movable separation film on the downstream side relatively larger than the portion thereof on the upstream side with respect to the central portion of the movable region.

22. A liquid discharging method according to claim 21, wherein said movable separation film is displaced to allow a point of said movable separation film positioned on the upstream side of the central portion in the initial state to be displaced toward the downstream side.

23. A liquid discharging method according to claim 13, wherein said movable separation film has a nose-type configuration in said bubble generating liquid flow path toward said liquid flow path.

24. A liquid discharging method according to claim 12, wherein stagnating portions are generated for delaying the liquid flow in said liquid flow path between the displacement ranges of said two movable separation movable films themselves.

25. A liquid discharge head for a liquid discharge apparatus comprising:

a liquid flow path communicated with a discharge opening for discharging liquid;

a bubble generating liquid flow path provided with a bubble generating area for creating a bubble in the liquid;

a heat generating element arranged in said bubble generating area to generate heat for creating the bubble; and a movable separation film for separating said liquid flow path and said bubble generating liquid flow path substantially from each other at all times, wherein the liquid is discharged from said discharge opening by displacing said movable separation film by pressure exerted by creation of the bubble, and wherein said liquid discharge head is provided with said heat generating element, said bubble generating liquid flow path, and said movable separation film arranged to be in two sets to allow at least parts of a movable range of said movable separation film to face each other with said liquid flow path therebetween.

26. A liquid discharge head according to claim 25, further comprising means for regulating direction to displace said two movable separation films on the upstream side relative to said discharge opening with respect to liquid flow in said liquid flow path, at the same time, at least a portion of one of said two movable separation films on the downstream side being displaced relatively larger on said discharge opening side than a portion thereof on the upstream side.

27. A liquid discharge head according to claim 26, wherein said means for regulating direction is said movable separation film itself, and said movable separation film is provided with elasticity.

28. A liquid discharge head according to claim 27, wherein said means for regulating direction is a movable member arranged adjacent to said movable separation film.

29. A liquid discharge head according to claim 28, wherein said movable member is provided with a free end on the downstream side of the portion facing said bubble generating area, and a fulcrum point on the upstream side, respectively.

30. A liquid discharge head according to claim 28, wherein said movable member is arranged on said liquid flow path side of said movable separation film.

31. A liquid discharge head according to claim 26, wherein said means for regulating direction is a sagged portion arranged for the portion facing said bubble generating area of said movable separation film, extruding to said bubble generating liquid flow path side when no bubble generation is made, and extruding to said liquid flow path side when bubble generation is made.

32. A liquid discharge head according to claim 31, wherein said sagged portion is formed to present a higher extrusion on the downstream side than the height of extrusion on the upstream side.

33. A liquid discharge head comprising:

a discharge opening for discharging liquid;

a liquid flow path provided with a bubble generating area for creating a bubble, and communicated with said discharge opening;

a heat generating element arranged in said bubble generating area for generating heat for creating the bubble; and a movable member provided with a free end on said liquid flow path to face said heat generating element;

wherein the liquid is discharged from said discharge opening by displacing said movable member by pressure exerted by creation of the bubble, and wherein said heat generating element and said movable member are arranged to be in two sets to face each other at least partly so that one of said movable members can come closer to the other of said movable members.

* * * * *

UNITED STATES PATENT AND TRADEMARK OFFICE

CERTIFICATE OF CORRECTION

PATENT NO. : 6,331,043 B1
DATED : December 18, 2001
INVENTOR(S) : Satoshi Shimazu et al.

It is certified that error appears in the above-identified patent and that said Letters Patent is hereby corrected as shown below:

Column 2,
Line 37, “bubbke” should read -- bubble --;
Line 48, “aby” should read -- by --; and
Line 65, “generationto” should read -- generation to --.

Column 3,
Line 9, “views” should read -- view --;
Line 11, “objectives” should read -- objective --; and “is” should be deleted; and
Line 19, “to” should read -- toward --.

Column 6,
Line 11, “set” should read -- sets --.

Column 18,
Line 49, “member” should read -- members --; and
Line 53, “part” should read -- parts --.

Column 20,
Line 35, “device” should read -- devices --; and
Line 53, “bubble(see” should read -- bubble (see --.

Column 21,
Line 37, “film” should read -- films --; and
Line 42, “such” should read -- such a --.

Column 23,
Line 57, “be disappeared” should read -- disappear --.

Column 24,
Line 24, “device” should read -- devices --.

Column 25,
Line 5, “be disappeared” should read -- disappear --.

Column 26,
Line 24, “be disappeared,” should read -- disappear, --.

UNITED STATES PATENT AND TRADEMARK OFFICE

CERTIFICATE OF CORRECTION

PATENT NO. : 6,331,043 B1
DATED : December 18, 2001
INVENTOR(S) : Satoshi Shimazu et al.

It is certified that error appears in the above-identified patent and that said Letters Patent is hereby corrected as shown below:

Column 27,
Line 2, “device” should read -- devices --.

Column 28,
Line 26, “21D;” should read -- 21D. --; and
Line 49, “device” should read -- devices --.

Column 29,
Line 28, “be disappeared,” should read -- disappear, --.

Column 31,
Line 54, “devices” should read -- device --.

Column 33,
Line 15, “devices” should read -- device --.

Column 34,
Line 14, “of” should read -- of a --.

Signed and Sealed this

Twenty-first Day of January, 2003

JAMES E. ROGAN
*Director of the United States Patent and Trademark Office*